US007699763B2

(12) United States Patent
Perry, Jr.

(10) Patent No.: US 7,699,763 B2
(45) Date of Patent: Apr. 20, 2010

(54) ABDUCTOR CONTRACTION, VARIABLE LEG/KNEE/THIGH/TRUNK AND SPINAL DECOMPRESSION EXERCISE AND REHABILITATION APPARATUS AND METHOD

(76) Inventor: Leroy R. Perry, Jr., 3283 Motor Ave., West Los Angeles, CA (US) 90034

( * ) Notice: Subject to any disclaimer, the term of this patent is extended or adjusted under 35 U.S.C. 154(b) by 0 days.

(21) Appl. No.: 11/973,160

(22) Filed: Oct. 5, 2007

(65) Prior Publication Data

US 2008/0096744 A1 Apr. 24, 2008

Related U.S. Application Data

(60) Provisional application No. 60/850,763, filed on Oct. 12, 2006.

(51) Int. Cl.
*A63B 26/00* (2006.01)

(52) U.S. Cl. ..... 482/144; 482/142

(58) Field of Classification Search ..... 482/144–145, 482/95–97, 142, 148, 135, 139, 101; 297/331, 297/239

See application file for complete search history.

(56) References Cited

U.S. PATENT DOCUMENTS

| | | | | |
|---|---|---|---|---|
| 4,566,693 | A * | 1/1986 | Seidentop et al. | 482/144 |
| 5,135,459 | A * | 8/1992 | Perry, Jr. | 482/144 |
| 5,203,755 | A | 4/1993 | Kaiser | |
| 5,295,936 | A * | 3/1994 | Perry, Jr. | 482/144 |
| 6,030,325 | A | 2/2000 | Ottoson | |
| 6,443,879 | B1 * | 9/2002 | Chen | 482/144 |

* cited by examiner

*Primary Examiner*—Lori Baker
(74) *Attorney, Agent, or Firm*—William W. Haefliger

(57) ABSTRACT

Exercise apparatus, comprises a first support means for the user's legs, a platform mounted on the support means to support a user's legs, there being a hinge connecting the platform to the support means and defining a generally horizontal hinge axis to allow pivoting of the user's trunk about a generally horizontal axis as the user relatively bends his body and his legs means, and extending in spaced, a second support means for the back of the user's body, and means for indexing said second support means at selected angularity relative to the hinge axis.

18 Claims, 56 Drawing Sheets

90°
70°
50°
30°
30
30
30
31
31
20
22
25
32
20a
20b
17
17c
16(1)
16a
16b
16e
17a
19a
11
14
18a
13b

F- 90°

F – 70°

F - 50°

F- 30°

R-90°

E-90°

E – 70°

30°
30
31
38
20
32
20a
20b
500a
500
35
36,36a
19a
11
14
53

50°

30°

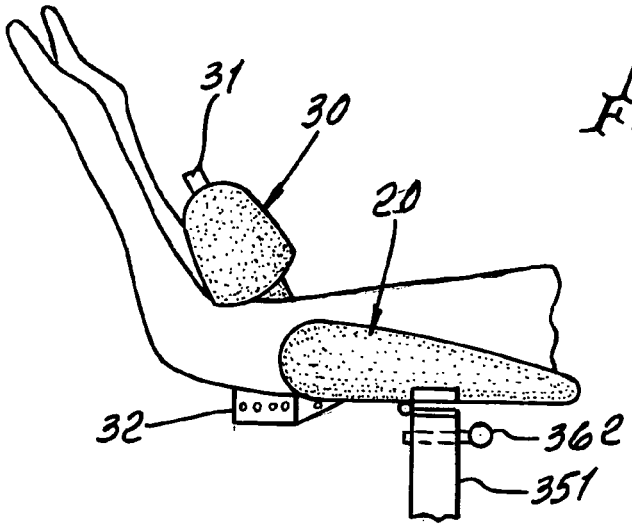
FIG. 29a.
70°
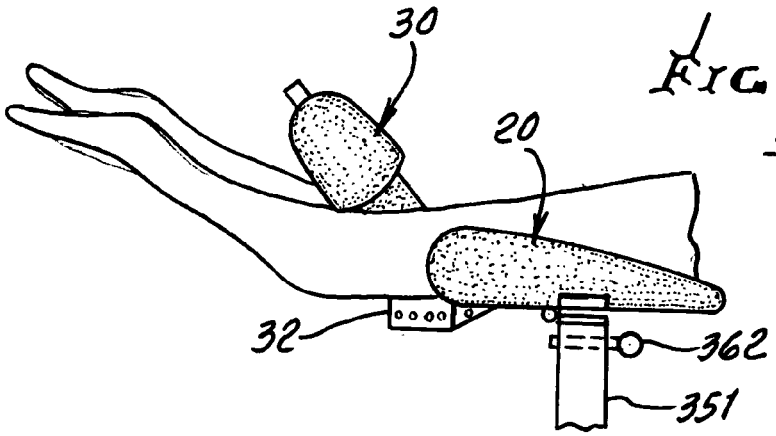
FIG. 29b.
50°
FIG. 29c.
30°
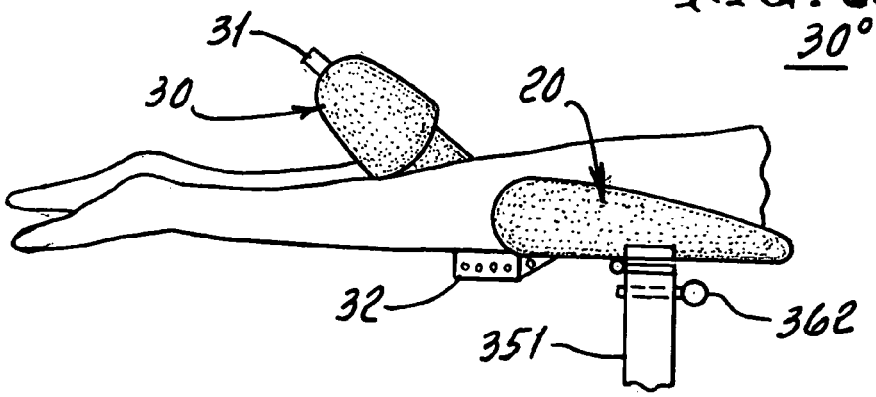

90°
30
20
320
31
362
32
351
366a
366

110°

90°

90°

110°

70°

50°

ABDUCTOR CONTRACTION, VARIABLE LEG/KNEE/THIGH/TRUNK AND SPINAL DECOMPRESSION EXERCISE AND REHABILITATION APPARATUS AND METHOD

This application claims priority from provisional application Ser. No. 60/850,763, filed Oct. 12, 2006.

BACKGROUND OF THE INVENTION

This invention relates generally to body decompression exercise, stretching, strengthening and rehabilitation apparatus, and methods more particularly providing for abductor contraction/stretching and adductor contraction/stretching during relative bending, extending of flexing of the user's trunk, thighs, knees, claves and legs while creating a greater stretch of the hamstrings, gluteal and spinal musculature by altering the position of the legs, thighs, knees, hips and trunk from 90 to 30 degrees more or less while performing flexion, extension and rotational movements of the spine.

Many people suffer from muscle imbalance, outer pelvic abductor muscular dominance and ligament instability causing loss of abdominal core strength, which contributes and creates lower back muscular instability and dominance resulting in the developmental loss of symmetry of intrinsic and extrinsic muscle of the body. This results in compressive imbalance syndromes which can contribute to vascular and neurological deficiencies which can harmfully affect people, particularly the aged. There is a need for an abductor stretching and decompression exercise apparatus with adjustable and variable leg/calf/knee/thigh/trunk and spinal decompression means whereby those who suffer from the aforementioned can exercise biomechanically efficiently to strengthen the necessary musculature to ensure balance, co-ordination and therefore stability and ability to create and reinforce a strong symmetrical development of the body with emphasis on the abductor (outer thigh), abdominal and lower back stability.

SUMMARY OF THE INVENTION

It is a major object of the invention to provide specific methods of exercise and apparatus or equipment that is operable or usable in such manner as to meet the above needs. Basically, the apparatus serves to decompress, distract or extends the user's spine to relieve compression and biomechanical stress while extending or flexing the thighs, knees and legs creating a stretch reflex of the gastrocnemius, soleus, plantaris, popliteal, hamstrings, gluteal and lumbar musculature relieving pressure on spinal disc, and associated anatomy including the nerves and blood vessels. In this regard, the apparatus aids in inducing abductor (outer thigh) contraction, which approximates the posterior aspect of the os ilium while decreasing load on the sacroiliac joints anteriorily. This procedure is accomplished by use of a flat seat using abduction methods, and particularly with a lateral thigh winged seat that ensures abductor contraction or outer thigh grip causing adductor stretching at the same time. Abductor contraction also stimulates lateral abdominal muscle contraction, thereby emphasizing inner pelvic muscle stretching, which is accomplished through isokinetic exercise methods external rotation and movement associated with abductor contraction and inverted flexion or extension movements. This controlled, biomechanical movement not only stretches the adductors, hamstrings, piriformis, gluteus maximus, erector spinal and associated musculature while decompressing the spine, but also strengthens the abductor, lateral or internal/external abdominis obliquus, rectus abdominis and associated abdominal and outer pelvic musculature.

Those who suffer from pathomechanical syndromes including tipped uteruses, bladder, prostrate dysfunction, erectile dysfunction or muscular instability and therefore internal organ pressure or compression in a vertical or horizontal plane as well as those patients with lower abdominal vascular, muscular, and neurological compression, can often benefit from isokinetic and active exercises that produce a combined action of forward flexion and abduction or extension and abduction with the benefit of variable adjustability for trunk, thigh, knee and leg extension and or flexion depending on the needs of the user. Depending on the cause of compression and load adductor or internal rotation of the os ilium may also be beneficial in which the aforementioned variable leg/knee/thigh positions are also applicable.

In some cases, stretching of the abdominal viscera may be helpful. In those cases, extension and even hyperextension may be accomplished with abductor contraction, thereby emphasizing the outer thigh muscle balance relative to adductor dominance as enabled by the invention.

The apparatus of the invention can be used and altered to accomplish a horizontal prone or supine position of the patient in order to perform abdominal sit-ups and curls with varying degrees of load and difficulty by altering the height of the support platform depending upon the needs of the patient for muscular contraction and work load required while emphasizing abductor contraction. An adjustable frame means is provided and allows for height and load variability, from 0 degrees to 45 degrees, therefore creating quadriceps and iliopsoas stretch, as well as abductor and rectus abdominuus contraction thereby altering the load on the associated joints and musculature of the leg, knee, thighs, hips and trunk by carrying the length and degree from vertical to horizontal angle 90, 70, 50, 30 degrees of the vertical rear seat post with a horizontal stabilizing T-bar brace. This creates a stretching and decompression of the user's body with rotational movement upon a base horizontal axis allowing the patient multiple and varying degrees of rotation stretching or strengthening the rectus abdominuus, abdiminis obliquus, abductor and other associated internal pelvic musculature. Means associated with the base and winged seat induces stretching of the user's adductor and associated musculature of the inner thighs while contracting the abductor and associated musculature of the outer thighs relatively away from one another in response to the trunk pivoting, for producing posterior or external rotation of the user's ilium, thereby inducing stretching of the adductor, inguinal ligaments and associated musculature repositioning the os ilium onto the sacrum. The winged seat apparatus can also be rotated on the horizontal pivotal axis thereby increasing or decreasing spinal load, contraction or resistance. These techniques are beneficial to those suffering from the aforementioned maladies and particularly scoliosis, kyphoscoliosis, degenerative disc disease, arthritis and are believed unique with respect to the multiple angles, uses, and contour formation of the novel apparatus. A winged seat associated with the platform and variable vertical post with adjustable horizontal stabilizing T-bar brace also contributes to flexion or extension and induced contraction of the user's outer thighs and legs away from each other maximizing spinal decompression for those suffering from adductor dominance.

The apparatus may also have a telescopic vertical single post, dual posts or A-frame to vary the height and angles of the flat or winged seat, both for prone or supine positions, allowing for changes of biomechanical stress throughout the body.

Such apparatus may be dismantled for use by the military, athletic teams or others who can benefit from the portability and use of this apparatus.

Yet another object is to provide method, exercise, stretching and rehabilitative apparatus that includes:

a) a support means, b) a flat or winged seat with base plate and variable rear vertical post with adjustable horizontal stabilizing T-bar brace mounted on the support means to support the user's thighs and legs, and to allow pivoting of the user's trunk about a generally horizontal axis as the user relatively flexes or extends his trunk, thighs, knees and legs, c) and other means associated with the flat or winged seat to induce stretching of the inguinal ligaments and associated adductor musculature relatively away from each other in response to trunk pivoting producing posterior and external rotation of the user's os ilium and pelvis, thereby inducing approximation of the user's os ilium toward the sacrum, distracting and decompressing the spine, d) the other means including a posterior vertical adjustable post with a T-bar brace. The posterior vertical adjustable post can be positioned more or less 90, 70, 50, 30 degrees, the variable adjustable angulations of changes work load or mechanical stress on all the associated joints, muscles and structures of the body decompressing and ensuring symmetrical balance and coordination achieved by means of distractive forces and counter balancing inverted exercises.

The crosspiece may be pivotally mounted to pivot about a horizontal transverse axis relative to the platform. Auxiliary strut means may be connected to the crosspiece and to the support means at a level below the platform; and the auxiliary strut means may include relatively movable members adjustable to control the tilt angle of the crosspiece. Elevation of the horizontal crosspiece which the platform seat rests upon and attached to the vertical adjustable telescopic tubes with holes and stabilizing security pins providing the means by which multiple heights may be achieved by lifting the horizontal crosspiece and platform seat to desired height and placing the pins in the appropriate holes.

Yet another object is the provision of a horizontal crosspiece mounted on the support means and carried for adjustable positioning relative to the platform. Carriage structure may be supported on the support means to carry the crosspiece for adjustable positioning in multiple dimensions, relative to the platform. Both the platform and crosspiece may have common pivoted support to pivot about the same horizontal axis, relative to the support means. The horizontal stabilizing means by which the pivotal action of the mounted seat can rotate in a horizontal transverse axis around the crosspiece is stopped by means of stop blocks, hinged or other means mounted on the crosspiece which control how far the seat is allowed to rotate. In order for the user to mount the rear T-brace horizontal stabilizing bar with calf/knee pads, the adjoining seat is positioned in a vertical position compared to the floor with the T-bar angled at 90 degrees or parallel to the ground. It is the forward rotational forces and body weight of the user that creates pivotal rotation in the horizontal transverse axis until the user's feet are vertical or in a desired angle as the user's body is inverted. It is this means and action with the variable degrees of user's calf/knee/thigh and trunk with abductor and external rotation of the os ilium or adductor and internal rotation of the os ilium that provides an extremely beneficial distractive and decompressive method, exercise and rehabilitative apparatus for those with weak abdominal muscles and who have unstable backs. It is these bad back pain sufferers especially those who have spinal compression and degeneration with adductor or abductor dominance who will receive the greatest benefits of this unique and novel apparatus and method.

As the spine and associated anatomy is decompressed, circulation and oxygenation throughout the body is increased. The Autonomic Nervous System made up of the sympathetic and parasympathetic nerves are stimulated thereby increasing motor and sensory function of the body creating and enhancing balance and co-ordination, acupuncture meridians are also stimulated increasing Yin/Yang Chi flow. This process of homeostasis is significantly enhanced by decompressing the body directly benefiting all persons from athletes, to non-athletes, military, police, firemen or anyone who suffers from macrotraumatic high compressive stress/impact and or accumulative micro traumatic compression injuries often seen in children as well as the aged, all who will significantly be helped by these decompression means, methods and uses of the apparatuses.

These and other objects and advantages of the invention, as well as the details of an illustrative embodiment, will be more fully understood from the following specification and drawings, in which:

DRAWING DESCRIPTION

FIG. 1 is a side elevation showing one form of apparatus A-Frame with triangular ribbed delta and with a flat or winged saddle seat/base plate apparatus with adjustable vertical post with variable horizontal T-bar brace and calf/knee pads adjustable/variable means from about 90 to 30 degrees, the front legs interconnect inferiorly to a front horizontal cross floor brace, the rear legs interconnect inferiorly to a rear horizontal cross floor brace; left legs are also interconnected by left stabilizer bar, right legs are also interconnected by right stabilizer bar;

FIG. 1*a*, is a side elevation showing similar apparatus, with alternative positioning of elements;

FIG. 1*b*, is a side elevation showing FIG. 1 apparatus in other positions of elements;

FIG. 1*c*, is an enlarged side elevation showing a portion of FIG. 1 with alternative element positions;

FIG. 1*d* is an enlarged rear elevation showing a portion of FIG. 1;

FIG. 1*e* is an enlarged elevation like FIG. 1*b;*

FIG. 1*f* is an enlarged rear elevation similar to FIG. 1*d;*

FIGS. 1*aa*, 1*bb*, 1*cc* are side, front and rear elevations of FIG. 1 apparatus, in perspective;

FIG. 1*dd*, 1*ee*, 1*ff*, 1*gg* and 1*hh* are elevations that show modified apparatus;

Figure 25:
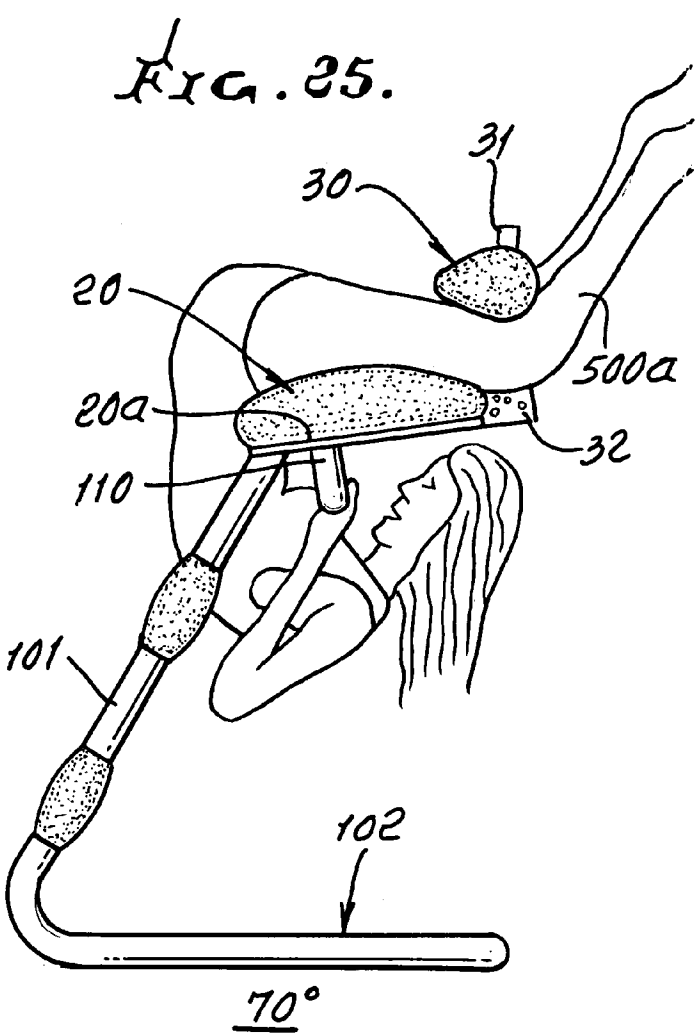
Figure 24:
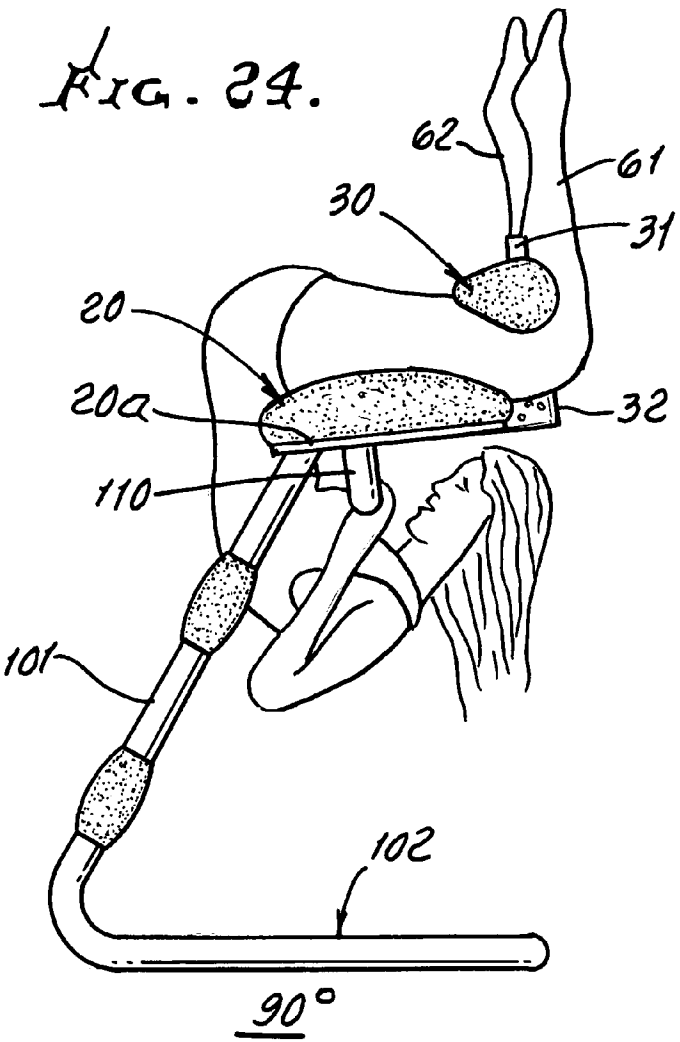
Figure 26:
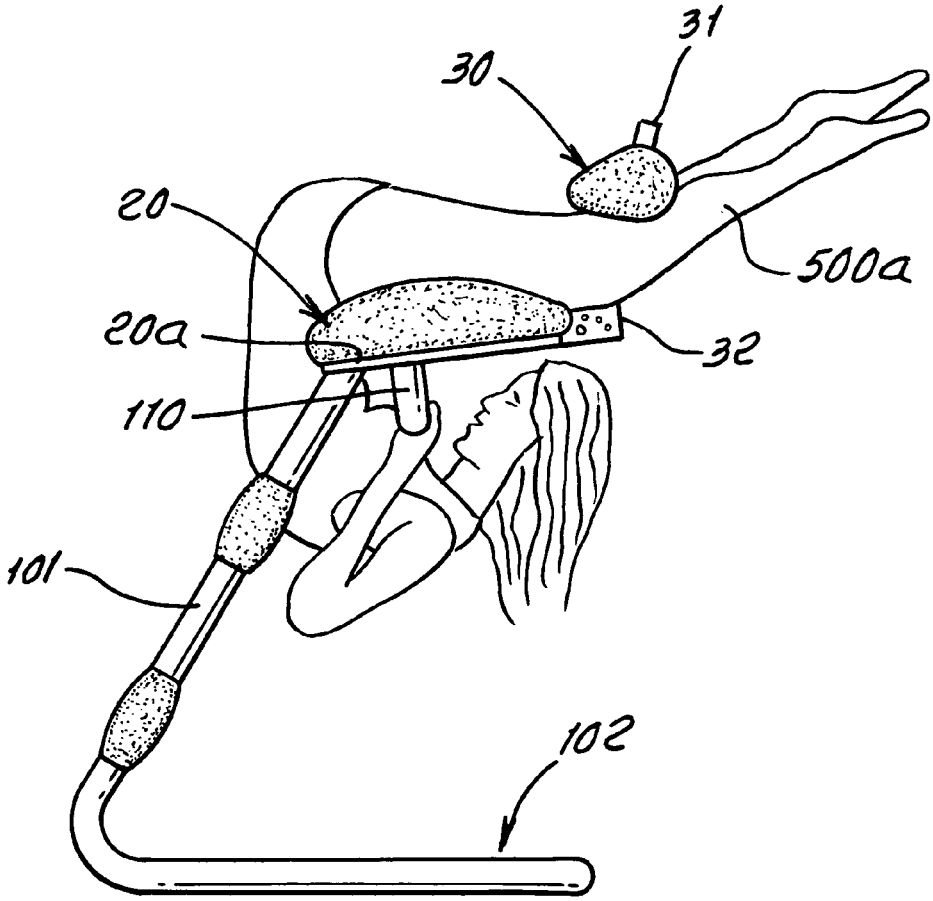
Figure 27:
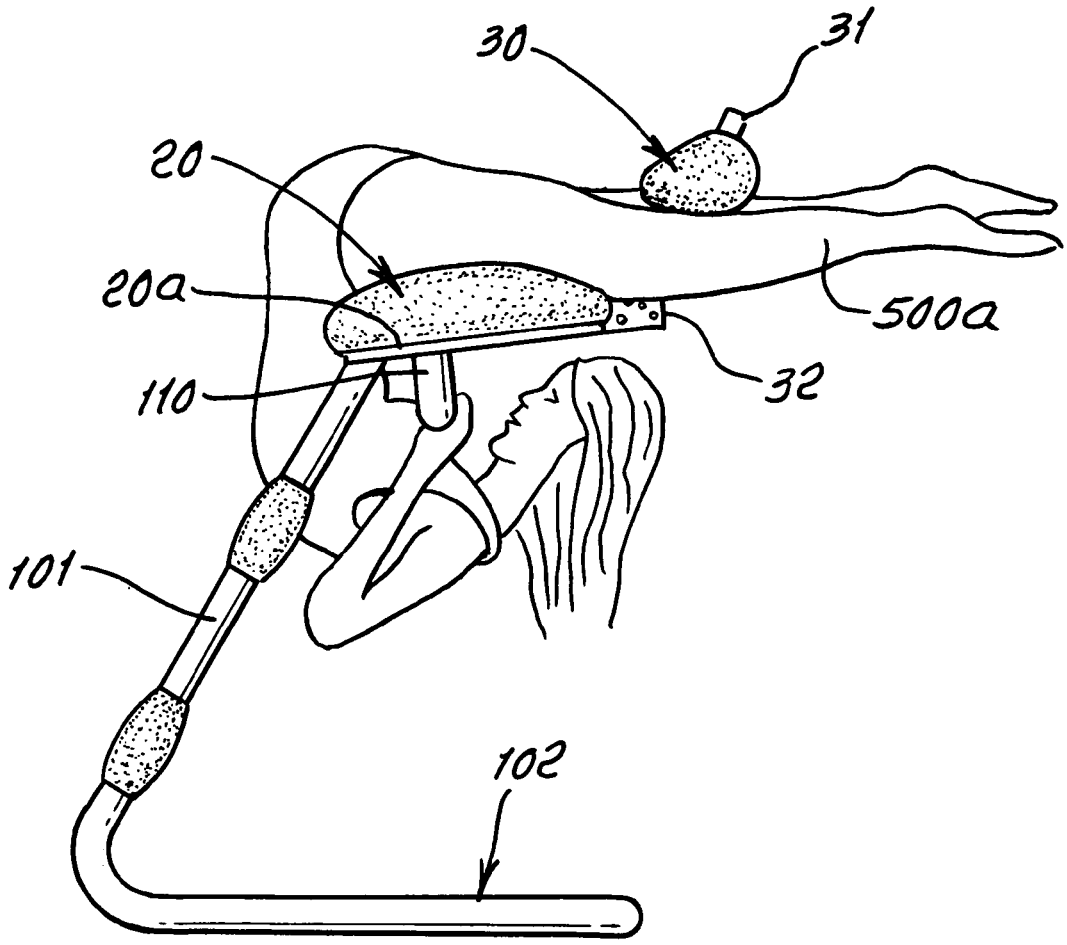
Figure 28:
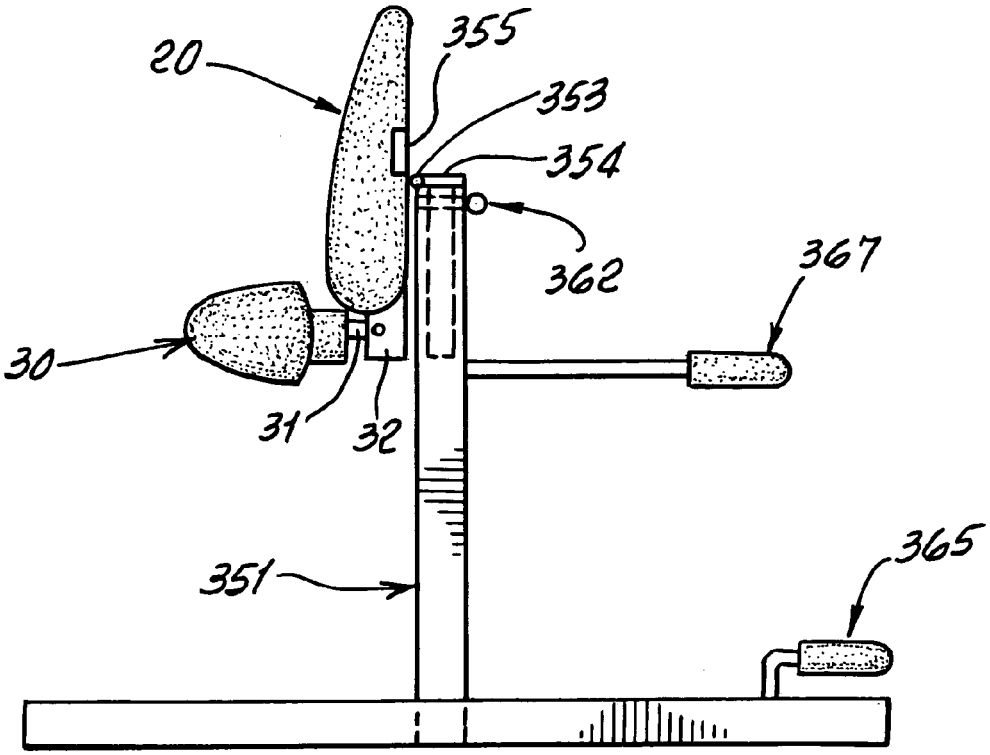
Figure 28A:
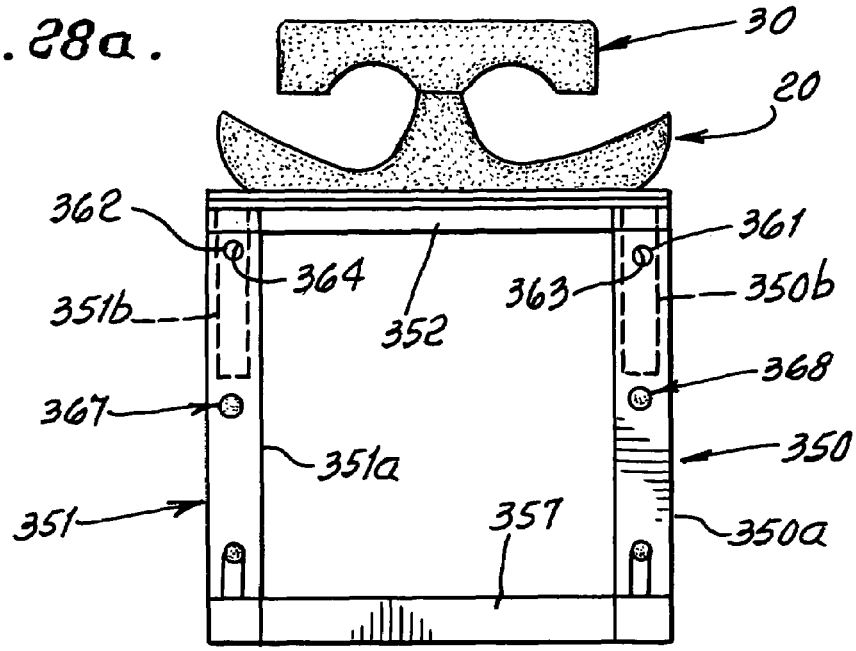
Figure 28B:
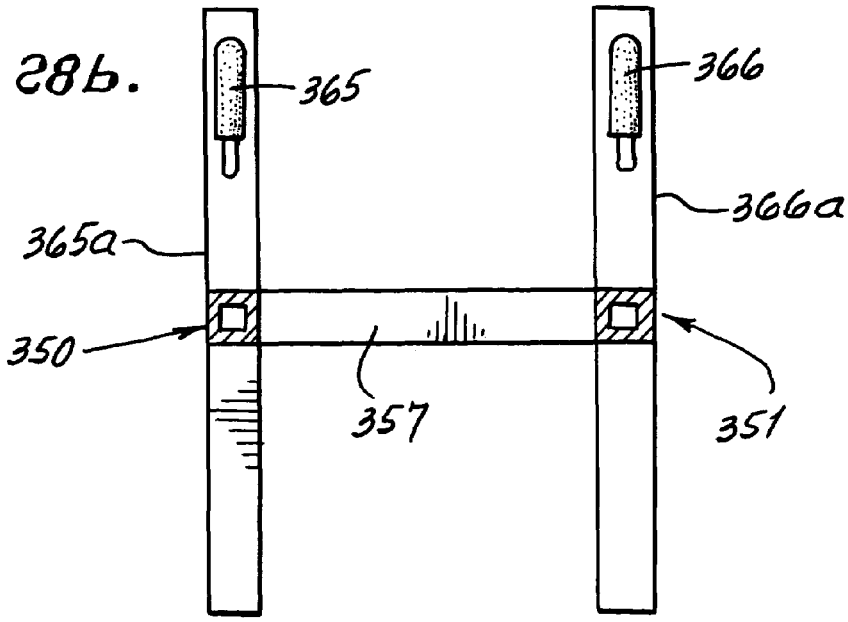
Figure 29:
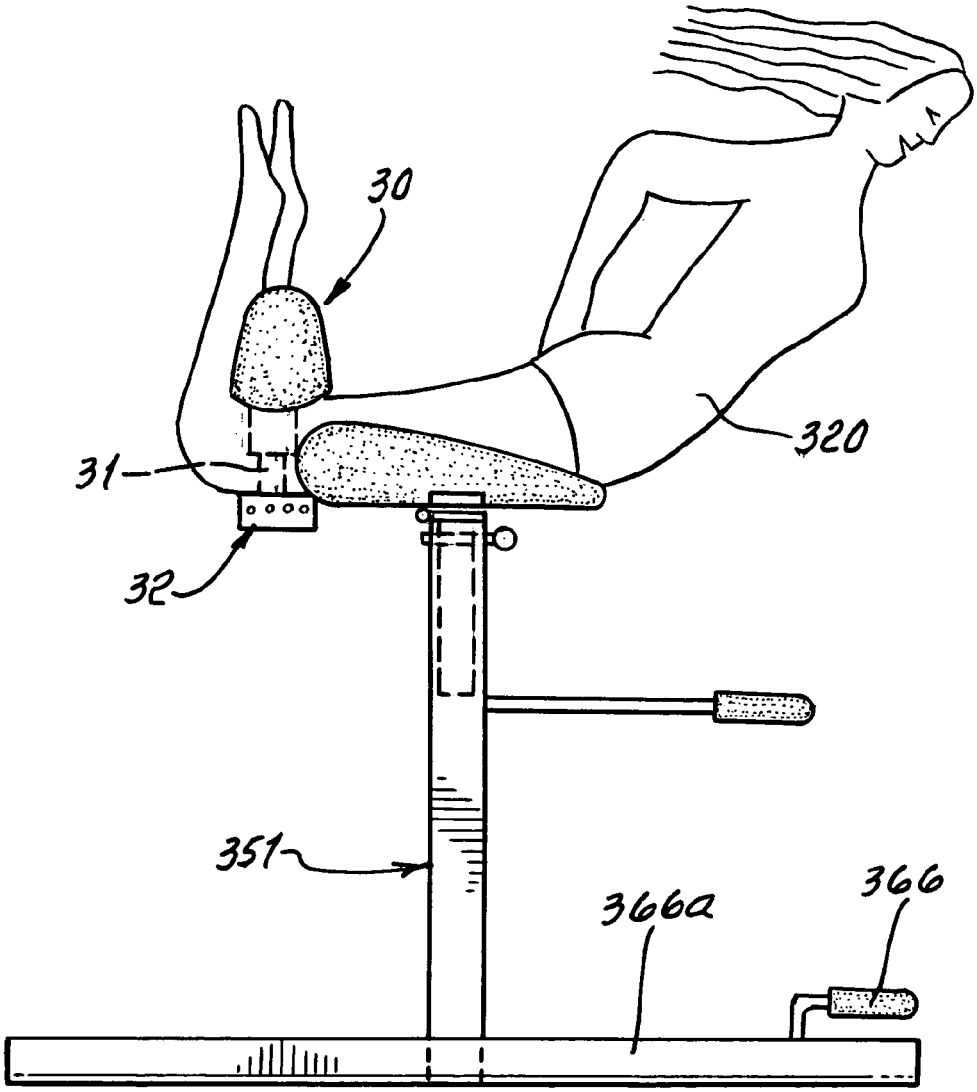
Figure 30:
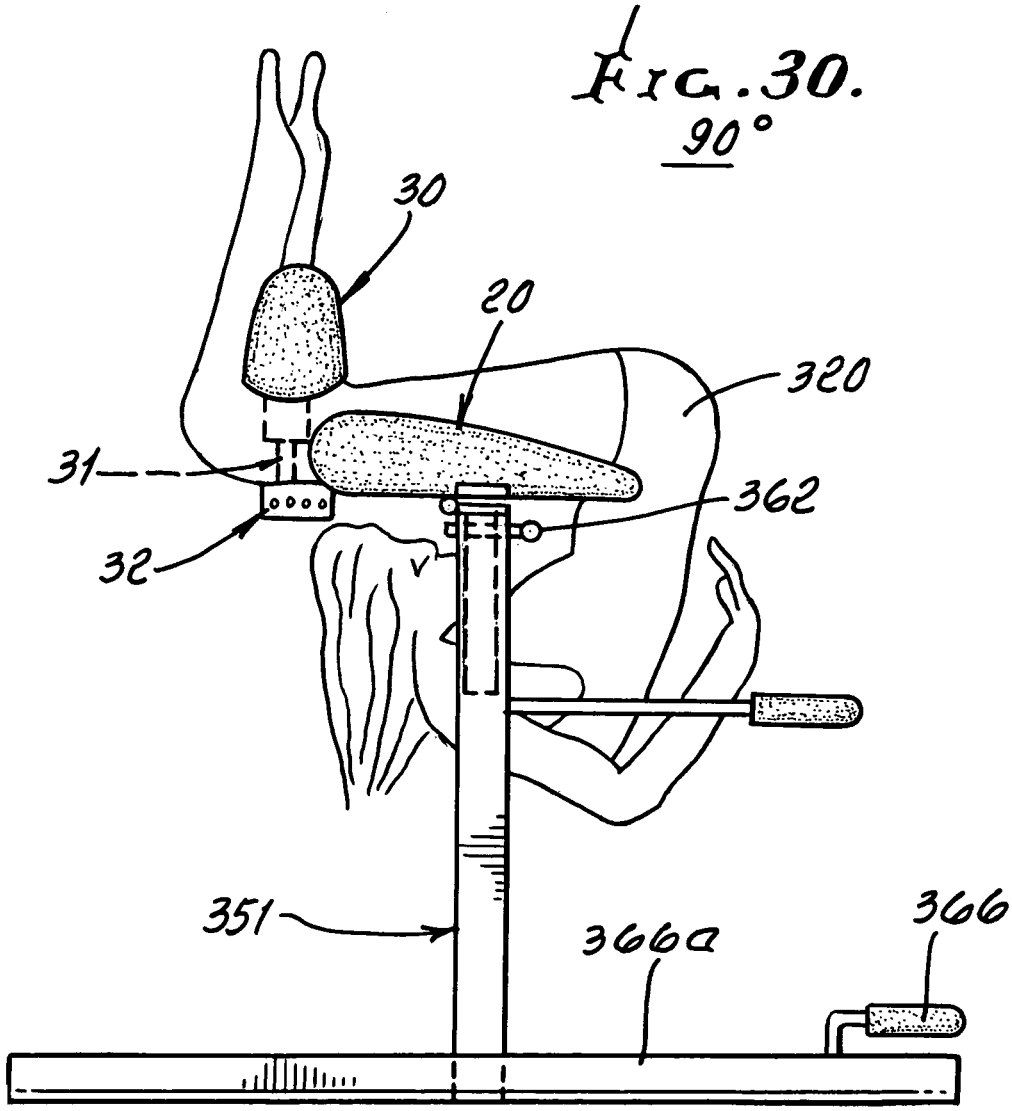
Figure 31:
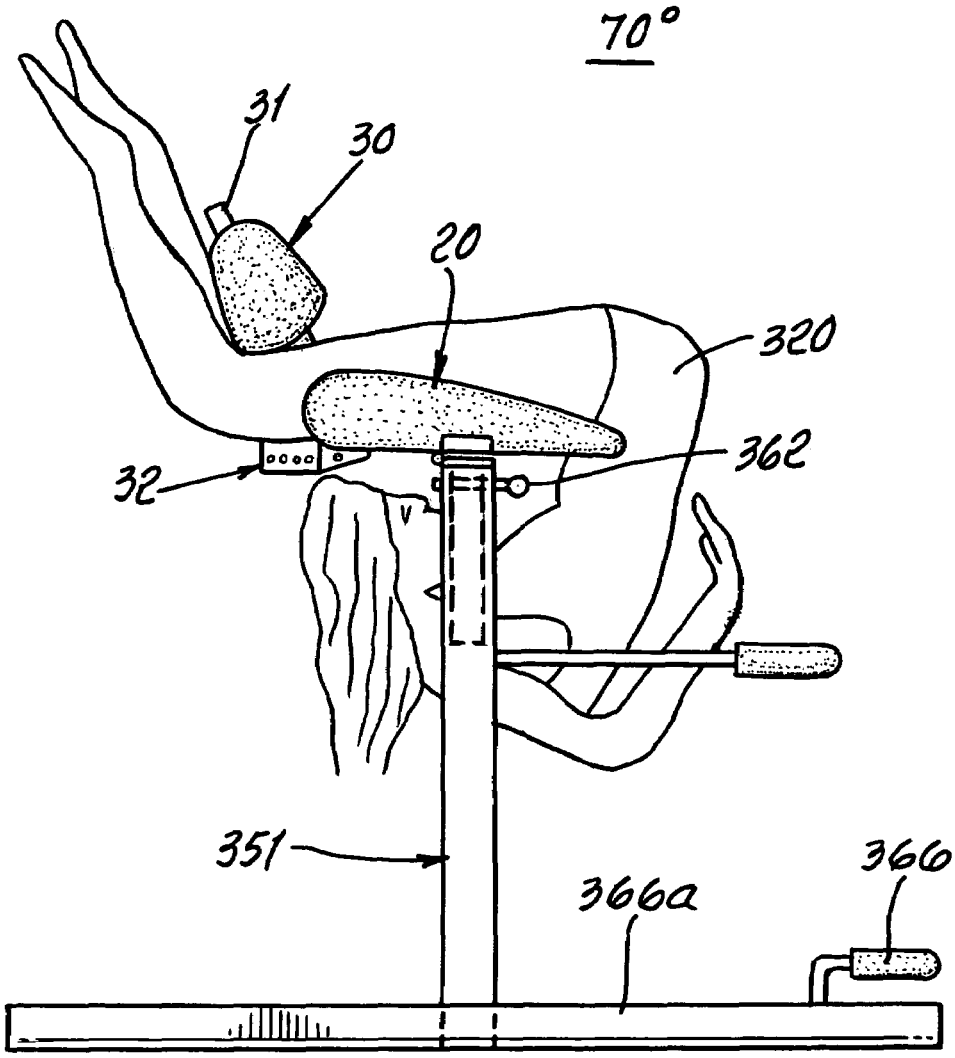
Figure 32:
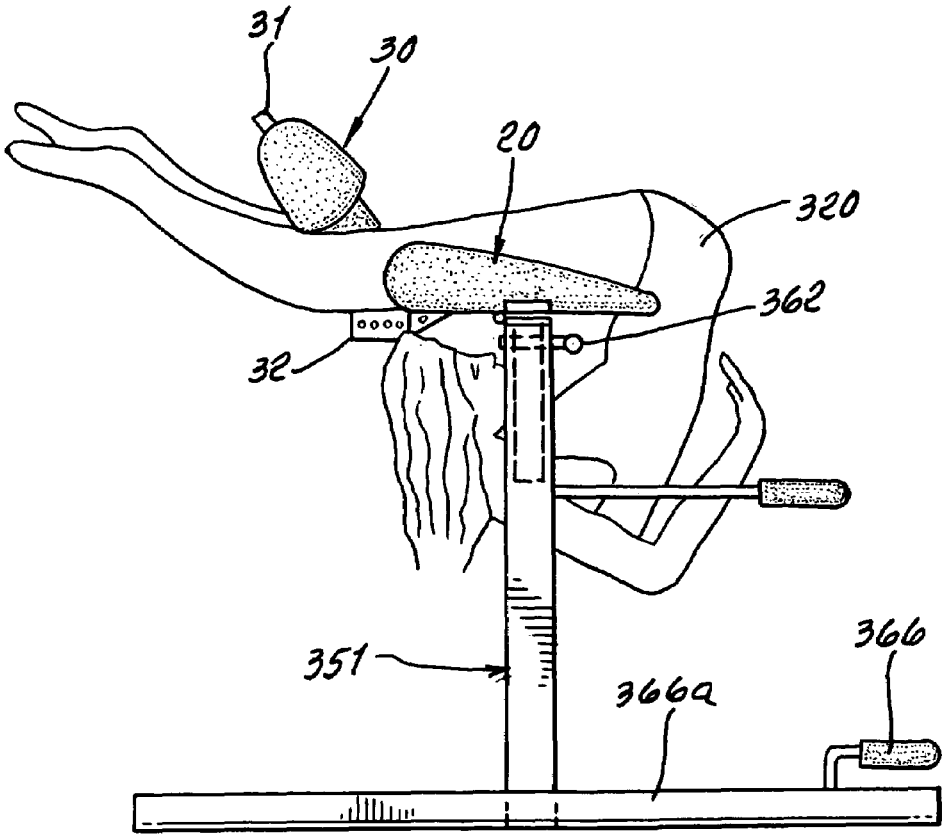
Figure 33:
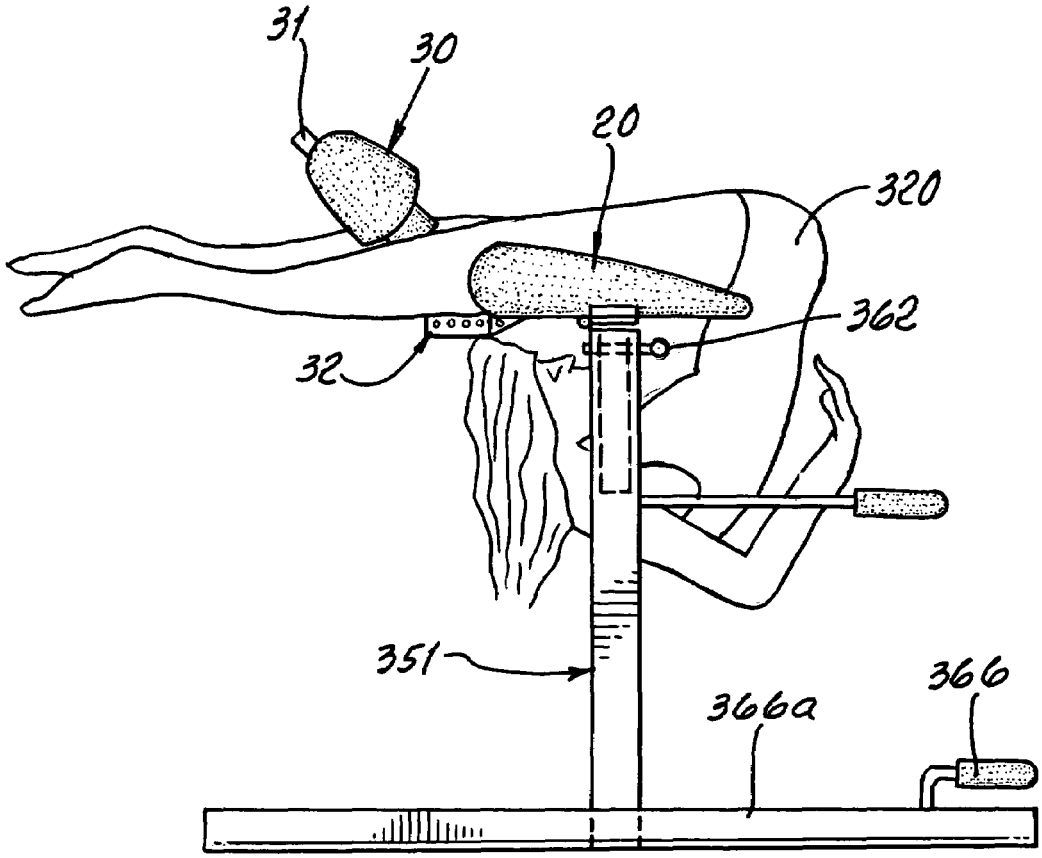
Figure 34:
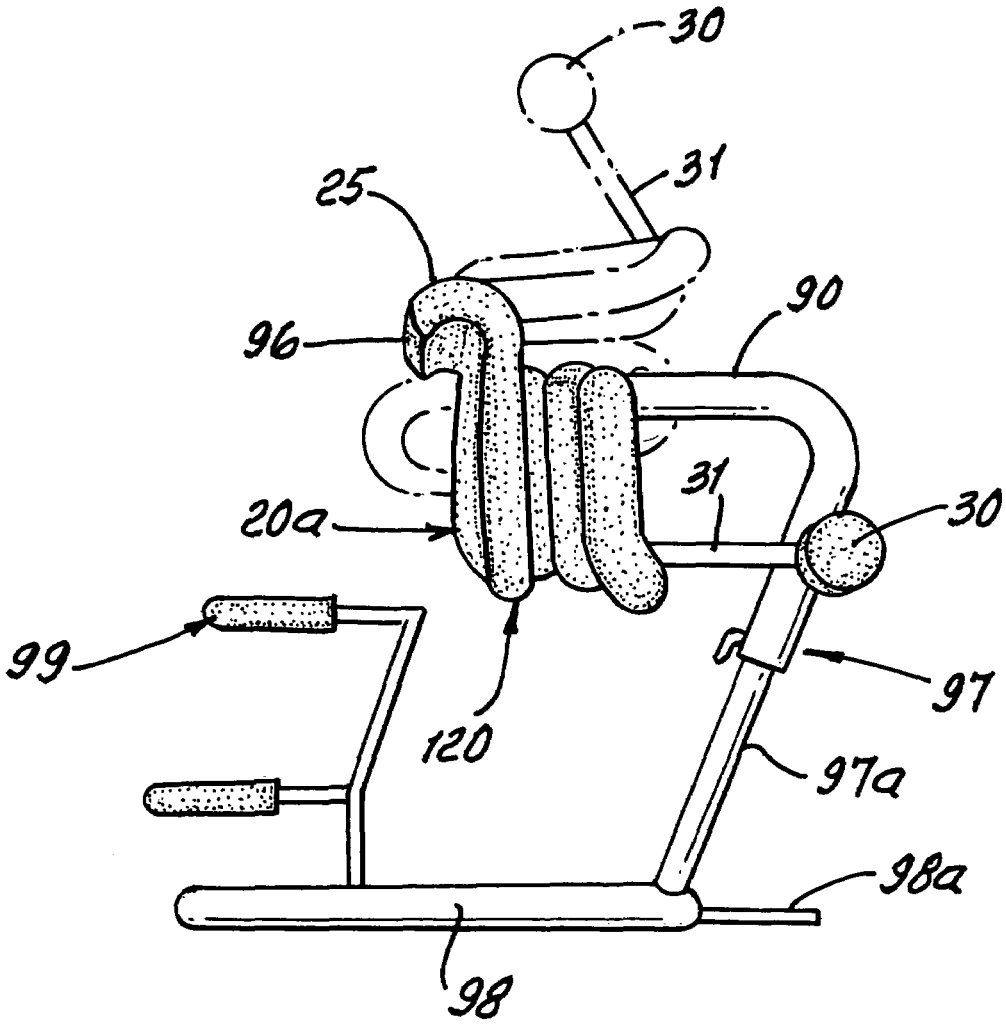
Figure 34B:
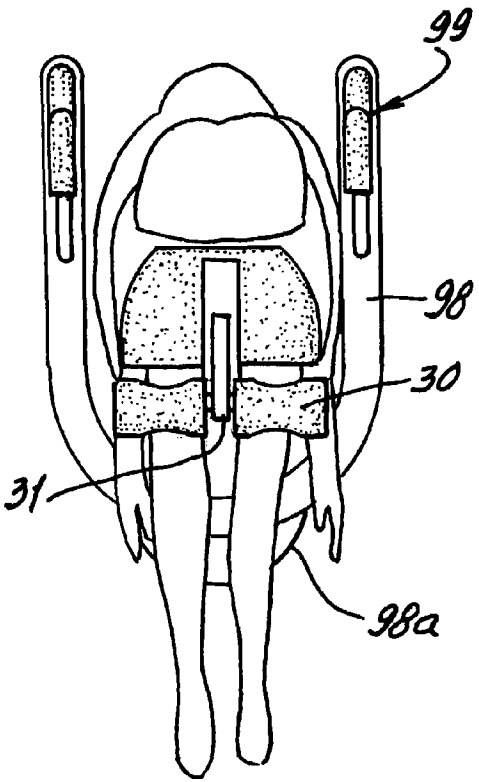
Figure 34A:
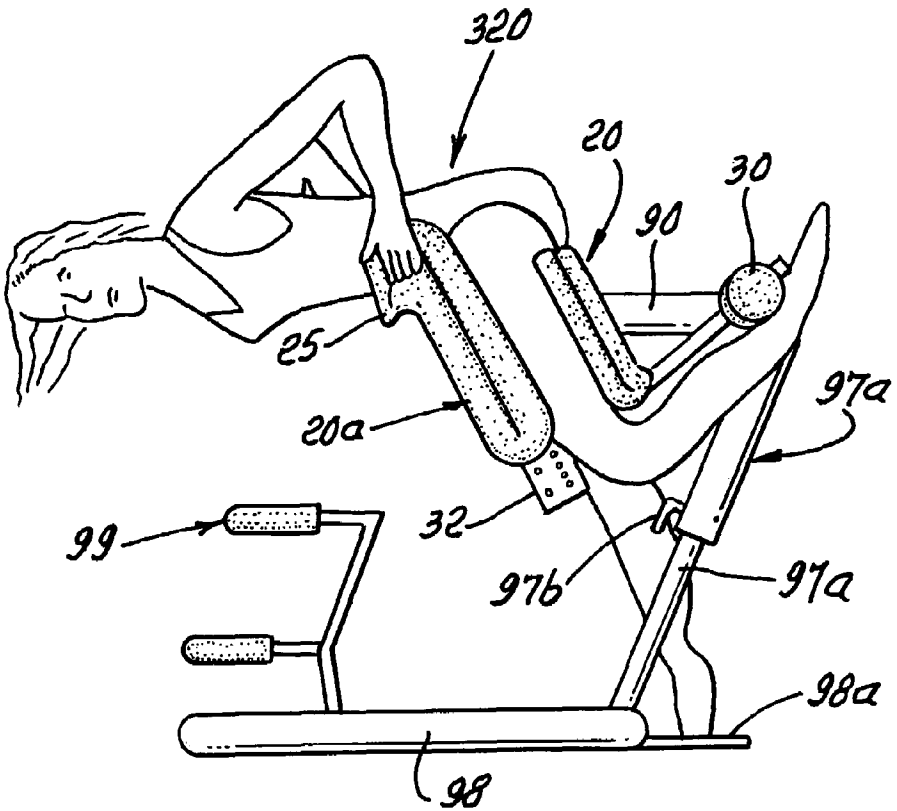
Figure 34C:
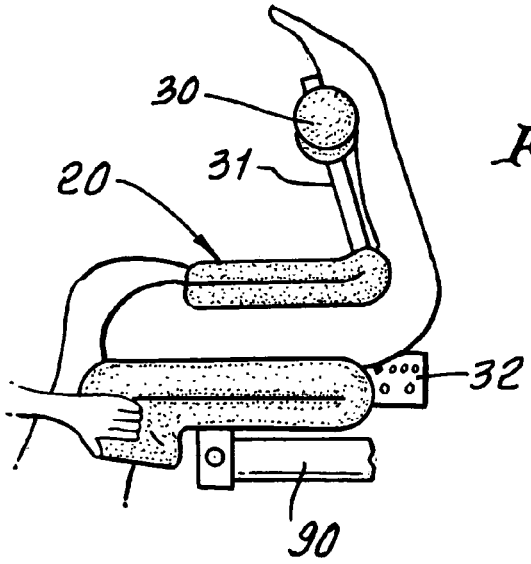
Figure 34D:
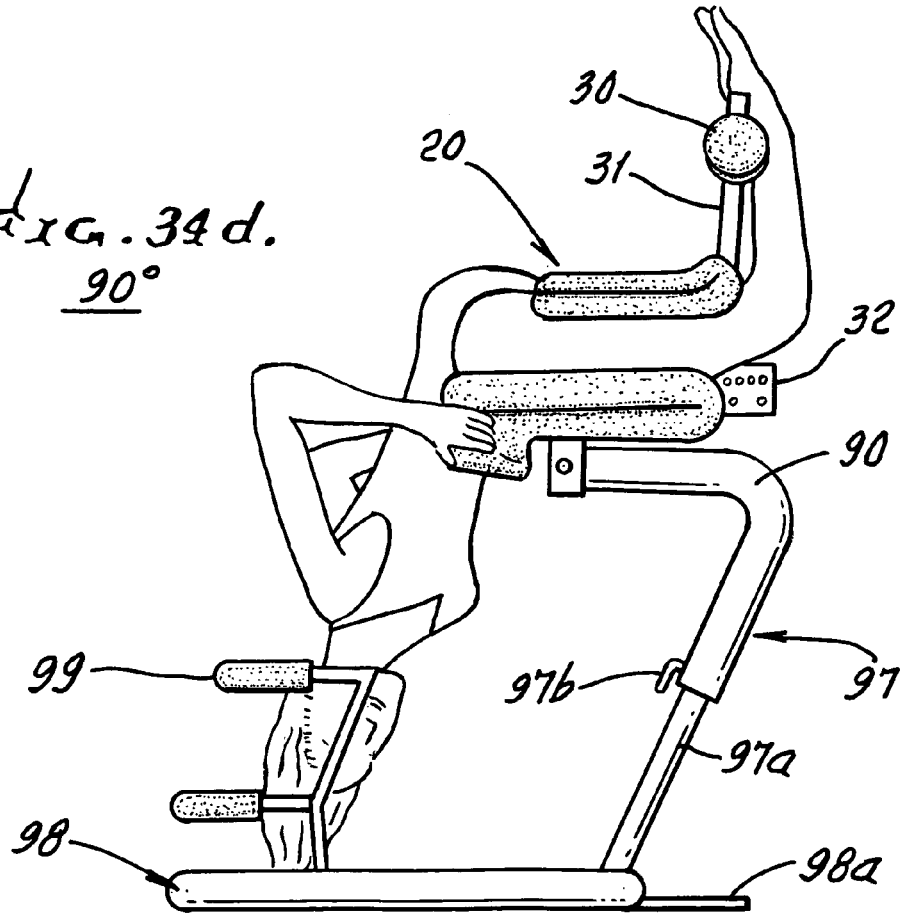
Figure 34E:
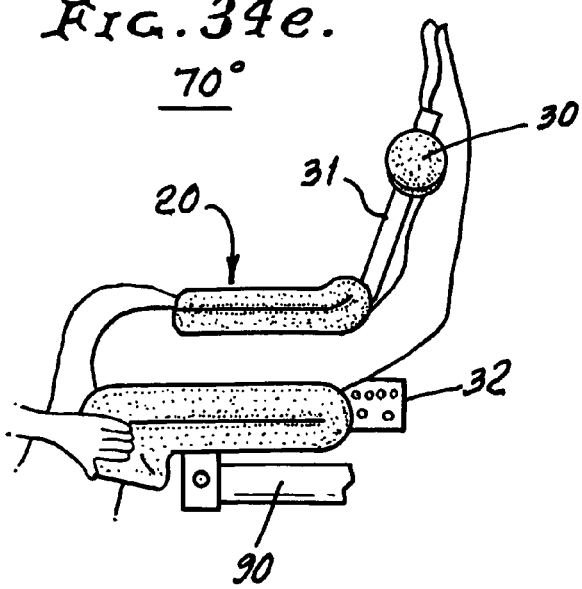
Figure 34F:
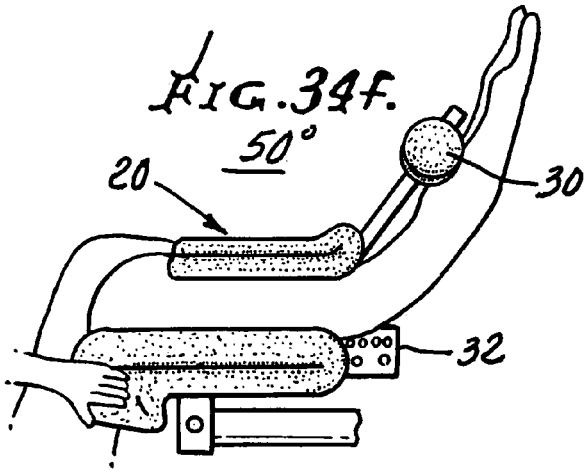
Figure 34G:
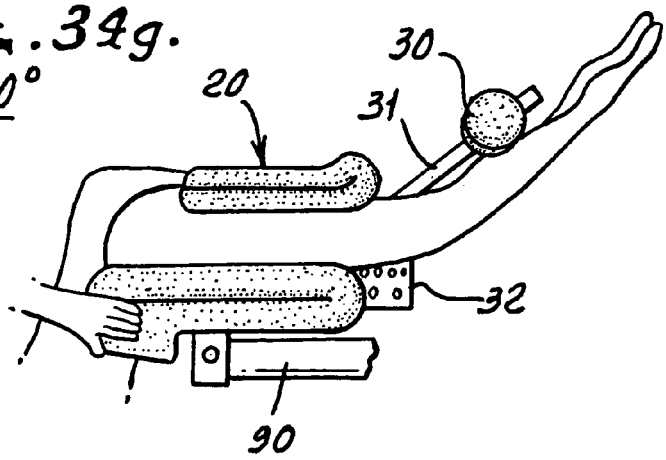
Figure 35:
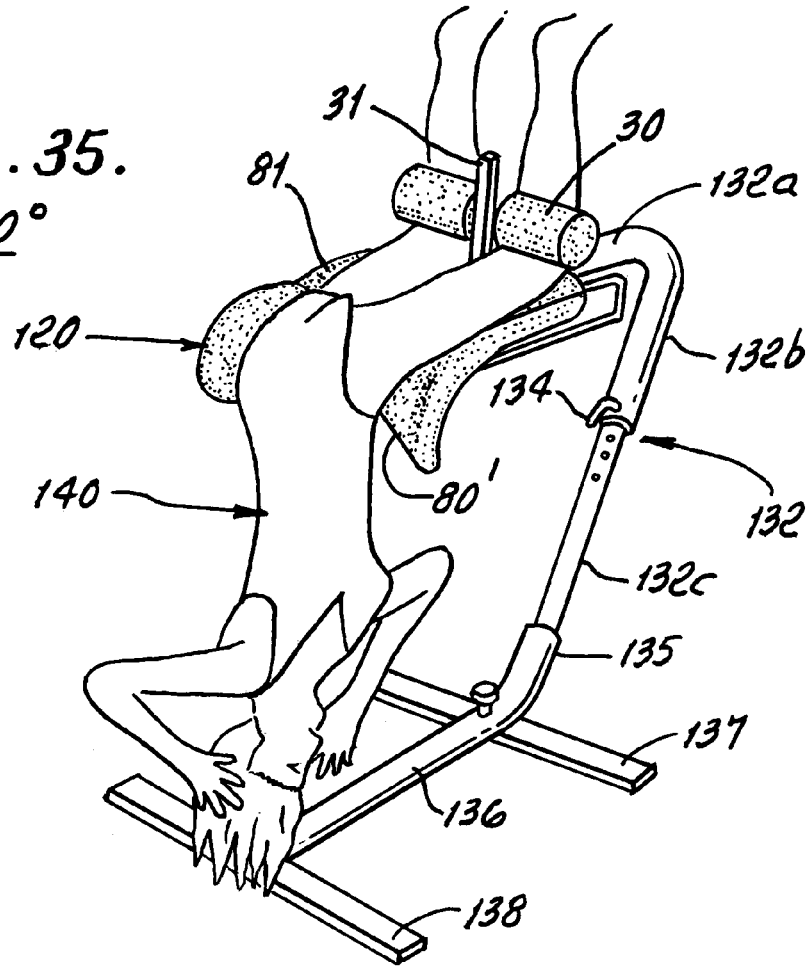
Figure 35A:
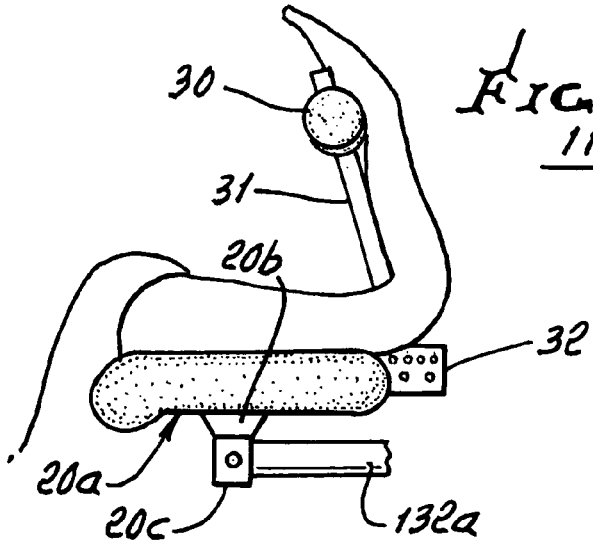
Figure 35B:
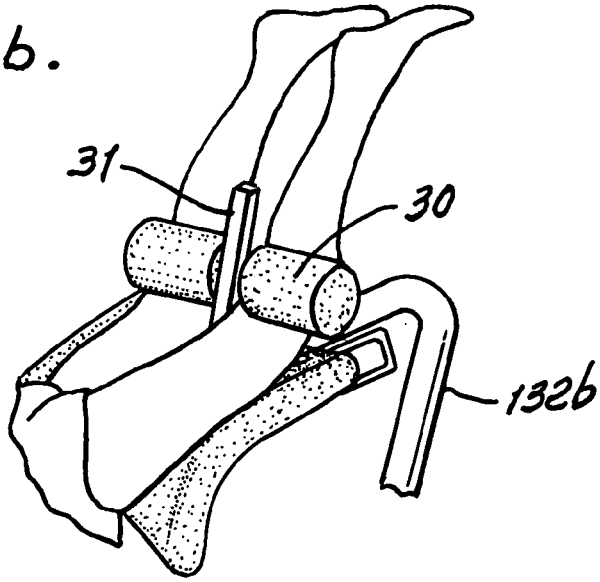
Figure 35C:
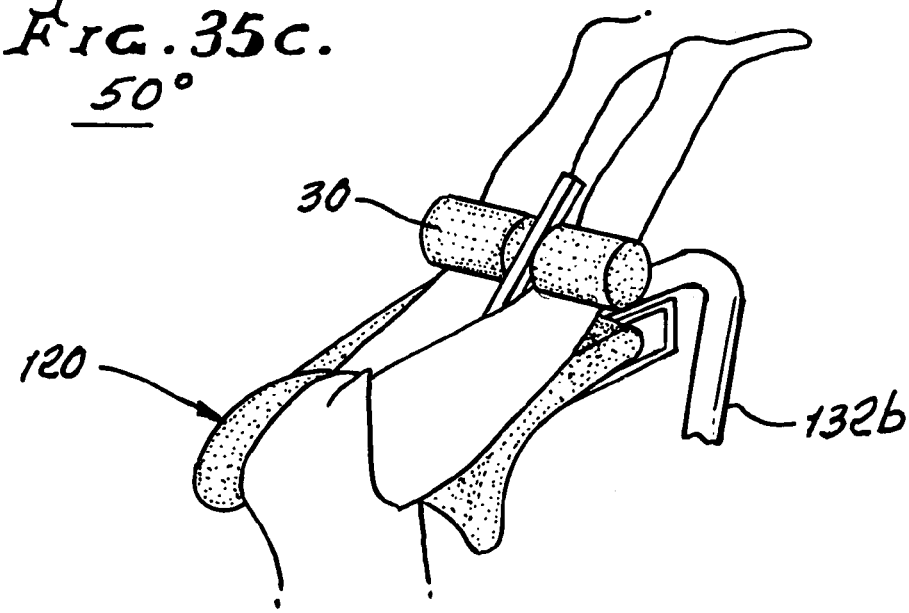
Figure 35D:
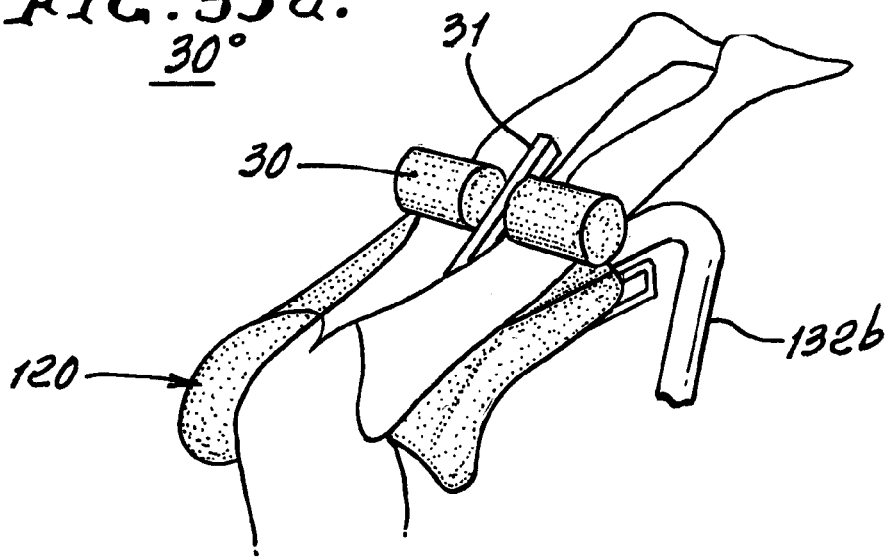
Figure 35E:
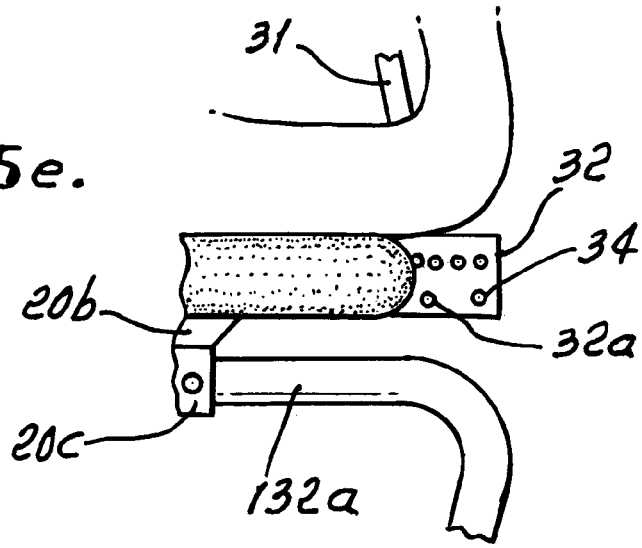
Figure 36:
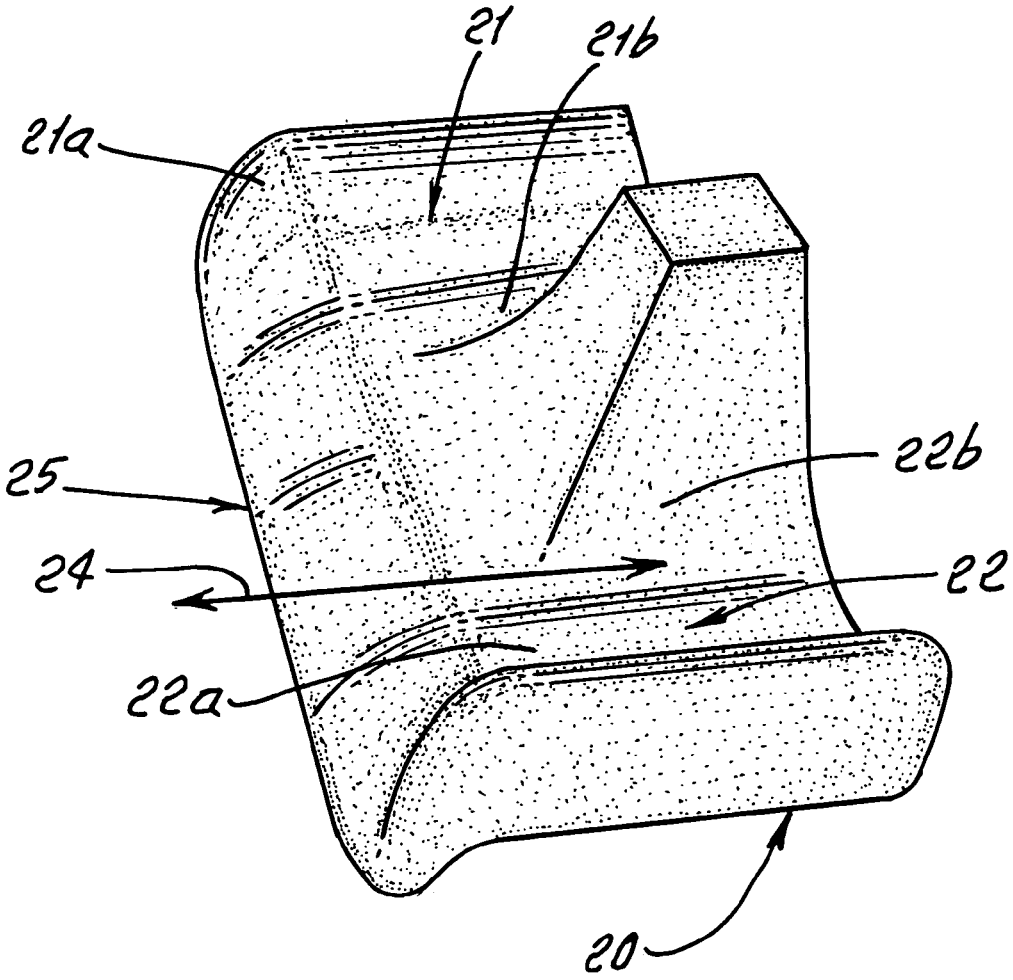
Figure 36A:
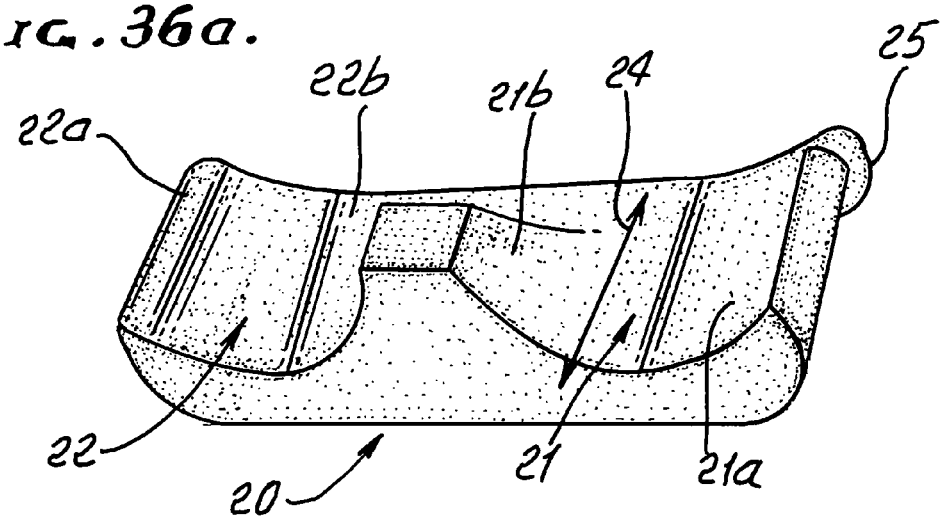
Figure 36B:
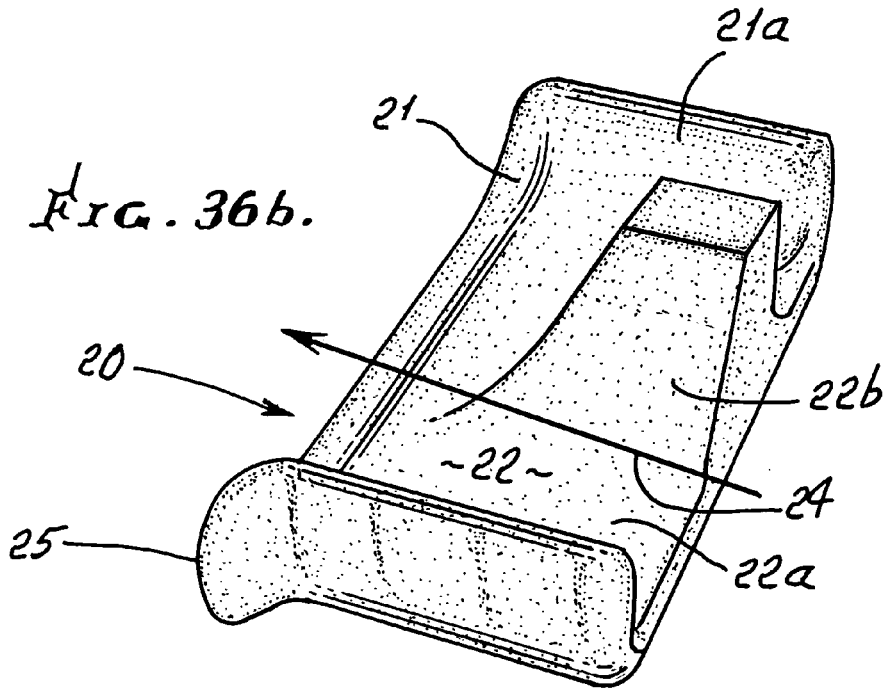
Figure 36C:
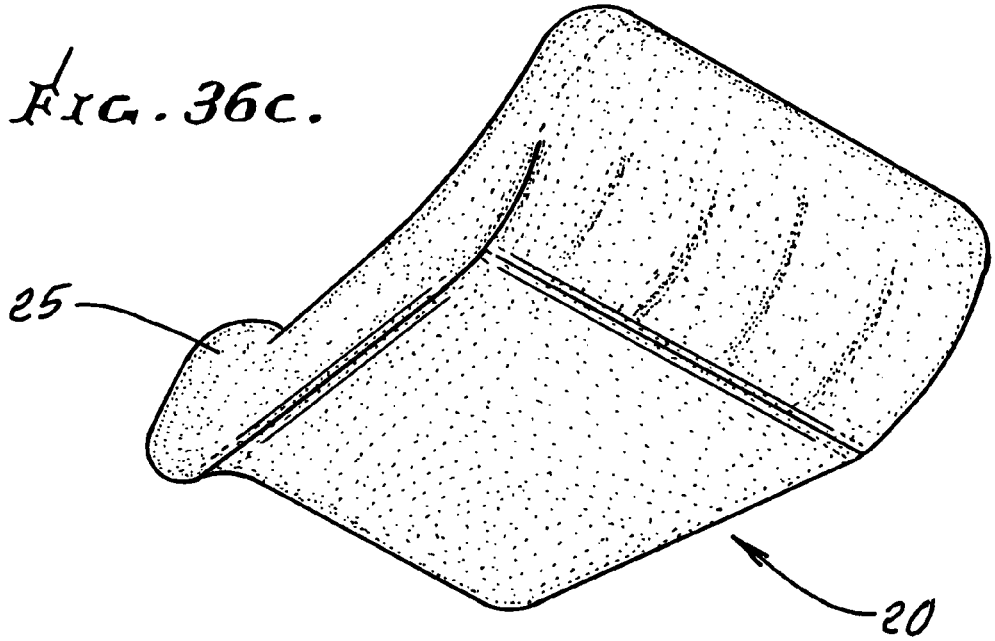
Figure 36D:
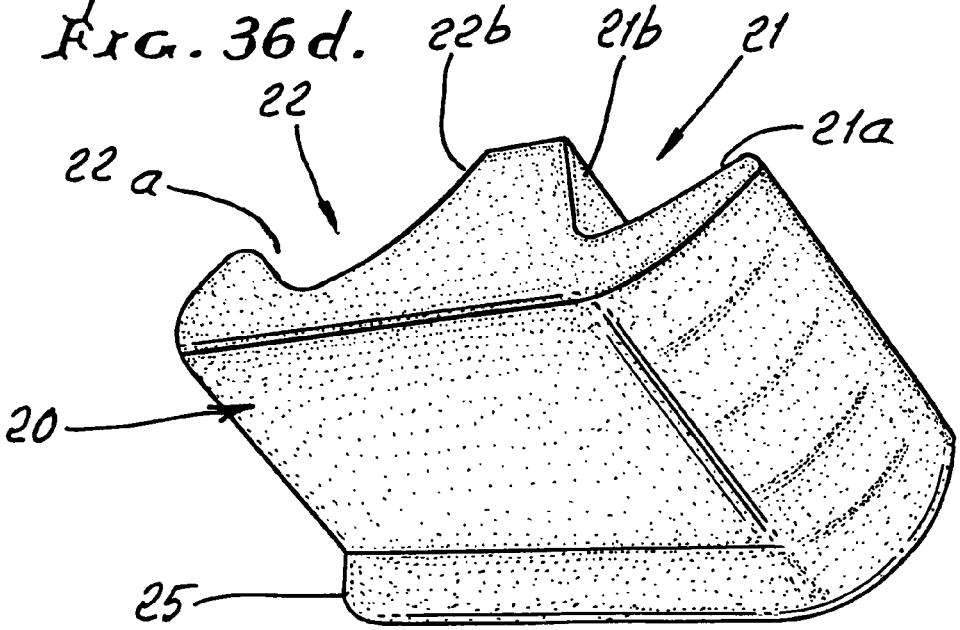
Figure 37:
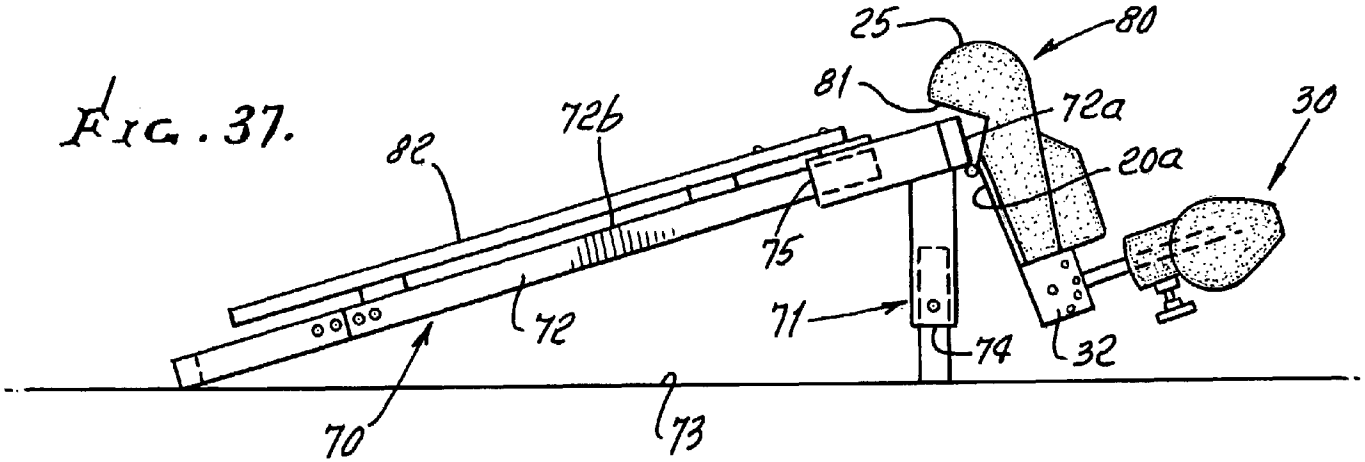
Figure 37A:
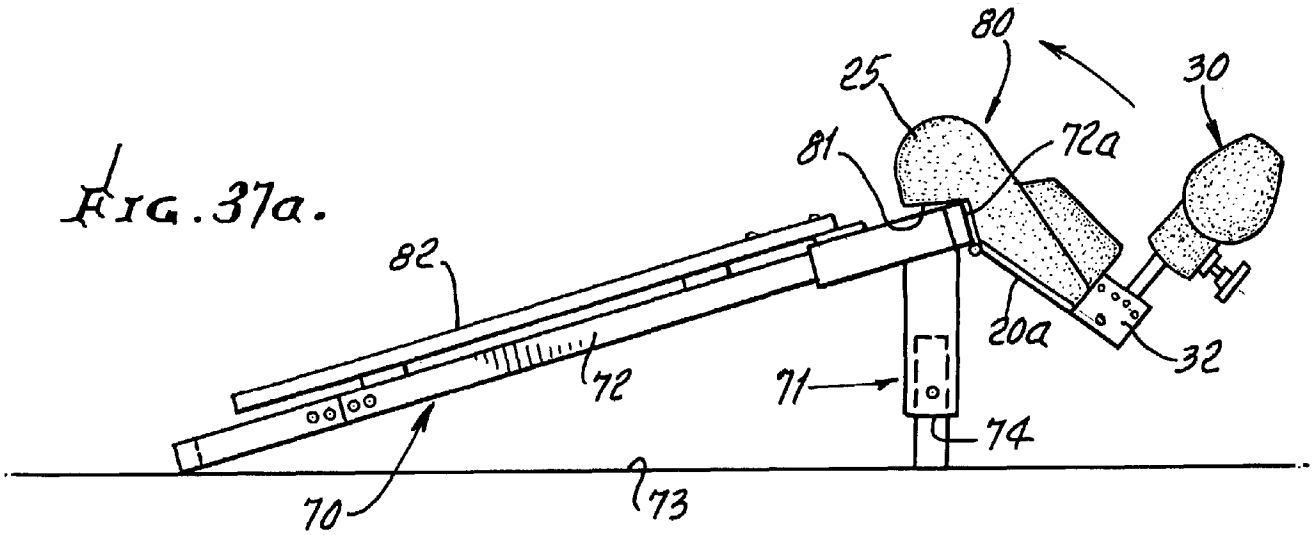

FIG. 24 is a side elevation showing modified apparatus with posterior 45 degree double/bilateral legs or posts support, the user hanging in a spinal/trunk flexed position legs bent 90 degrees, adjustable vertical post with variable horizontal T-bar brace and calf/knee pads behind the legs, knees bent 90 degrees;

FIG. 25 is a side elevation showing modified apparatus, with posterior 45 degree double/bilateral legs or posts support, the user hanging in a spinal/trunk flexed position legs bent 70 degrees, adjustable vertical post with variable horizontal T-bar brace and calf/knee pads behind the legs, knees bent 70 degrees;

FIG. 26 is a side elevation showing modified apparatus with posterior 45 degree double/bilateral legs or posts support, the user hanging in a spinal/trunk flexed position, legs bent 50 degrees, adjustable vertical post with variable horizontal T-bar brace and calf/knee pads behind the legs, knees bent by apparatus at 50 degrees;

FIG. 27 is a side elevation showing modified apparatus with posterior 45 degree double bilateral legs or posts support, the user hanging in a spinal/trunk flexed position legs bent 30 degrees, adjustable vertical post with variable horizontal T-bar brace and calf/knee pads behind the legs, knees bent by apparatus at 90 degrees;

FIG. 28 is a side elevation showing modified apparatus, seat rotated into vertical position with double/bilateral legs or posts which support the cross member base and seat laterally;

FIG. 28*a* is a front elevation showing modified apparatus having double/bilateral legs or posts with saddle seat and rear calf/leg support pads, legs/posts and seat being connected to telescopic extensions within double legs or posts, adjustment that allows for variation of seat heights;

FIG. 28*b* is a top plan view showing modified apparatus double legs or posts with frame in H floor pattern indicating vertical telescopic ports and handgrips;

FIG. 29 is a side elevation showing modified apparatus, seat rotated into horizontal position, with double/bilateral legs or posts which support the cross member base and seat laterally, user hanging in a spinal/trunk extended position with capabilities to 70 degrees trunk extension or more, legs bent by apparatus at 90 degrees, FIG. 29*a* 70 degrees, FIG. 29*b* 50 degrees;

FIG. 29*c* shows an adjustable vertical post with variable horizontal T-bar brace and calf/knee pads behind the legs, knees bent by apparatus at 90, 70, 50, 30 degrees, user performing an hyper extended movement;

FIG. 30 is a side elevation showing modified apparatus, seat rotated into horizontal position, with double/bilateral legs or posts which support the cross member base and seat laterally, user hanging in a spinal/trunk flexed position, legs bent by apparatus at 90 degrees, adjustable vertical post with variable horizontal T-bar brace and calf/knee pads behind the legs, knees bent 90 degrees, user performing an inverted tucked abdominal curl;

FIG. 31 is a side elevation showing modified apparatus, seat rotated 0-90 degrees or more with double/bilateral legs or posts which support the cross member base and seat laterally, user hanging in a spinal/trunk flexed position, legs bent 70 degrees, adjustable vertical post with variable horizontal T-bar brace and calf/knee pads behind the legs, knees bent by apparatus at 70 degrees, user performing an inverted tucked abdominal curl;

FIG. 32 is a side elevation showing modified apparatus, seat rotated into horizontal position, with double/bilateral legs or posts which support the cross member base and seat laterally, user hanging in a spinal/trunk flexed position, legs bent 50 degrees, adjustable vertical post with variable horizontal T-bar brace and calf/knee pads behind the legs, knees bent by apparatus at 50 degrees, user performing an inverted tucked abdominal curl;

FIG. 33 is a side elevation showing modified apparatus, seat rotated into horizontal position, with double/bilateral legs or posts which support the cross member base and seat laterally, user hanging in a spinal/trunk flexed position, legs bent 30 degrees, adjustable vertical post with variable horizontal T-bar brace and calf/knee pads behind the legs, knees bent by apparatus at 30 degrees, user performing an inverted tucked abdominal curl;

FIG. 34 is a side elevation perspective views showing further modified apparatus single leg or single post support demonstrating versatility and mechanism of seat (note dotted versus solid lines) variable rotation from 0-90 degrees with stop block bracket to prevent seat from forward tipping more than 90 degrees or less than 0 degrees with adjustable vertical post and with a modified and improved variable horizontal T-bar brace and calf/knee pads, knee/leg bent of flexed up to 110 degrees or more, (see FIGS. 34*a, b, c, d, e*, and *f* for function);

FIG. 34*a* is a side elevation perspective view showing further modified apparatus with single leg or single post support with the user mounting and hanging in a spinal/trunk flexed position, adjustable vertical post with variable horizontal T-bar brace and calf/knee pads behind the legs, left knee/leg bent by apparatus at 110 degrees or more;

FIG. 34*b* is an over head birds eye elevation perspective view showing further modification with flat or winged seat with thigh support and adjustable vertical post with variable horizontal T-bar brace and calf/knee pads behind the legs/calf/knee, this unique design allows for greater flexion 110 degrees or more of the knee as the seat apparatus is split sagitally, in this modification the horizontal T-bar and vertical post are stabilized body weight and position;

FIGS. 34*c*, 34*d*, 34*e*, 34*f* and 34*q* are side elevation and communications of FIGS. 34, 34*a*, and 34*b*, this perspective view showing further modified apparatus single leg or single post support with the user hanging in a spinal/trunk flexed/rotated position knee/leg bent at varying degrees, (FIG. 34*c* 110 degrees, 34*d* 90 degrees, FIG. 34*e* 70 degrees, FIG. 34*f* 50 degrees, FIG. 34*q* 30 degrees, more or less);

FIG. 35 is a side elevation perspective views showing further modified apparatus single leg or single post support with two floor cross stands/mounts user hanging in a spinal/trunk rotary flexed position showing further modification with winged contoured seat and adjustable vertical post with variable horizontal T-bar brace and calf/knee pads behind the legs/calf/knee, legs and knees bent 90 degrees, FIG. 35*a* legs and knees bent 110 degrees, FIG. 35*b* legs and knees bent 70 degrees, FIG. 35*c* legs and knees bent 50 degrees, FIG. 35*d* legs and knees bent 30 degrees more or less;

FIG. 35*e* this modification, showing elements present in FIGS. 34, 34*a*, 34*b*, 34*c*, 34*d*, 34*e*, 34*f*, 34*q*, 35, 35*a*, 35*b*, 35*c*, and 35*d*, is a side elevation perspective view showing further modified apparatus, single leg or single post support with two floor cross stands/mounts below the base plate and seat, this stop block hinge controlling forward formation of the seat to 90 degrees and backward rotation to a 0 degree vertical position allowing for the user to mount the seat; it also demonstrates the rigid U-shaped apparatus which the central rigid telescopic vertical post interconnects/merges with this U-shaped bracket with four holes or more in a top row; a pin being placed to control position and variable modification of the adjustable vertical post and T-bar brace below above the base two holes one anterior and the second posterior being provided, the purpose of which is to be able to change the angle of the vertical post with T-bar brace allowing for greater than a 90 degree flexion of the knees/legs;

FIGS. 36, 36*a* and 36*b* are fragmented views showing a front saddle inner adductor/abductor winged seat, FIG. 36*a* with both medial adductor and lateral abductor contoured padding, and FIG. 36*b* anterior inferior contoured padded seat and rear section;

FIGS. 36*c* and 36*d* are fragmented views showing a bottom front saddle abductor winged seat with both medial adductor and lateral outer abductor contoured padding and FIG. 36*d* anterior inferior outer contoured padded seat and rear elevated winged seat with adductor pad section;

FIG. 37 shows modified apparatus that includes the support means in the form of a forward leg member or members extending almost vertically, and a rearward leg member extending at less than 45 degrees from horizontal, both resting on a support surface.

DETAILED DESCRIPTION

Figure 1:
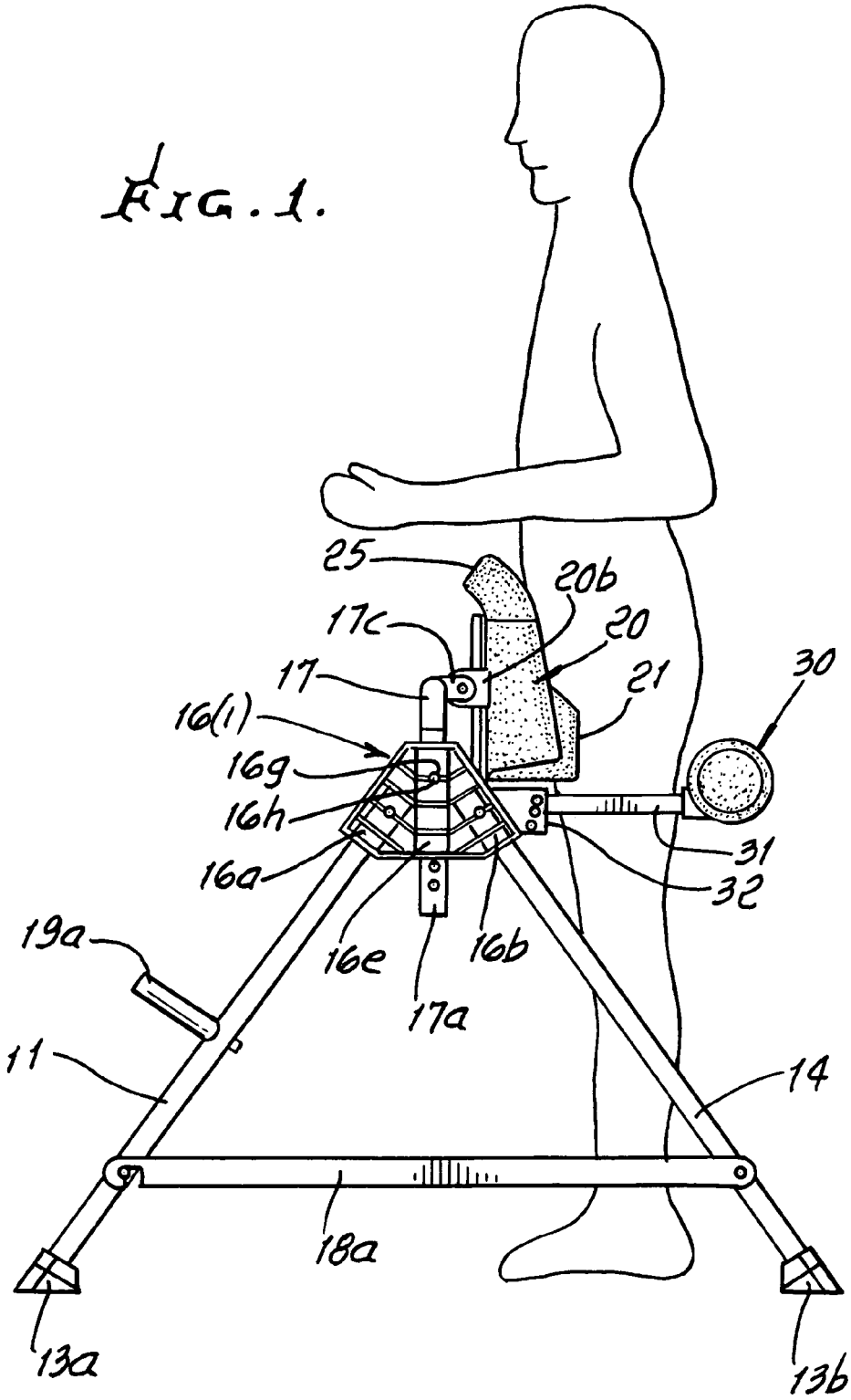
Figure 1A:
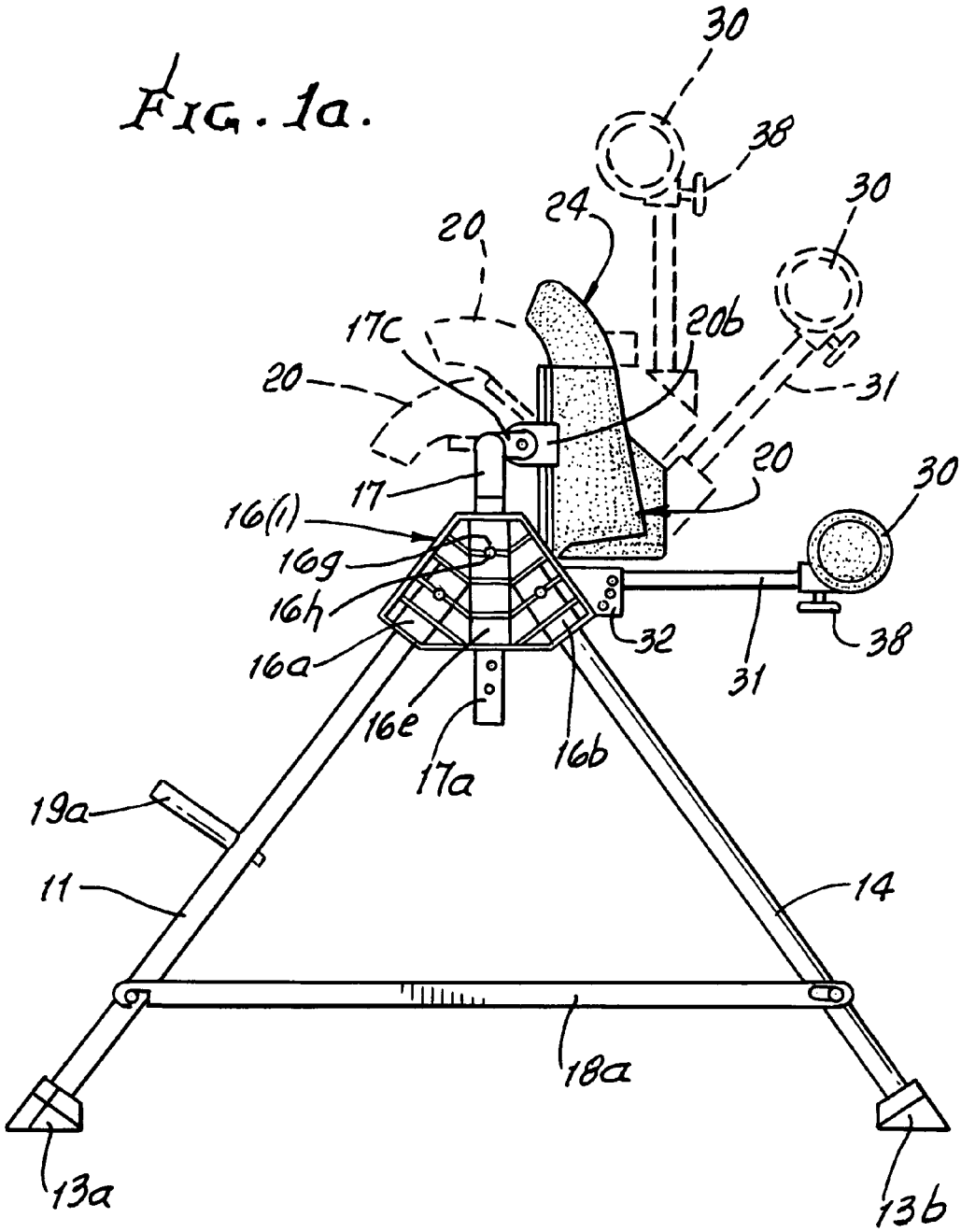
Figure 2:
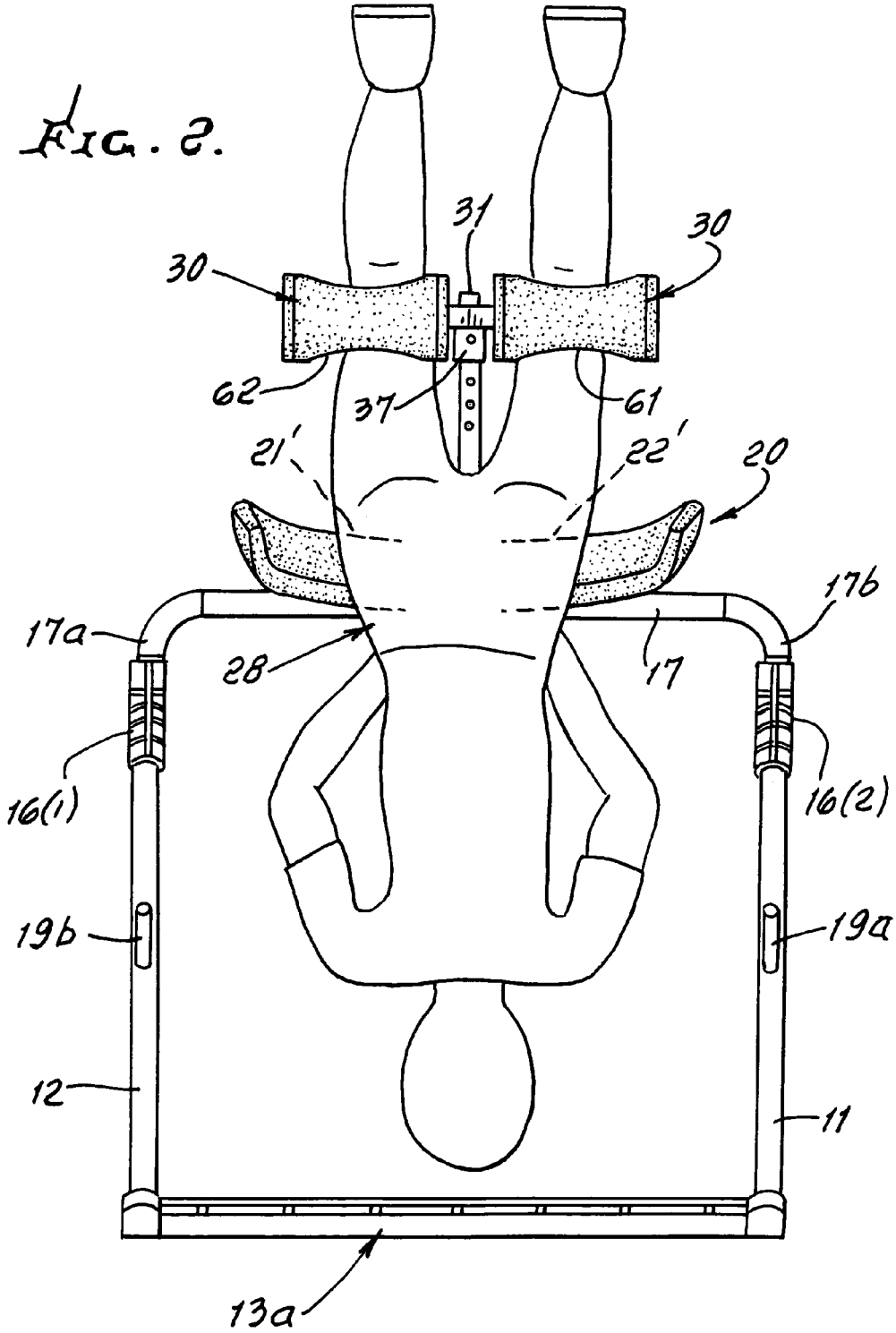
FIG. 2 is a front elevation showing FIG. 1 apparatus in use.

In FIG. 1, FIG. 1*aa*, and FIG. 2, the illustrated preferred exercise apparatus and method includes a support means 10 in the form of a first pair of leg members 11, the front legs jointed by a distal/inferior cross-member 13*a*, front horizontal cross floor brace; and a second pair of leg members 24 rear legs joined by cross-member 13*b*. The rear horizontal cross floor brace, legs 11 front left and 14 rear left are interconnected and supported superiorly by triangular ribbed delta member 16(1). Front left port sleeve 16*a* on the left interconnects superiorly with leg 11, on the right by means of the rear delta port sleeve 16*b*, leg 14 interconnects superiorly into the delta same is true for legs 12 and 15 on the opposite right side of the triangular delta by means of port sleeves 16*c* and 16*d*. Legs 11-14 are cross-braced by 19*c* on the left and one the right legs 12-15 are cross-braced by 19*d*. Crosspiece/member 17 supports the seat base and contoured winged seat member inferiorly, and also adjoins 17*a* left telescopic rigid post and 17*b* right telescopic rigid post both having holes at one inch increments for vertical variable height adjustment post 17*a* is located within the midsection of 16*e*, a mid delta telescopic port, 17*b* right telescopic rigid post with variable holes for vertical variable height adjustment is located within the midsection of opposite delta 16*f* and both are adjusted by means of inserting a pin 16*q*-1 in hole 16*h* on the left; on the right pin 16*q*-2 in hole 16*i*. All legs are secured in the delta via insertion/port sleeves 16*a, b, c*, and *d*, on the right. Stabilizer bar 18*a* interconnects front leg 11 with rear leg 14 on the left. Stabilizer bar 18*b* interconnects front leg 12 with rear leg 15 on the right. Handgrip support 19*a* is located on 11. Handgrip support 19*b* is located on 12. Legs 11, 14 and 12, 15 are interconnect by means of triangular ribbed delta superiorly and by means of cross floor braces 13*a*, 13*b* inferiorly. These make up the A-Frame to provide support for a horizontal or transverse platform 20. FIGS. 1*a, b, c* and *d* illustrate the support means of the flat or winged contoured seat on which the user's thighs rest at 21 and 22. The platform/seat 20 connected to 17 by 17*c* cross support bracket and base plate 20*a* and 20*b* secure means/pins/bolts/bearings, 20*c* pivotal blocks or other means, whereby the platform is then pivotal about a horizontal axis. Alternatively, the platform may be locked in multiple positions, relative to the trunk, thigh, leg, knee and calf, as shown in FIG. 1*a* multiple seat appositions 20 and 1*b* multiple vertical post with horizontal T-bar brace positions 30, 31 adjustable vertical post member attached to 32 U-shaped member at 90, 70, 50, 30 degrees, are provided.

Figure 1B:
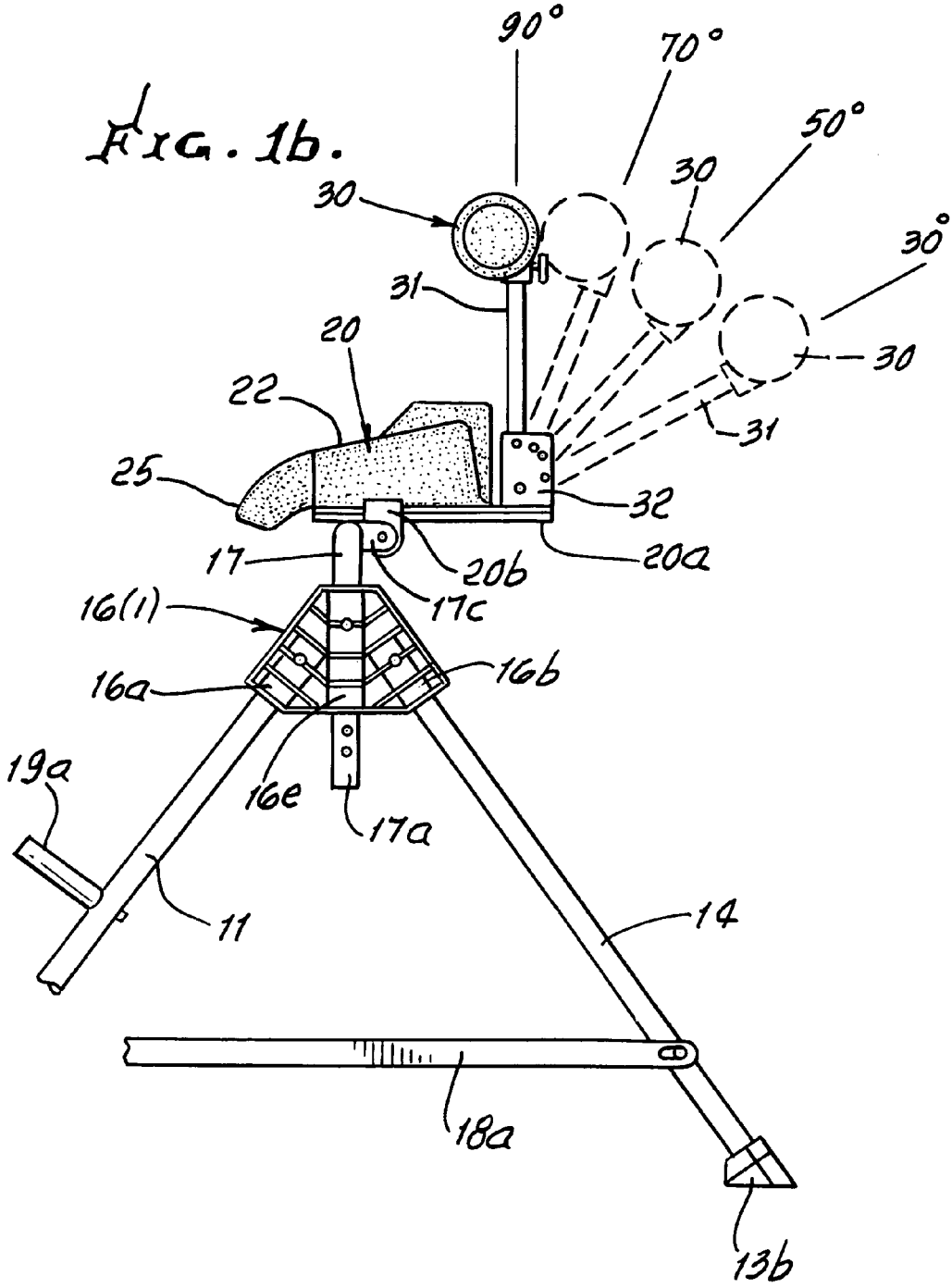
Figure 1C:
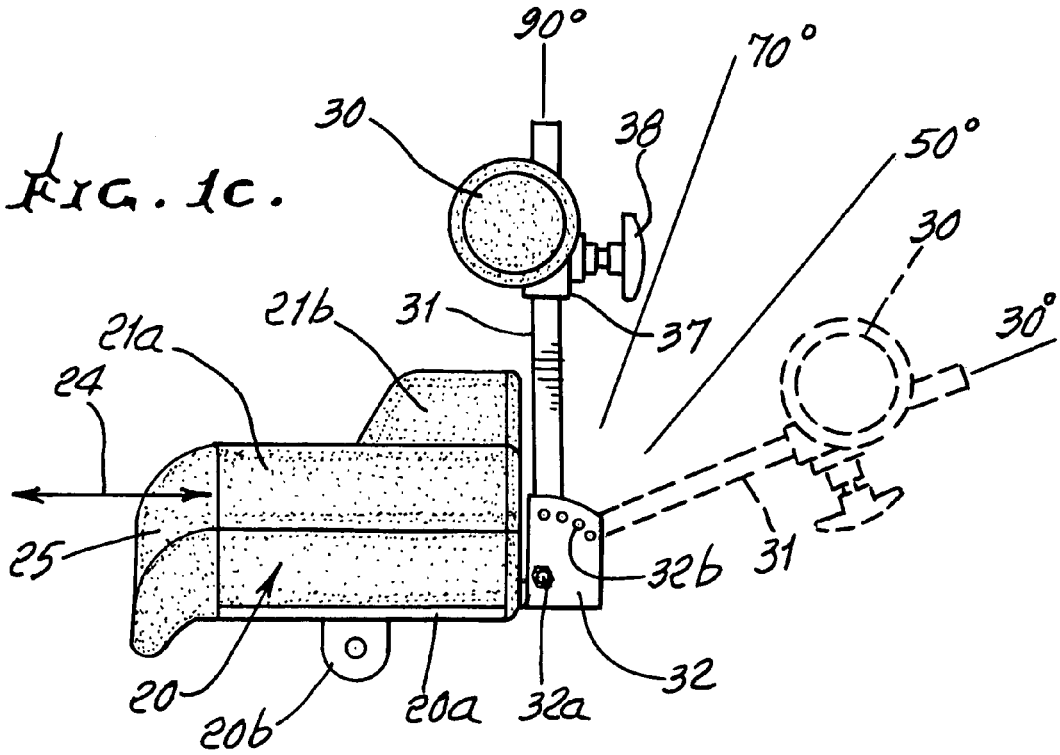
Figure 1D:
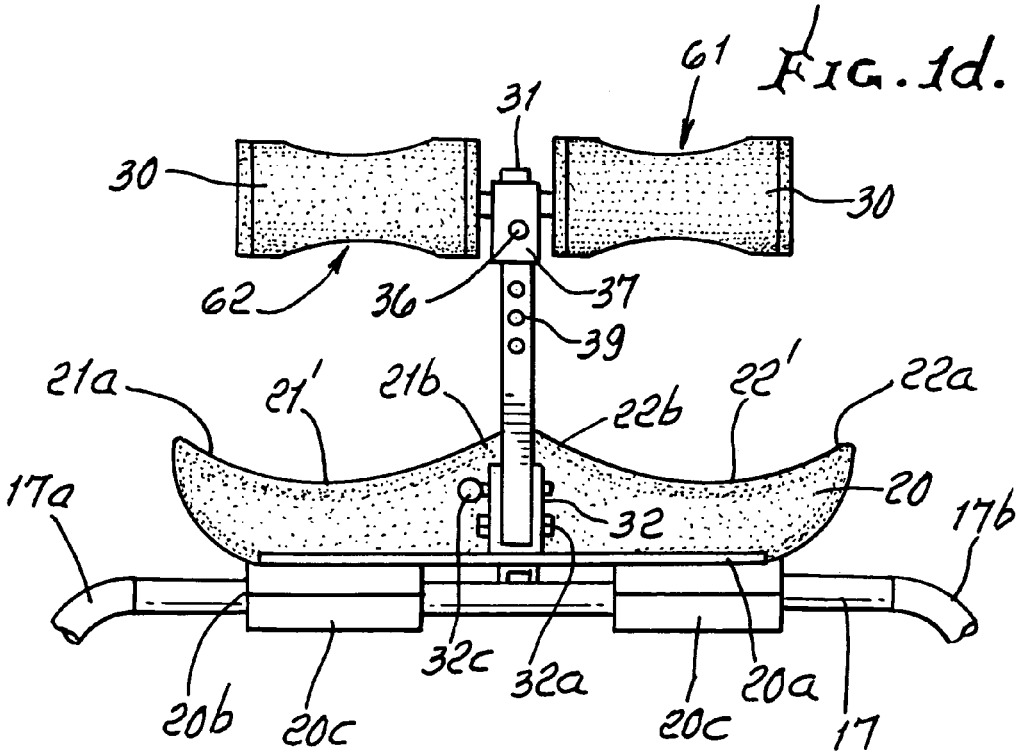
Figure 1E:
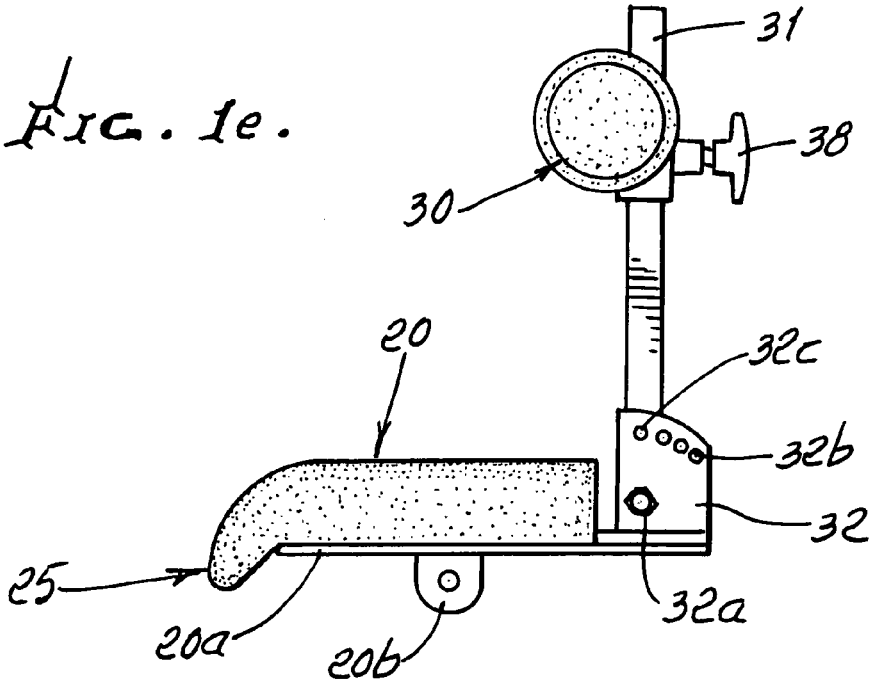
Figure 1F:
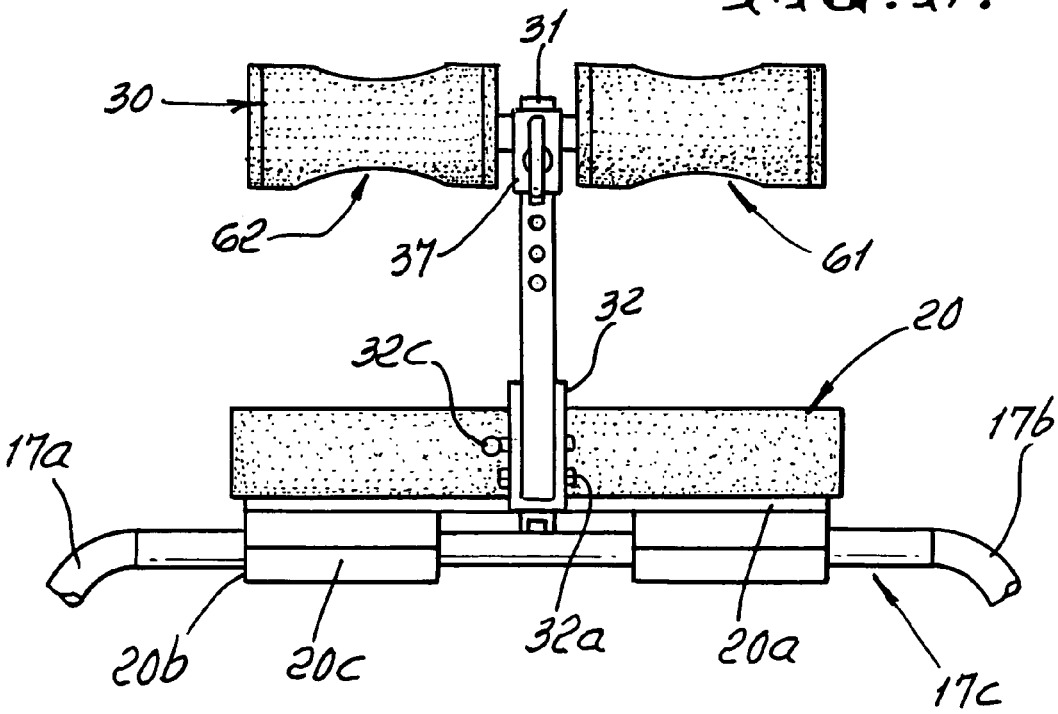
Figure 1A:
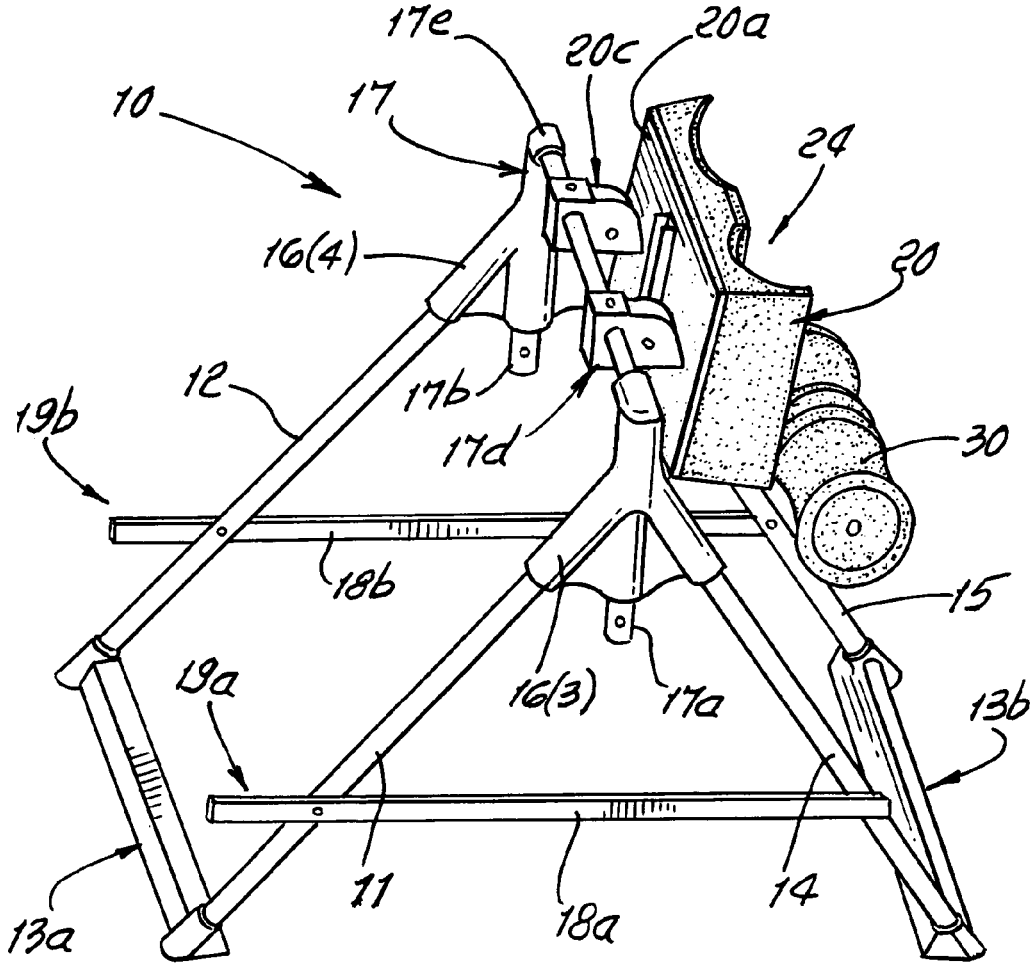
Figure 1B:
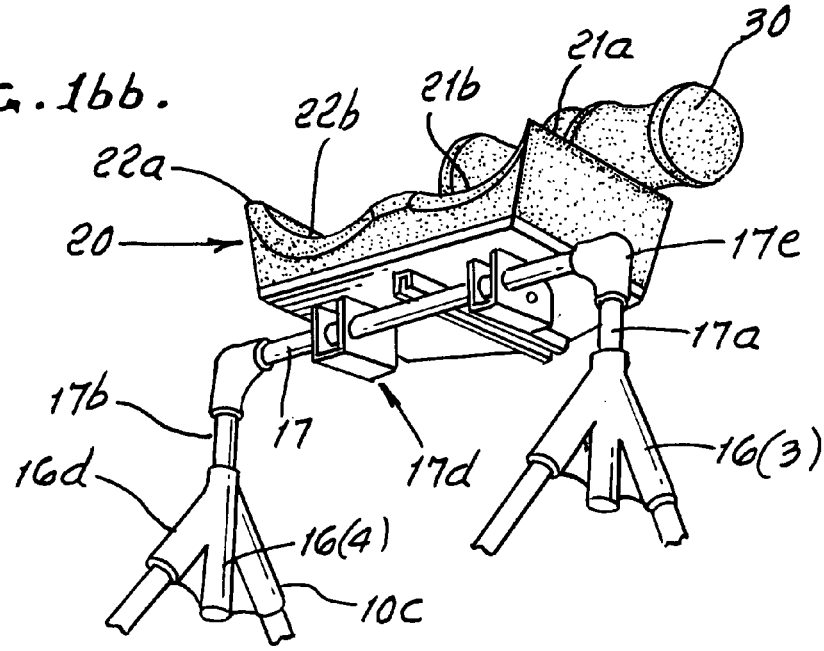
Figure 1C:
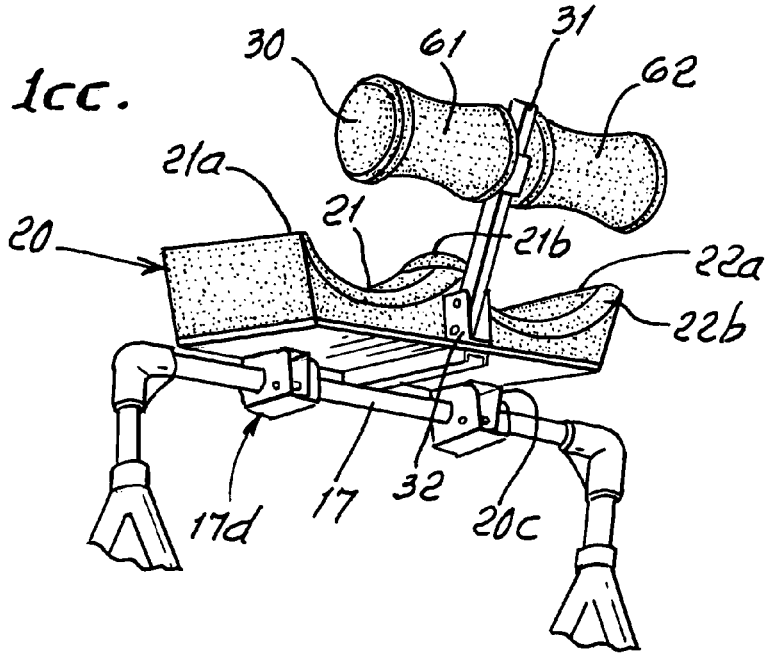
Figure 1D:
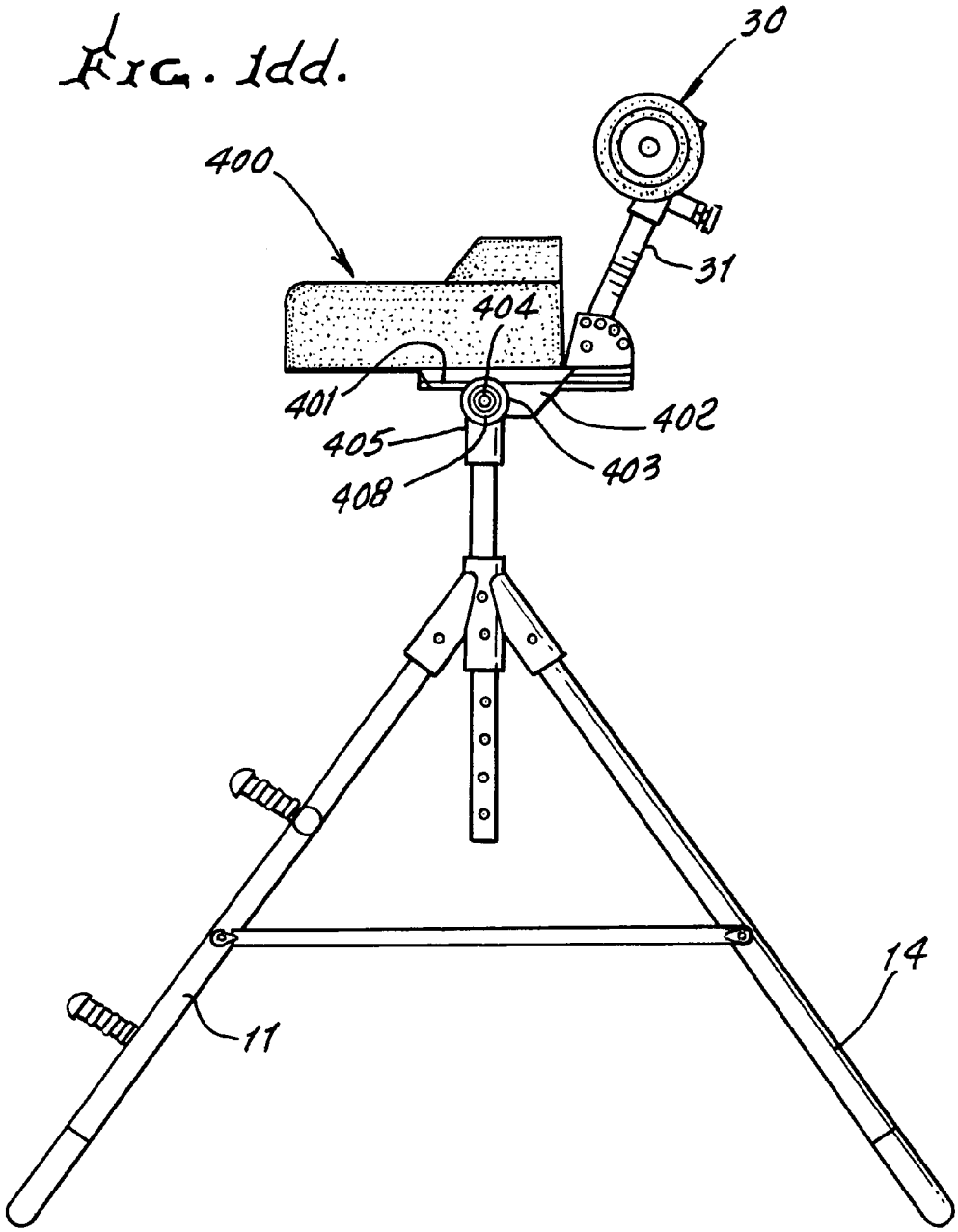
Figure 1E:
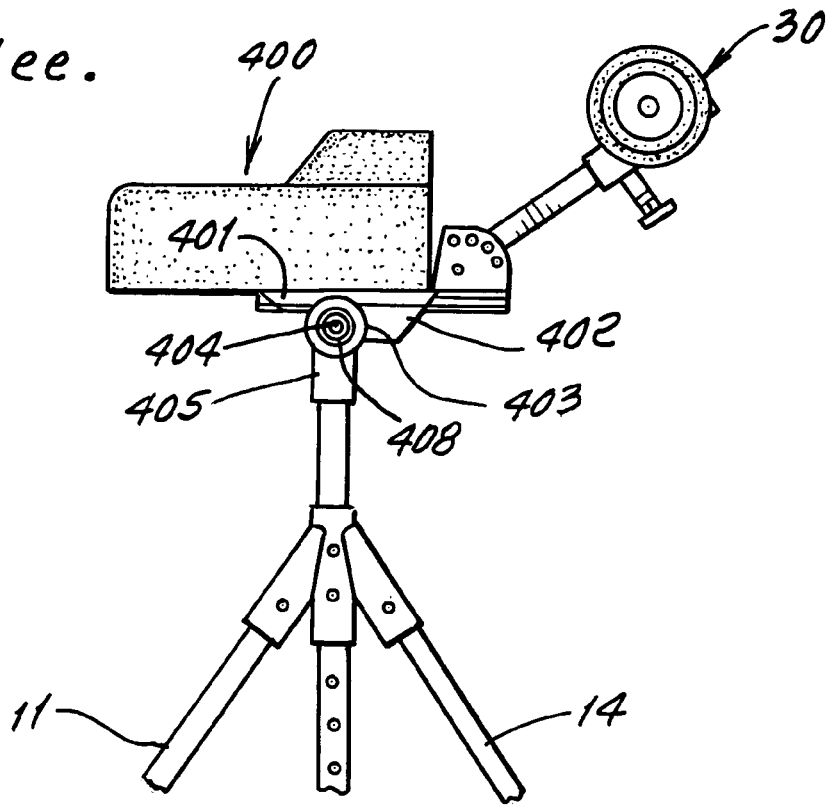
Figure 1F:
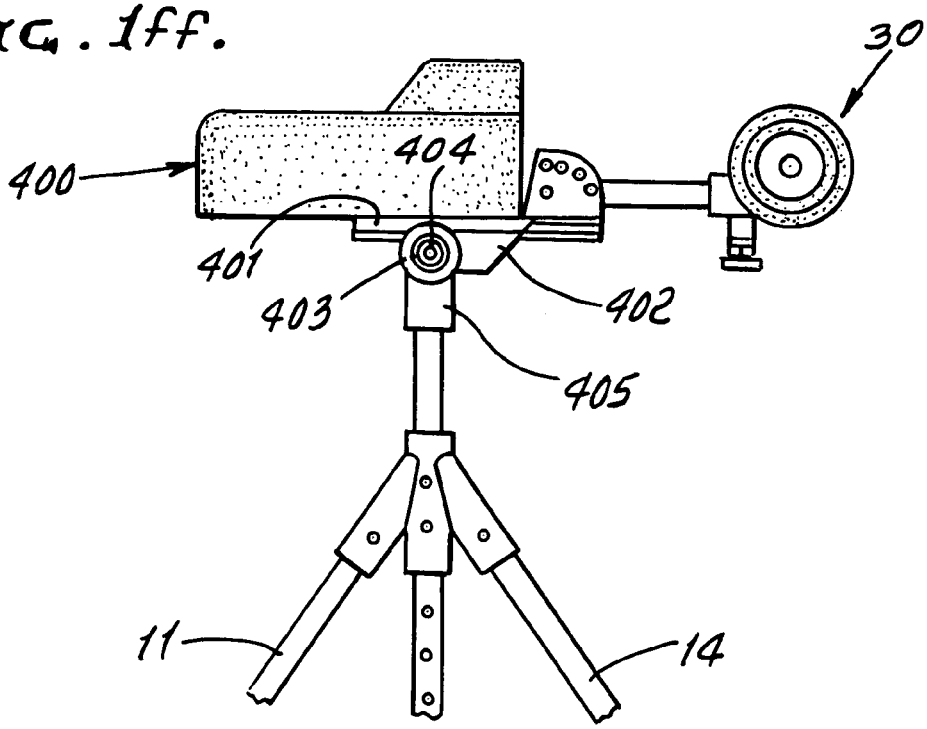
Figure 199:
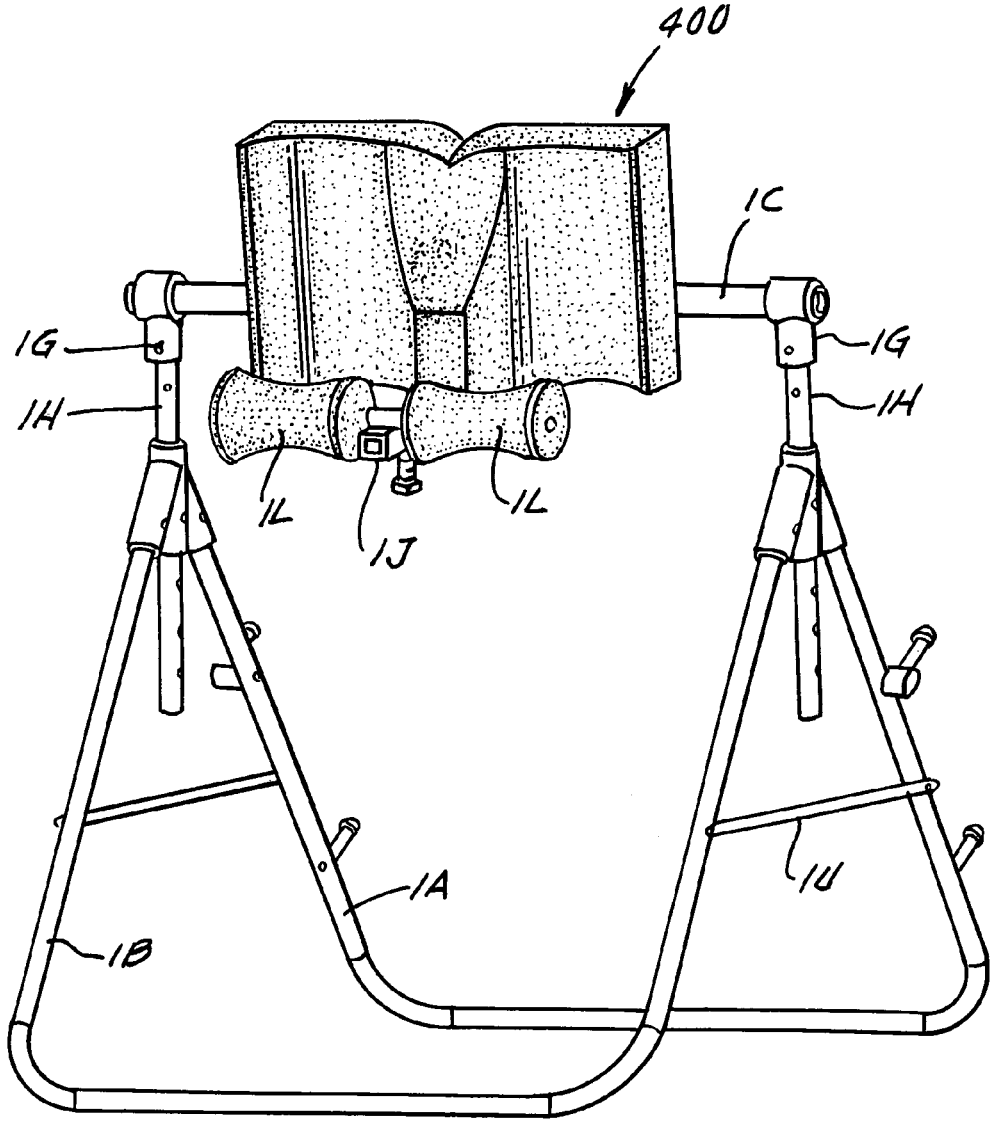
Figure 1H:
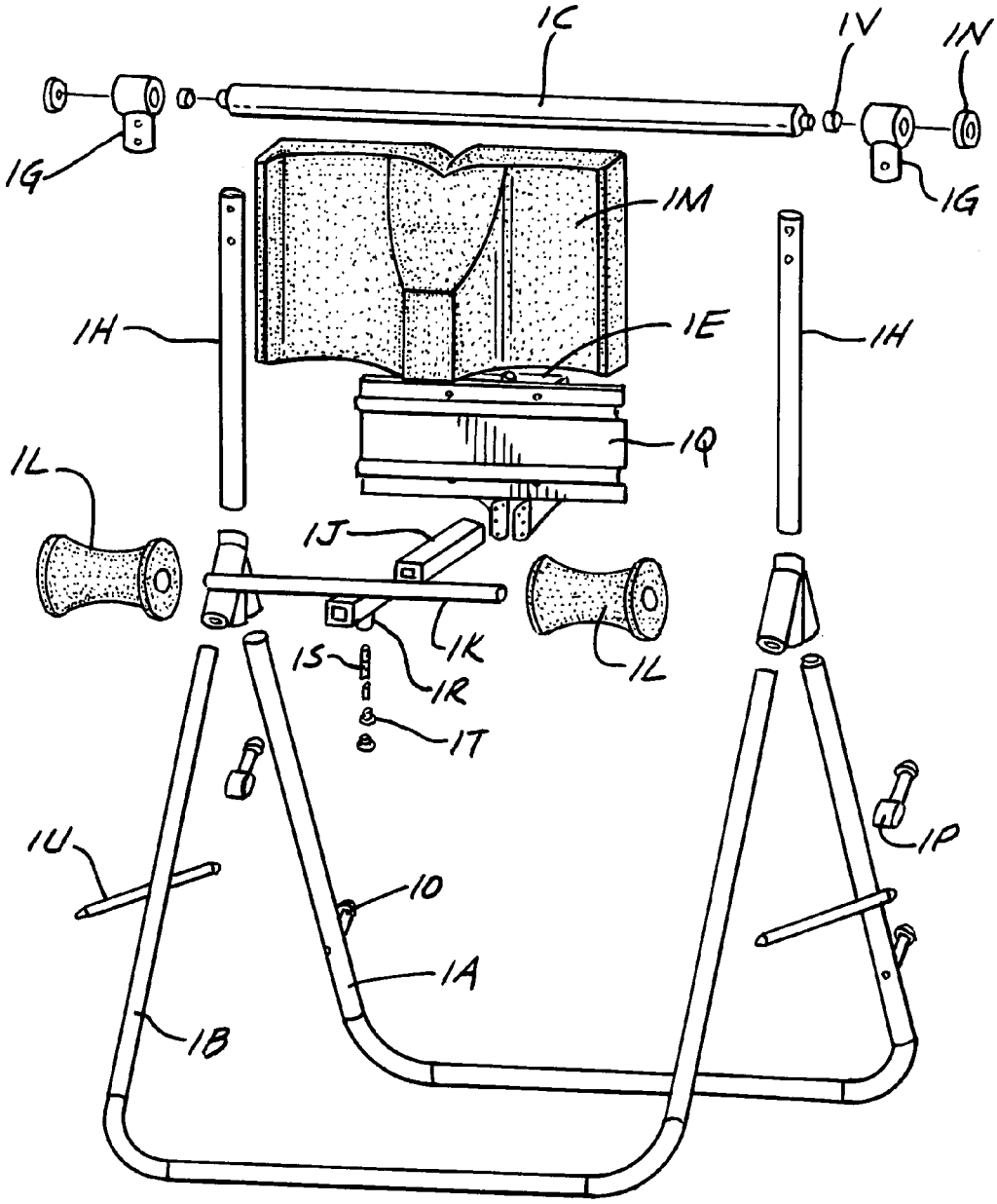

The platform 20 seat and base plate 20*a*, 20*b* extends transversely, as seen in FIGS. 1*d* and 1*f*, to provide user's thigh support regions 21' and 22' which may be flat or downwardly concave throughout their lengths anterior to posterior direction indicated by arrow 24. Also, the platform ahs a convexly rounded surface 25 which faces horizontally in the direction of arrow 24, to engage and push against the user's body at the juncture of his (or her) trunk 28 and thighs, i.e., the forward pelvic area. Note that the downwardly concave regions 21' and 22' merge with concave regions 21*a* and 22*a* at downward surface 25, as seen in FIG. 1, 1*a*, 1*b*, 1*c* and 1*d*. This accommodates to the user's thighs when the thighs 21 and 22 and legs extend horizontally, and in FIGS. 2, 3, and 4 trunk 28 extends or hangs downwardly, below 20 platform/flat or contoured winged seat with base plate 20*a*, 20*b* or 20*c* level.

FIGS. 1-3 and 1*d* also show a crosspiece 30 mounted on the support means 20 via a vertical post 31 to extend in spaced relation to the platform upper surface, over the user's leg region supported on the platform. The crosspiece may be carried by a central rigid telescopic vertical member 31 which extends downwardly and merges with a rigid U-shaped member 32 attached to the seat base plate by bolts 32*a* or other means with variable hole 32*b* by means of a security pin 32*c*, to permit variably angled extension at 90, 70, 50 and 30 degrees or variations thereof, more or less attached to the platform. See also FIGS. 1*b*, 1*c*, 1*d*, 1*cc*. Likewise, vertical positioning of the crosspiece 30 is adjustable by means of hole 36 in the crosspiece adjustable frame 37, and pin 38 extending through hole 36 and through a selected hole 39 in member 31. The crosspiece 30 is convexly contoured at 61 and 62 (see FIG. 1*cc*) to engage the rear side of the user's legs, FIGS. 1, 2, 3 and 4 for example, proximate the back side of the user's thigh/knee joint at 30*a* and to block upward displacement of the thighs 21 and 22 relative to the platform 20, to enable trunk stability during trunk swinging and twisting.

In accordance with the invention and its methods of use, other means FIGS. 1*d*, 1AA, 1BB, 1CC, 2, 3, 21*a* and 22*a* are provided in association with the platform to induce contraction of the user's thighs relatively away from one another in an abduction response to trunk pivoting, for producing posterior rotation of the user's os ilium, thereby inducing distraction and a stretching of the user's adductor and associated anatomy including but not limited to muscles, ligaments, tendons and approximating the sacroiliac joints, at the os ilium anterior, relieving pressure on the spine. Adductor pad or pads 21*b* and 22*b* conversely stretch and decompress the spine and sacroiliac joints in an opposite manner when the adductor muscles are engaged. The reverse is true if there is abductor dominance and adductor contraction is necessary by emphasizing adductor contraction while stretching and decompressing the abductor musculature.

Figure 3:
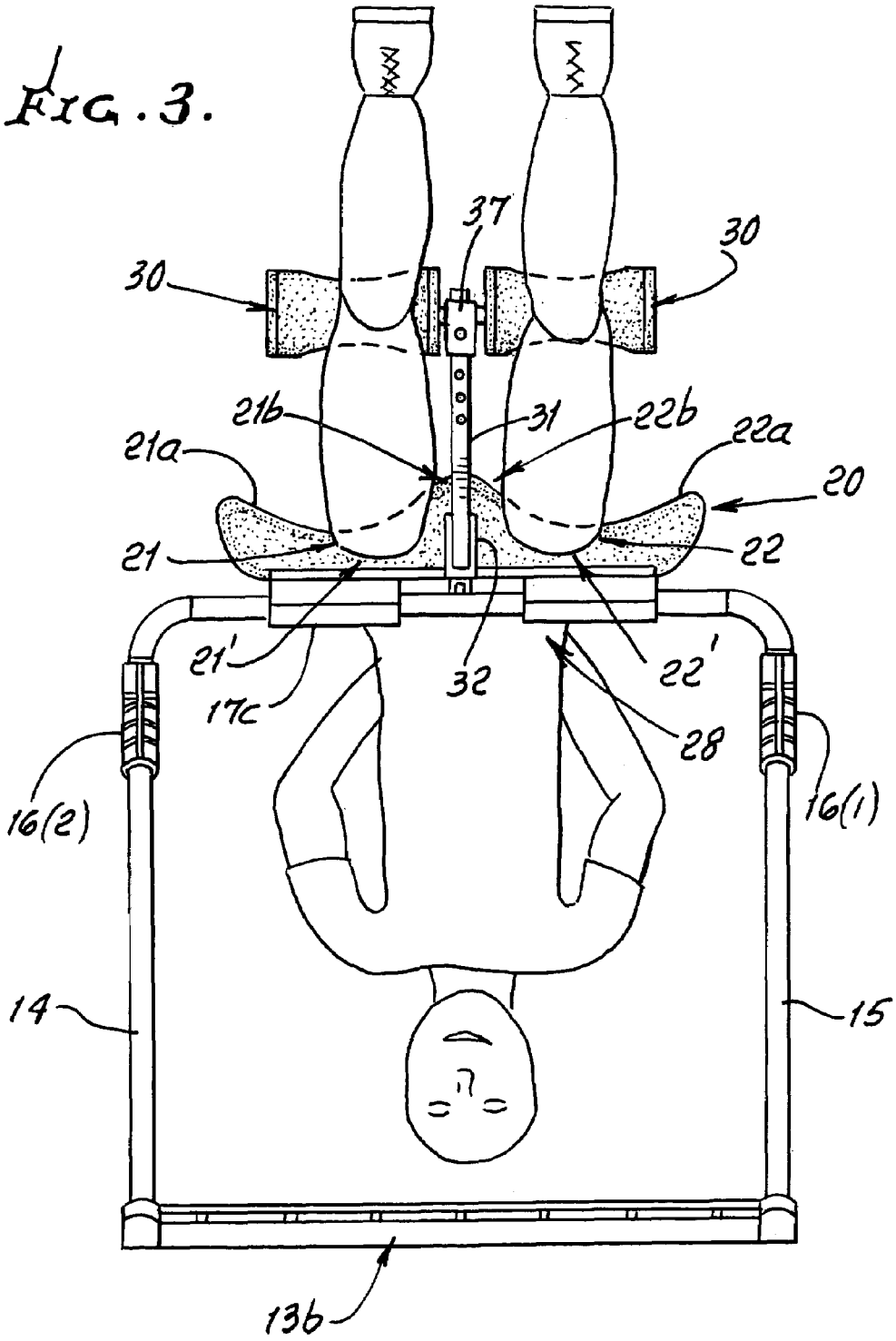
FIG. 3 is a rear elevation showing FIG. 1 apparatus in use.

Such other means advantageously includes a thigh grip element 21*a* and 22*a* projecting into the outer thigh region of the user's legs (see FIGS. 1*a*, 2, and 3), to be gripped or clamped by user's thighs while rotating the thighs externally as the apparatus user swings his trunk in varying positions, benefiting the spin, pelvic and sacroiliac regions, as referred to. Elements 21*a* and 22*a* may advantageously comprise a pad integral with the platform and tapering upwardly, as seen in FIGS. 1*d*, 2 and 3. Showing tapered sides 21*a* and 22*a* to the lateral winged pad. The user's thighs are induced to externally rotate, in use of the apparatus, as seen in FIGS. 1*d*, 2 and 3. The platform 20, flat seat or saddle pad 21*a*, 21*b*, 22*a* and 22*b* together define an upwardly facing saddle-like structure with vertical post 31, 37 crosspiece adjustable frame; pin 38 and telescopic horizontal T-bar part of crosspiece 30 together define an inverted, saddle-like structure with concave surface regions. Calf/knee/thigh pads 61, 62 and winged saddle seat 20, base plate 20*a*, and 20*b* secure means 20*c* pivotal blocks 21*a* and 22*a* abductor pads 21*b* and adductor pads 22*b* fit the user's thighs at opposite sides and are horizontally offset, as shown, in the direction of arrow 24, as seen in FIGS. 1*a*, 1*b*, 1*c* 1AA, 1BB, 1CC, 2, 3 and 4 and make up the seat assembly.

The open spacing of the supporting legs of all devices identified in FIGS. 1-35 provide spacious room for user body movement but more specifically as in FIGS. 1-23, legs 11, 12 and legs 14, 15 allow the user's head, trunk and arms to hang freely and twist, as during flexion or extension. This helps relieves spinal compression, especially in the thoracic, lumbar and sacroiliac regions. Hand grips 19*a* and 19*b* may be provided on the legs 11 and 12, as shown, to project normal thereto. The legs may be fixed or telescopically interconnected sections. See for example FIG. 28 connected together as by pine 362.

In FIGS. 1*dd*, 1*ee*, and 1*ff* the seat 400 is attached to Seat Plate Base 401 which is bolted to Seat Plate 402 that is welded to Pivot Tube 403. Tube 403 has extended Insert Stop Pins 404 inserted into 90 Degree Upper Fitting 405 with a 50% horizontal controlled radius that limits the rotation of the Pivot Tube 403 and Seat from vertical −5 degrees to a 90 degree angle parallel to the floor. Each end of the Pivot tube shaft size distally is reduced. On each of the ends of this distal shaft is a Bushing which fits into the 90 degree Upper Fitting 405 and in which the Pivot Tube rotates. Pivot Tube 403 is secured into 90 Degree Upper fitting 405 by Bearing Cover 408.

Figure 4:
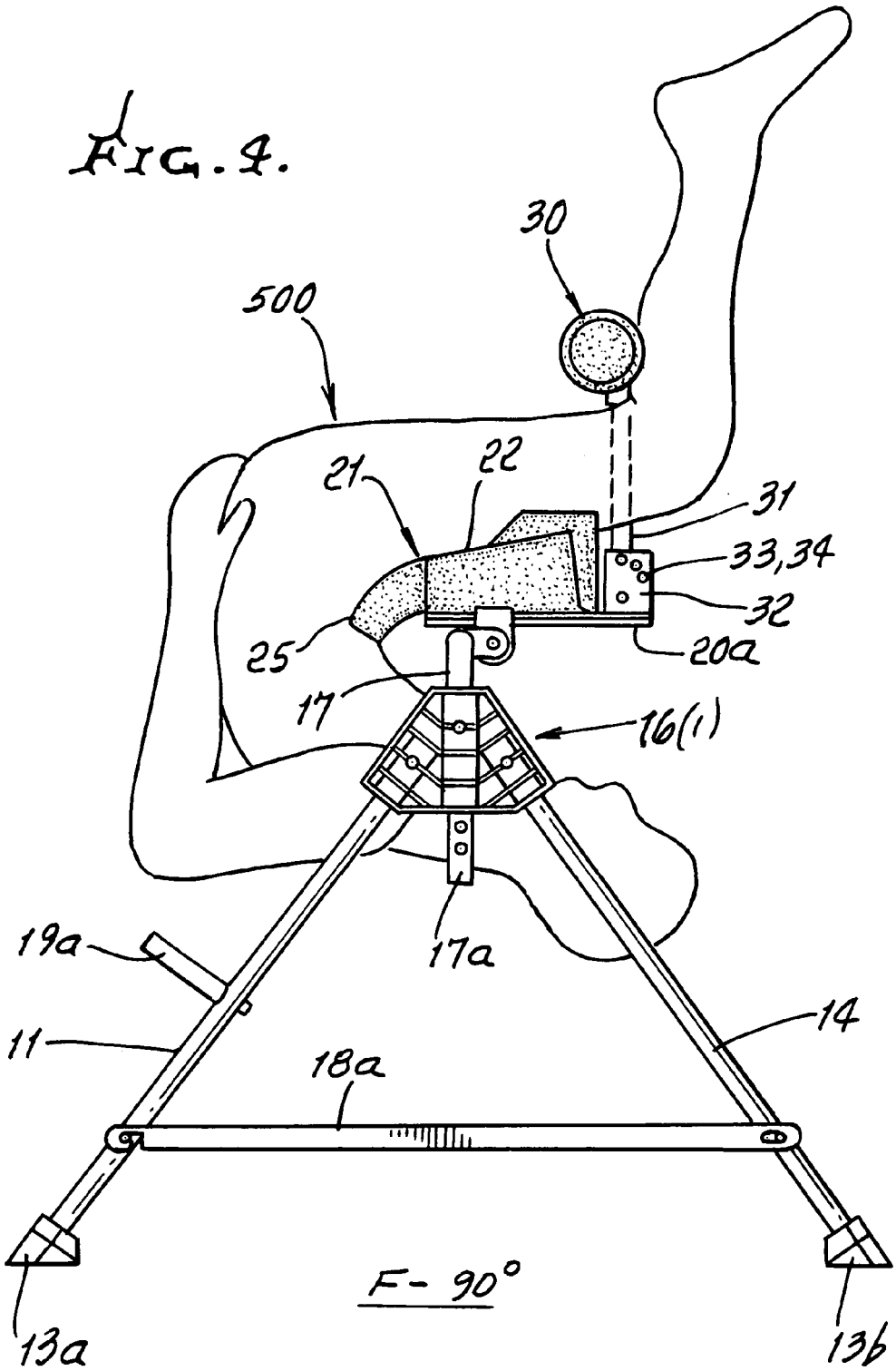
FIG. 4 is a side elevation showing FIG. 1 apparatus in use.

FIGS. 1*gg* and 1*hh* show elements of the apparatus similar to those shown in FIG. 1, in assembled and exploded view form. Elements are identified as follows:

1A Front Base
1B Rear Base
1C Pivot Tube
1D Discontinued
1E Seat Plate
1F 3 Way Fitting
1G Upper Fitting
1H Downtube
1I Post Bracket
1J Post
1K Leg Post
1L Leg Cushion
1M Seat Cushion
1N Bearing Cover
1O Handle
1P Angled Handle
1Q Seat Plate Base
1R Leg Screw
1S Leg Screw
1T Leg Screw
1U Cross Arm
1V Bushing The structure in FIG. 4 is the same as FIGS. 1-3 the body 400 demonstrating trunk flexion/inverted abdominal curl with legs/knees bent at 90 degree s (the method of exercise) and, the crosspiece 30 may be carried by a central rigid telescopic adjustable vertical post member 31 which extends downwardly and merges with a rigid U-shaped member 32 attached to the seat base plate 20*a* and attached by bolt 32*a* or other means with variable hole or holes 32*b* for a security pin 32*c*. The angle may be altered 90, 70, 50 and 30 degrees or variations thereof, more or less. Attached to the platform at 32 (see FIGS. 1*b*, 1*c*, 1*d* and 1CC) as an adjustable vertical post 31 with variable horizontal T-bar brace 30, 31, adjustable vertical post member, vertical post slider 37 and calf/knee pads 61, 62 behind the legs/calf/knee/legs making up the elements that support the user and allow him to flex his knees at 90 degrees, more or less.

Figure 5:
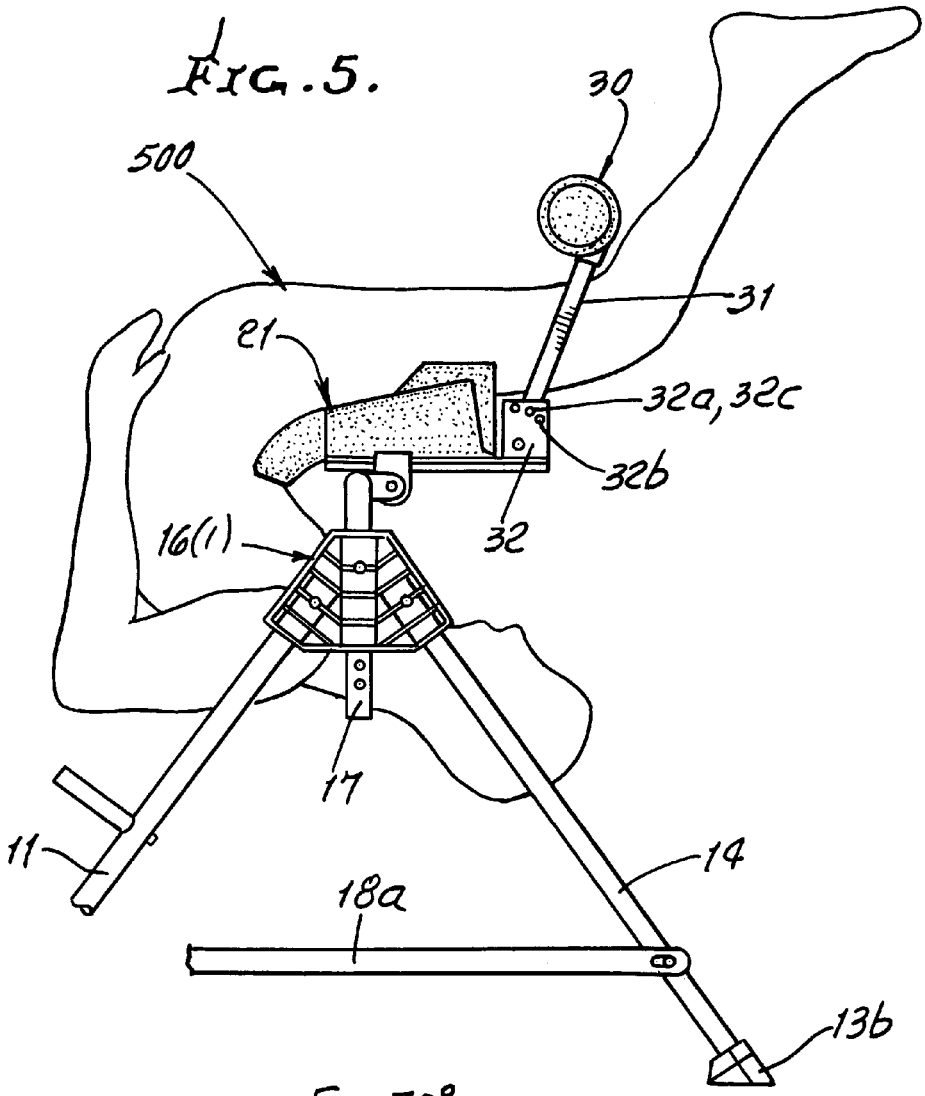
FIG. 5 is a side elevation showing apparatus in use knees flexed by apparatus at 70 degrees.
Figure 6:
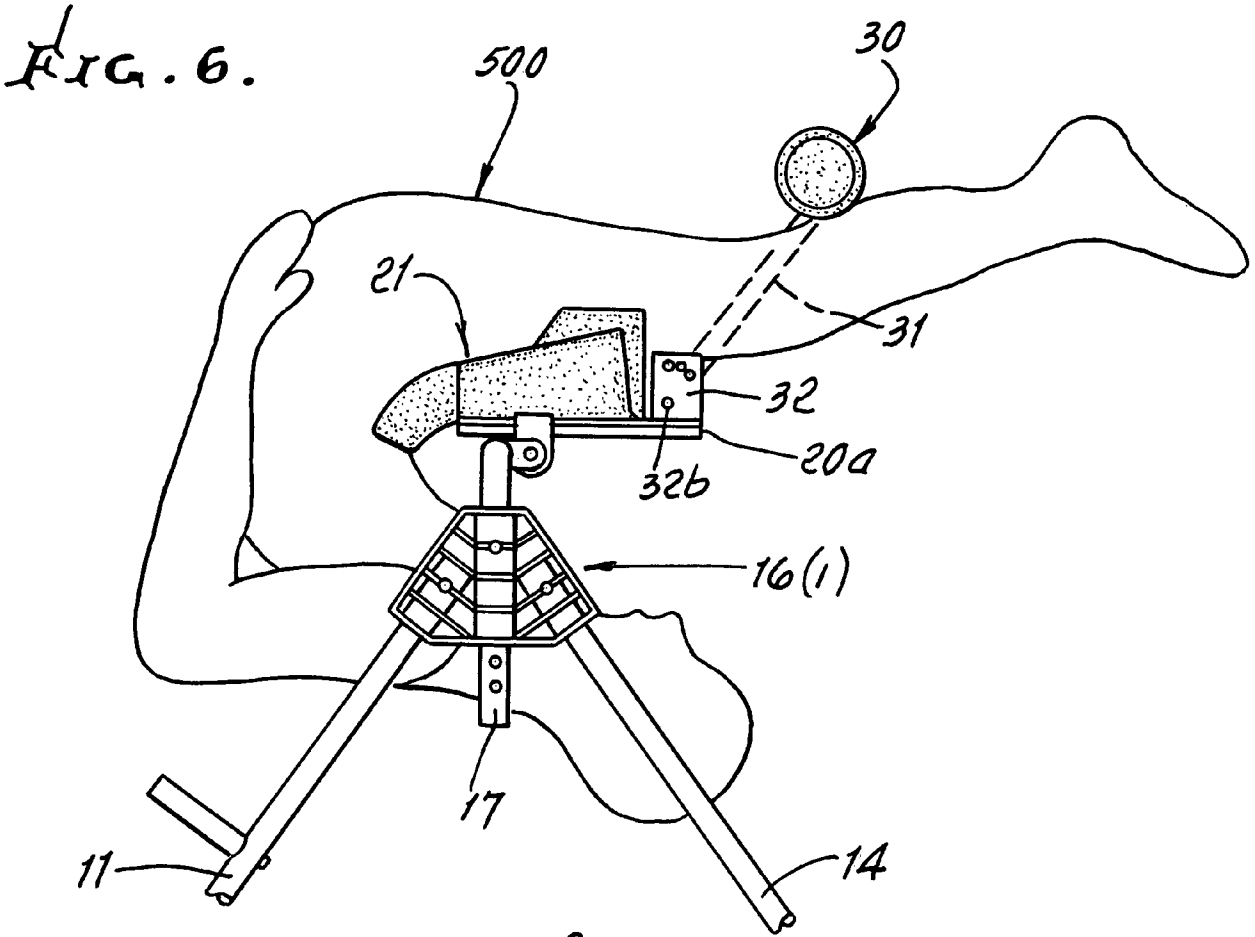
FIG. 6 is a side elevation showing apparatus in use knees flexed by apparatus at 50 degrees.

FIG. 5, the method and apparatus are again basically the same as FIGS. 1-4 with the body demonstrating trunk flexion/inverted abdominal curl, legs/knees bent at 70 degrees. The crosspiece 30 may be carried by a central rigid telescopic adjustable vertical post member 32 attached to the seat base plate 20*a*, and attached as by bolt 32*a*, or other means with variable holes 32*b* by a security pin 32*c*. The angle may be altered 90, 70, 50 and 30 degrees or variations thereof more or less while attached to the platform. (See FIG. 1*b*, 1*c*, 1*d* and 1CC). As before, vertical post 31 within 32 and with variable horizontal T-bar brace 30, adjustable vertical post member 31, vertical post slider and calf/knee pads 61, 62 behind the legs/calf/knee/legs make up the elements that support the user and allow him to flex his knees at 70 degrees more or less.

Figure 7:
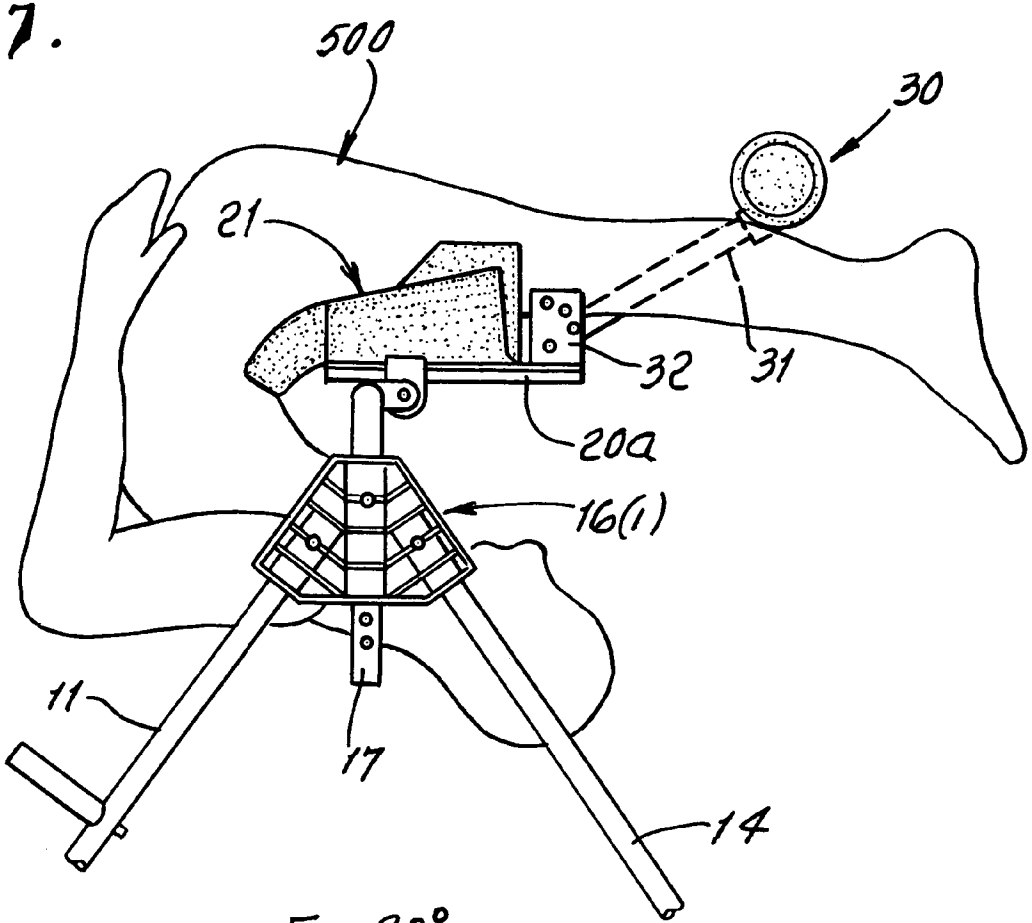
FIG. 7 is a side elevation showing apparatus in use, knees flexed by apparatus at 30 degrees.

FIG. 7, the method and apparatus is again basically the same as FIGS. 1-6 with body demonstrating trunk flexion/inverted abdominal curl with legs/knees bent at 30 degrees.

Figure 8:
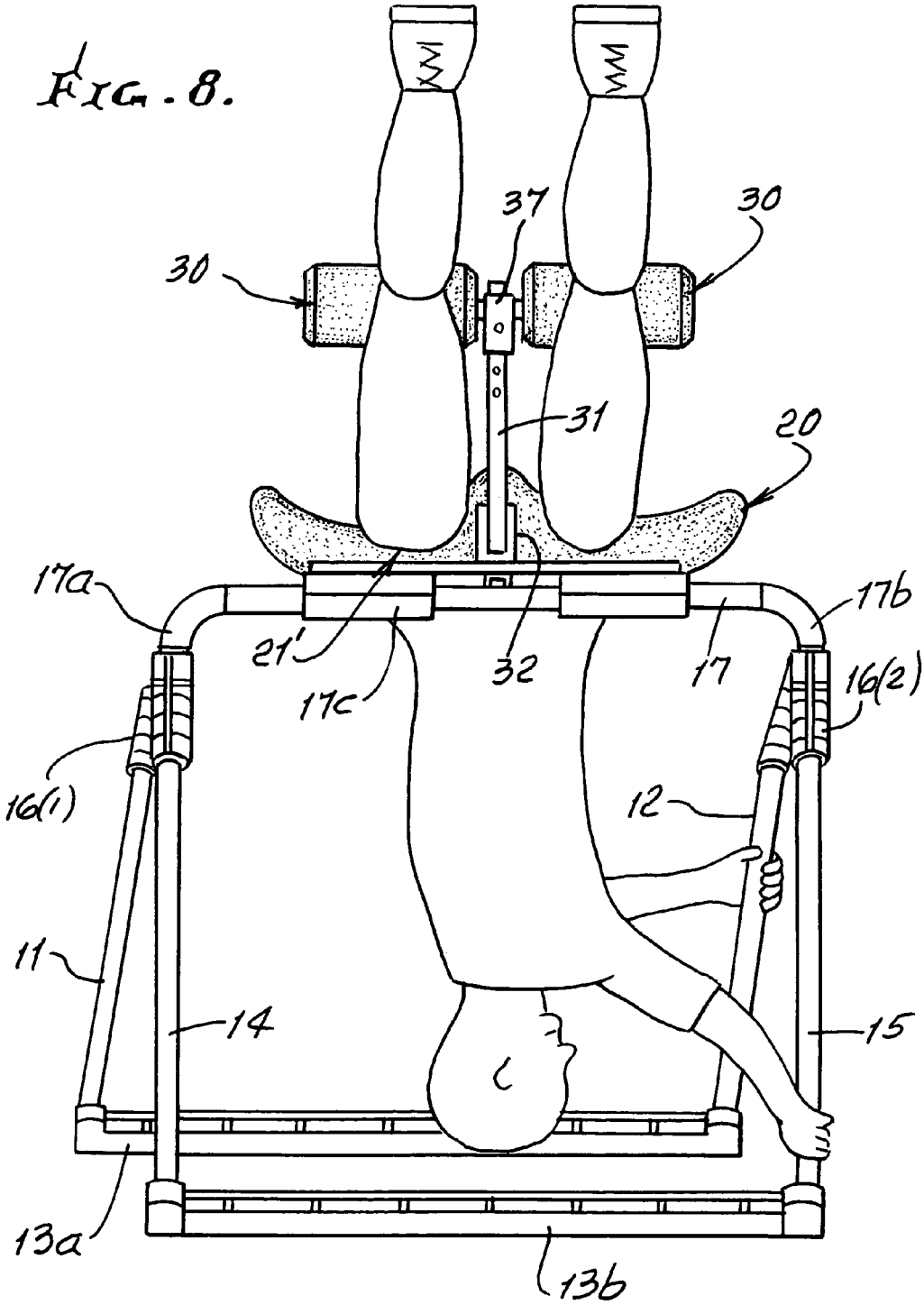
FIG. 8 is a rear elevation showing apparatus in use or in FIG. 4, with knees flexed by apparatus at 90 degrees.

FIG. 8, the method and apparatus is again basically the same as FIG. 1-7 with rear view of body 500 demonstrating trunk rotation with legs/knees bent at 90 degrees.

Figure 9:
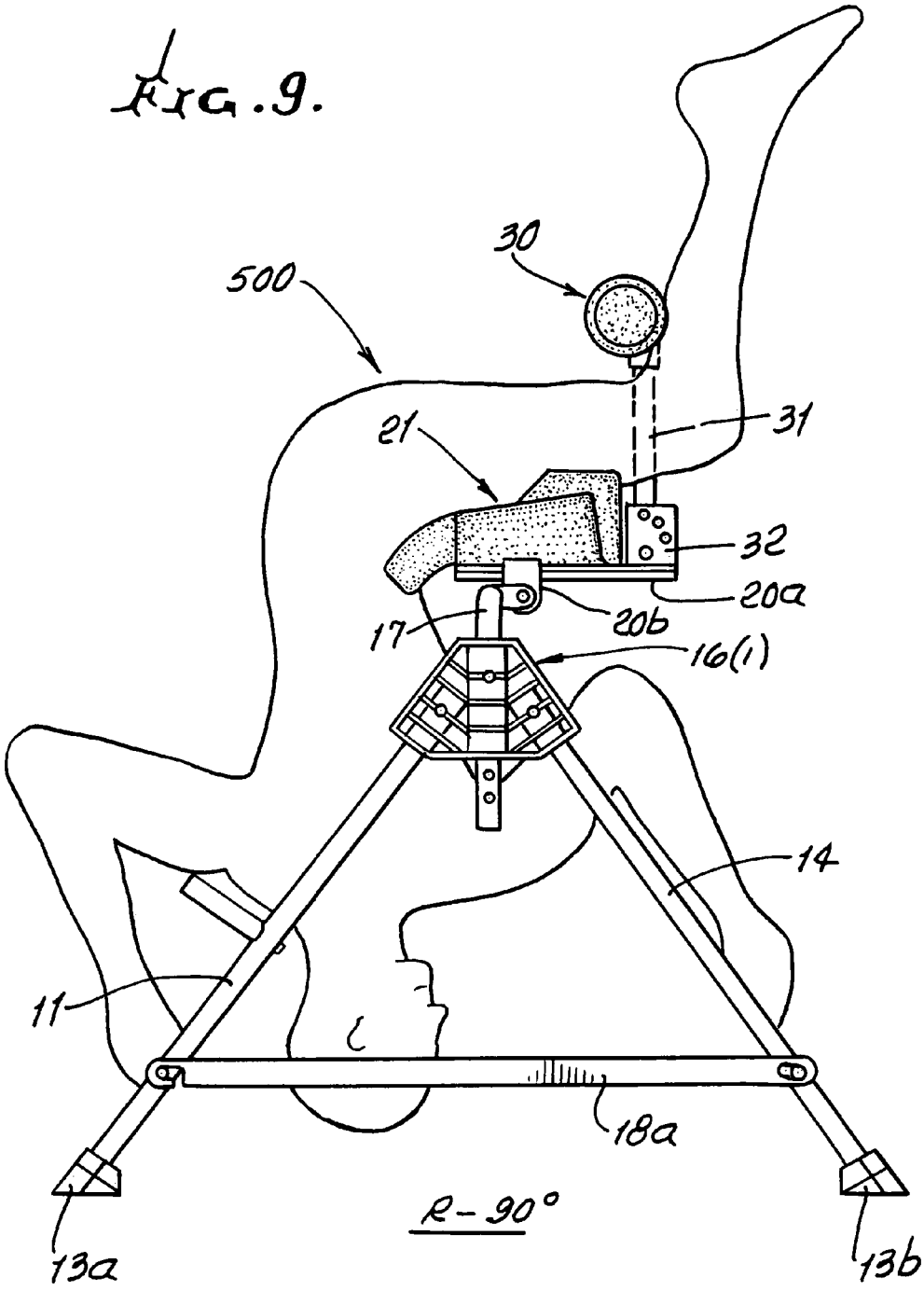
FIG. 9 is a side elevation as in FIG. 4 showing knees flexed by apparatus at 90 degrees.

FIG. 9, the method and apparatus is again basically the same as FIGS. 1-8 with side/lateral view of body 400 demonstrating flexed trunk rotation with legs/knees bent at 90 degrees.

Figure 10:
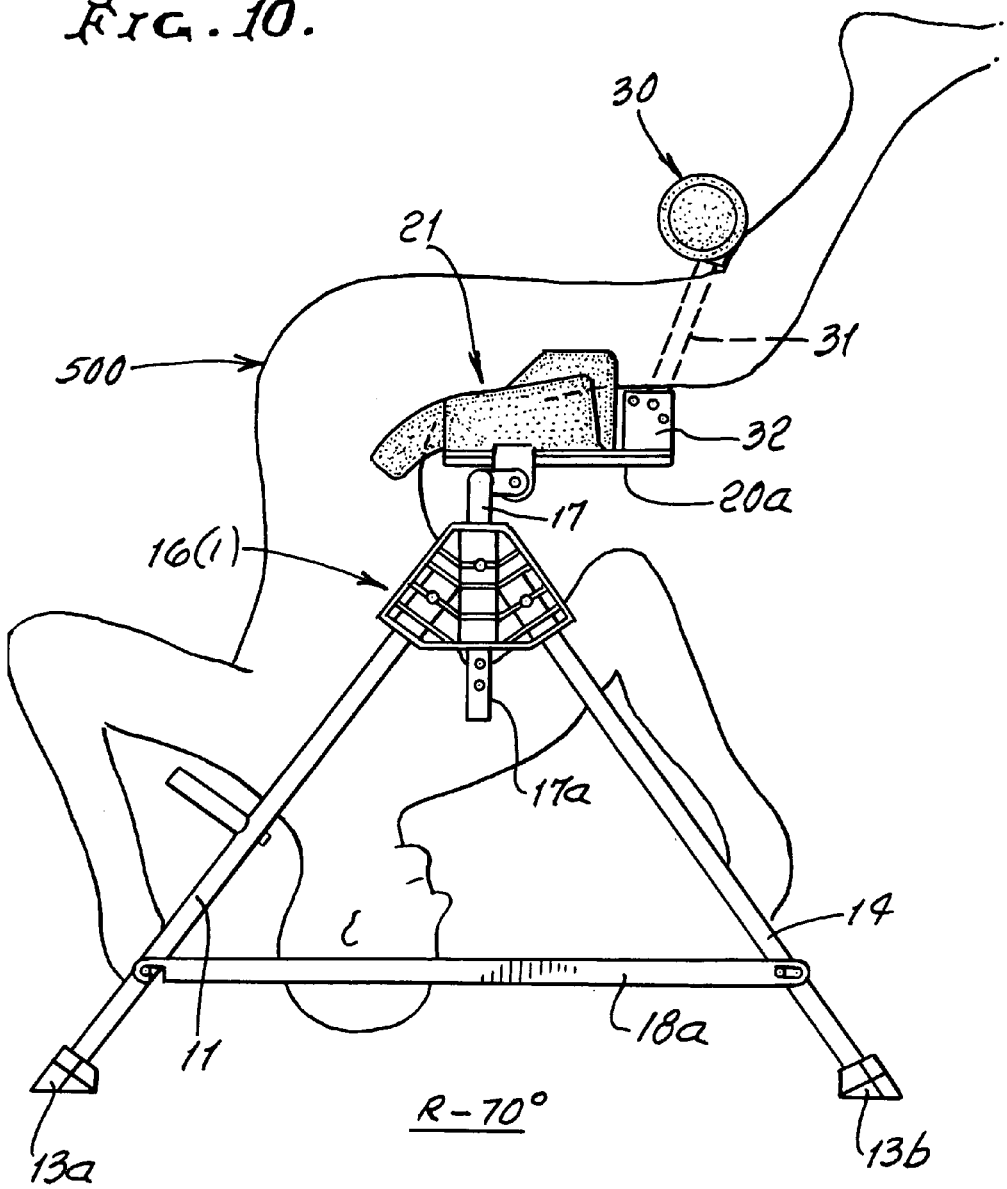
FIG. 10 is a side elevation as in FIG. 4 showing knees flexed by apparatus at 70 degrees.

FIG. 10, the method and apparatus is again basically the same as FIGS. 1-9 with side/lateral view of body 500 demonstrating flexed trunk rotation with legs/knees bent at 70 degrees.

Figure 11:
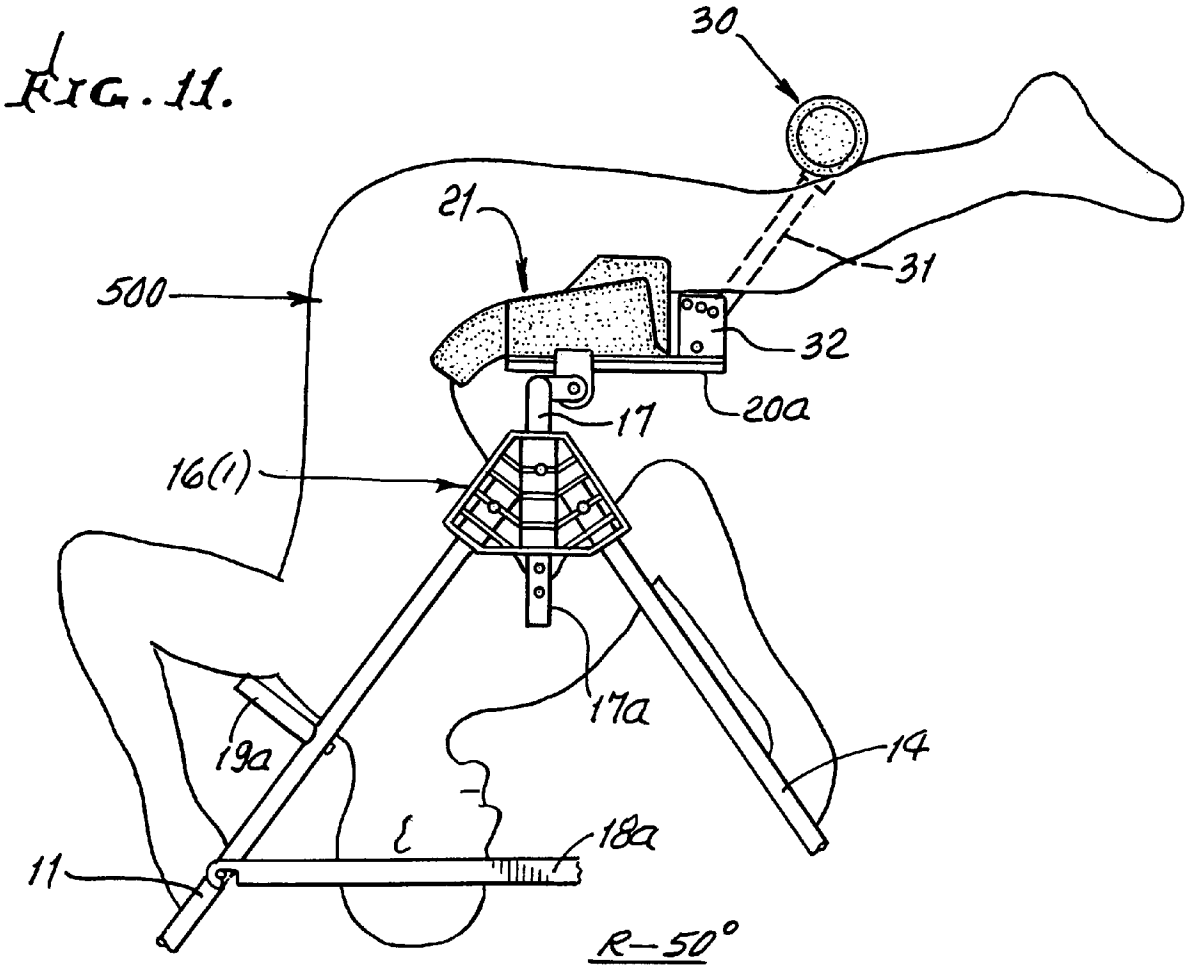
FIG. 11 is a side elevation as in FIG. 4 showing knees flexed by apparatus at 50 degrees.

In FIG. 11, the method and apparatus are again basically the same as FIGS. 1-10 with side/lateral view is of body demonstrating flexed trunk rotation with legs/knees bent at 50 degrees.

Figure 12:
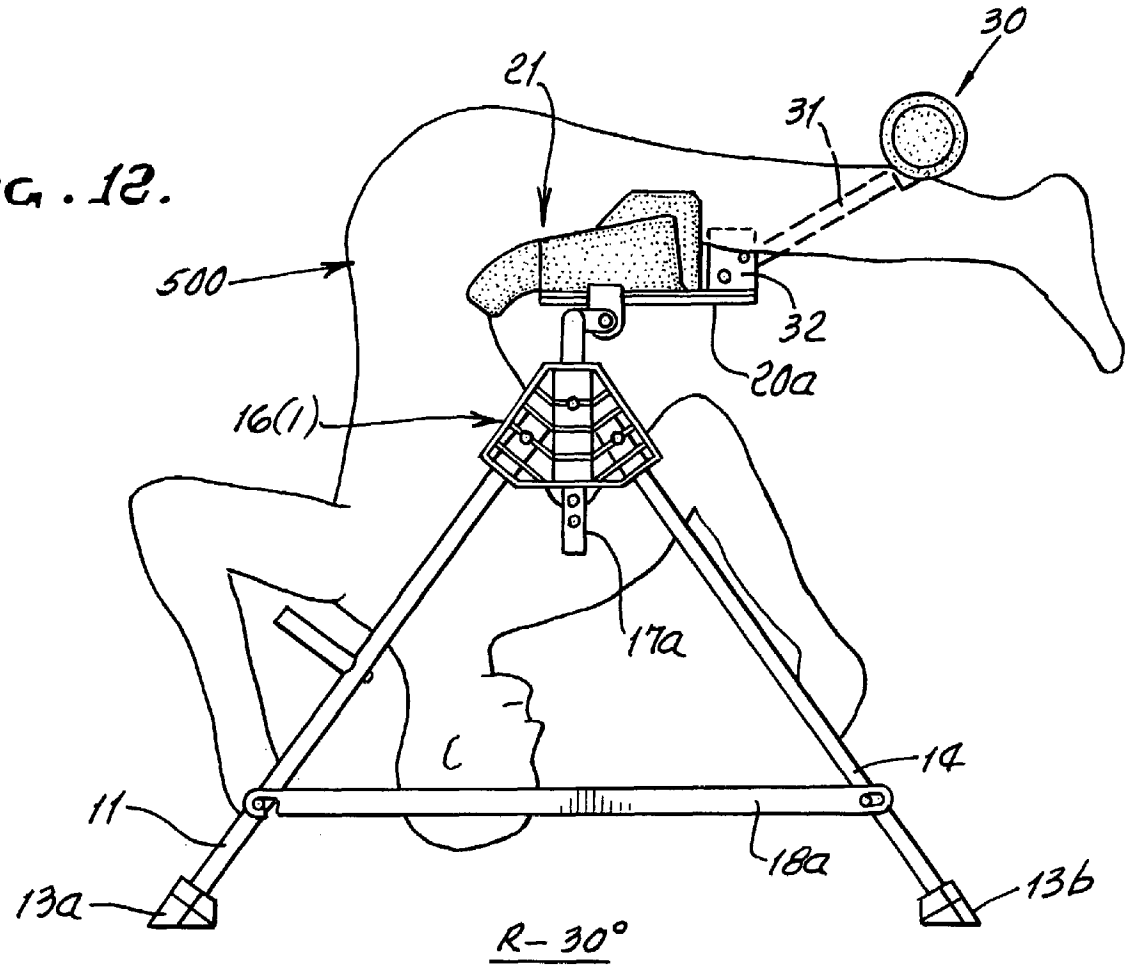
FIG. 12 is a side elevation as in FIG. 4 showing knees flexed by apparatus at 30 degrees.

In FIG. 12, the method and apparatus are again basically the same as FIGS. 1-11 with side/lateral view of body demonstrating flexed trunk rotation with legs/knees bent at 30 degrees.

Figure 13:
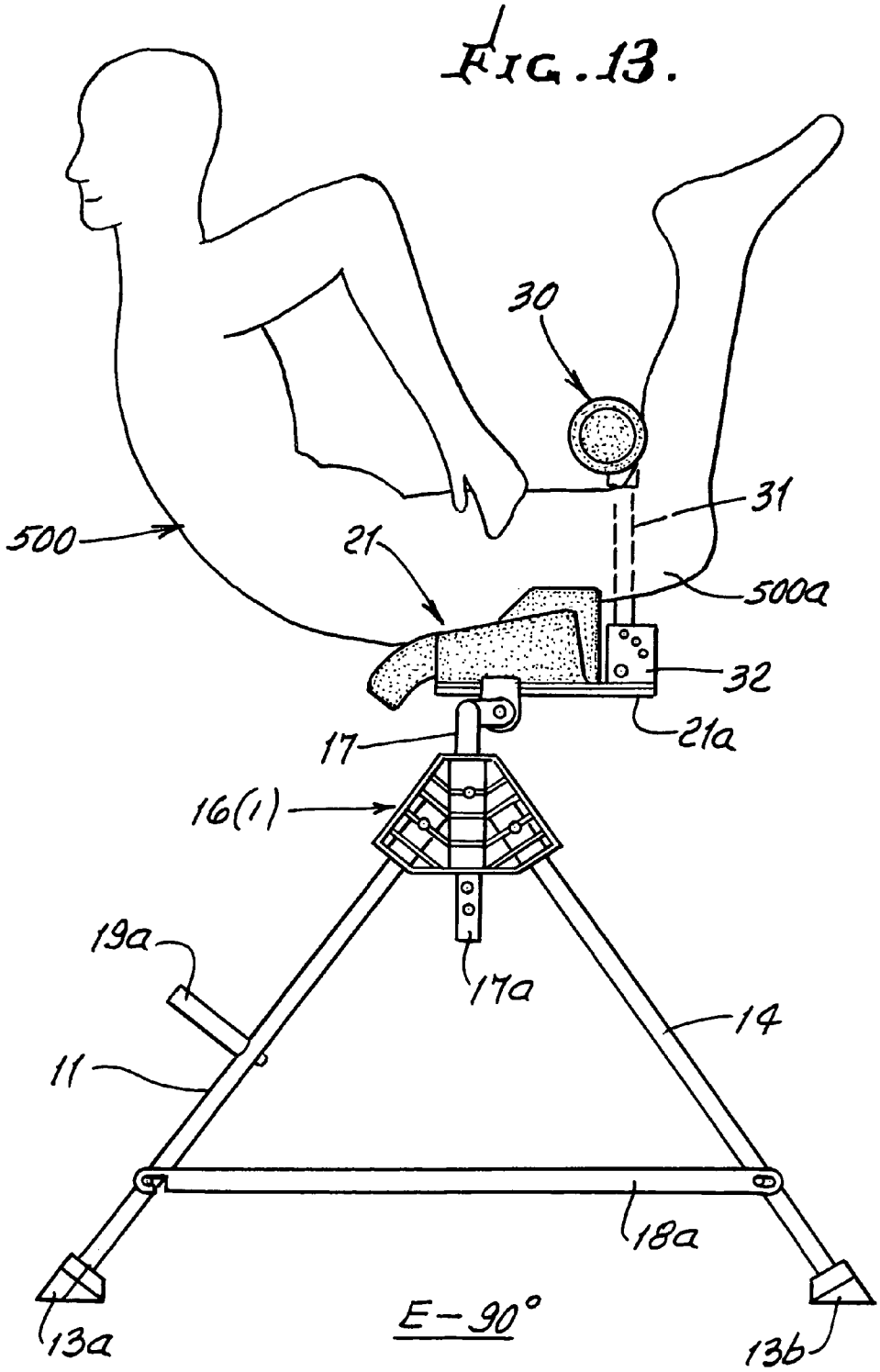
FIG. 13 is a side elevation as in FIG. 4 showing legs at 90 degrees, knees flexed by apparatus at 90 degrees.

In FIG. 13, the method and apparatus are again basically the same as FIGS. 1-12 with side/lateral view of body demonstrating a trunk extension with legs/knees 500 bent at 90 degrees.

Figure 14:
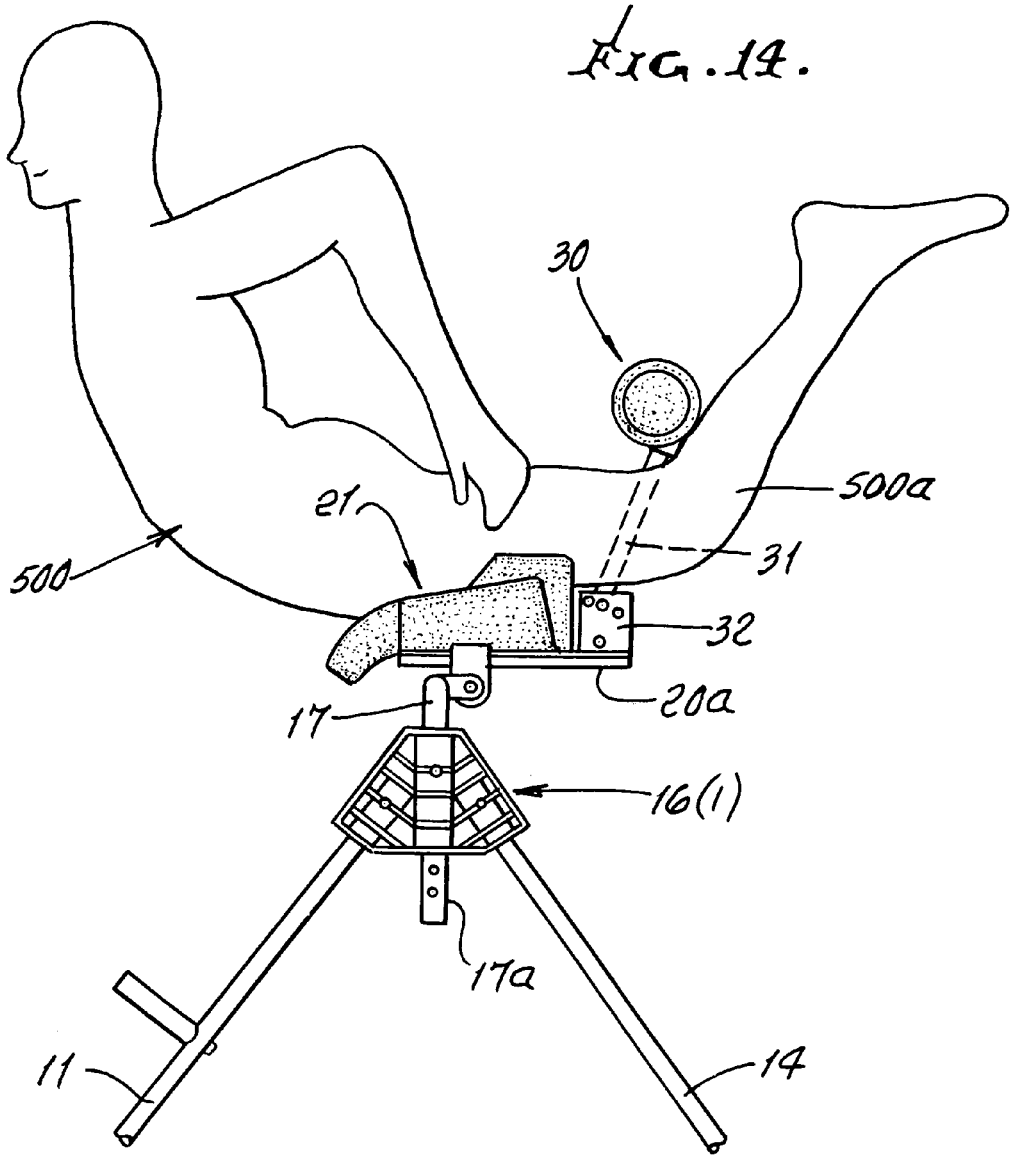
FIG. 14 is a side elevation as in FIG. 4 showing legs at 70 degrees, knees flexed by apparatus at 70 degrees.

In FIG. 14, the method and apparatus are again basically the same as in FIGS. 1-13 with side/lateral view of body demonstrating trunk extension with legs/knees 500 bent at 70 degrees.

Figure 15:
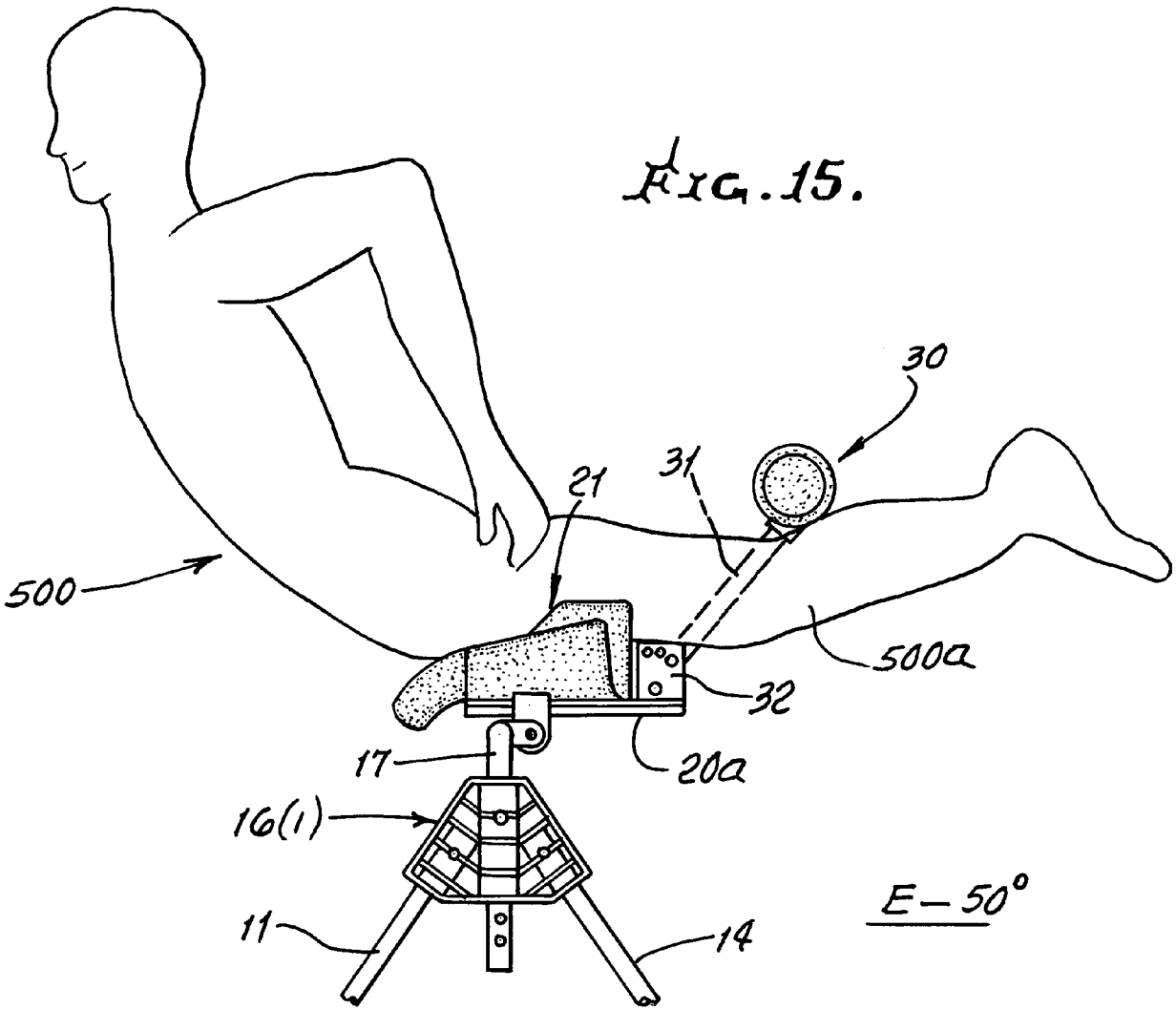
FIG. 15 is a side elevation as in FIG. 4 showing legs at 50 degrees, knees flexed by apparatus at 50 degrees.

In FIG. 15, the method and apparatus are again basically the same as FIGS. 1-14 with side/lateral view of body demonstrating trunk extension with legs/knees bent at 50 degrees.

Figure 16:
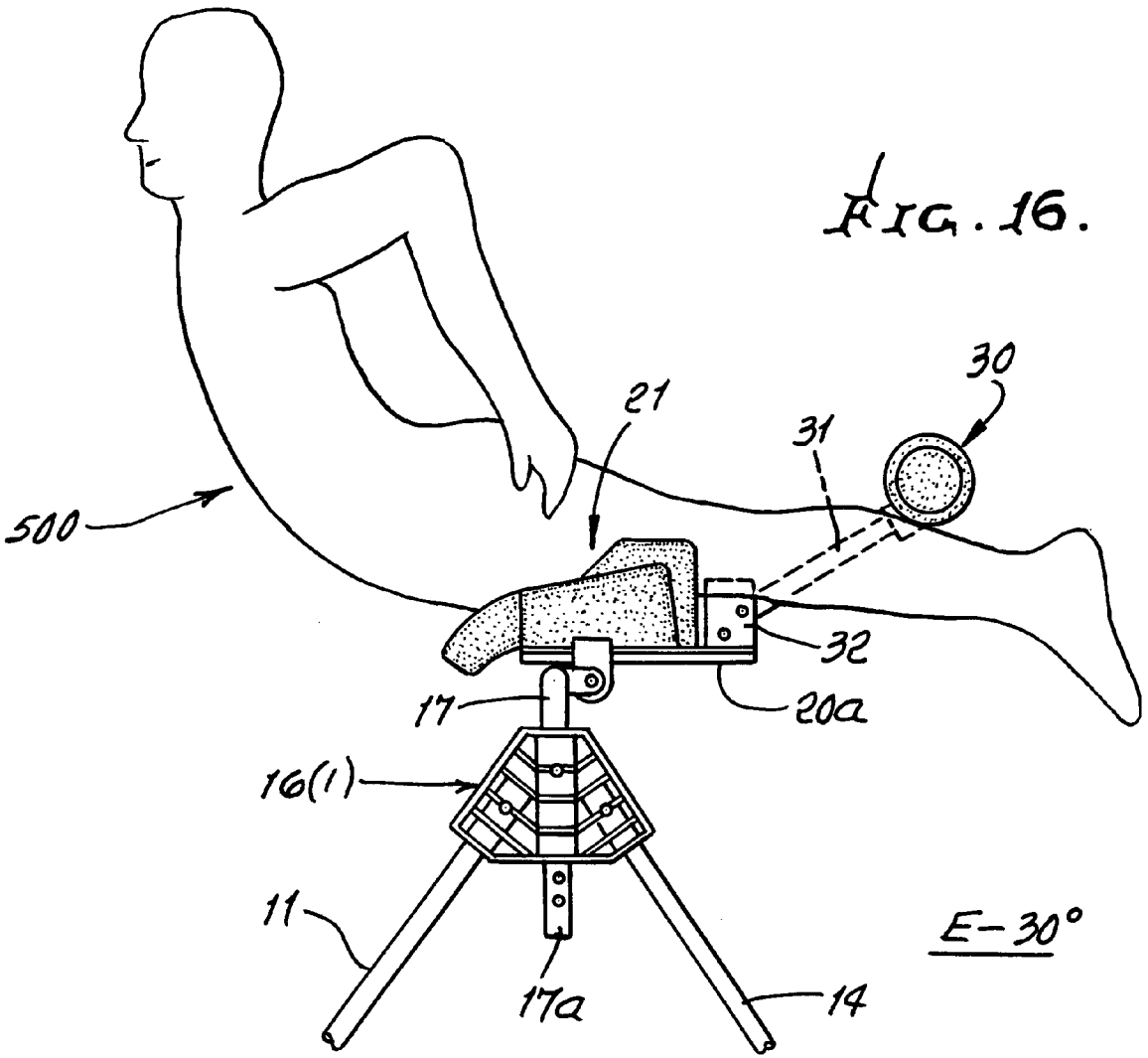
FIG. 16 is a side elevation in FIG. 4 showing legs at 30 degrees, knees flexed by apparatus at 30 degrees.

In FIG. 16, the method and apparatus are again basically the same the same as FIGS. 1-15 with side/lateral view of body demonstrating trunk extension with legs/knees bent at 30 degrees.

Figure 17:
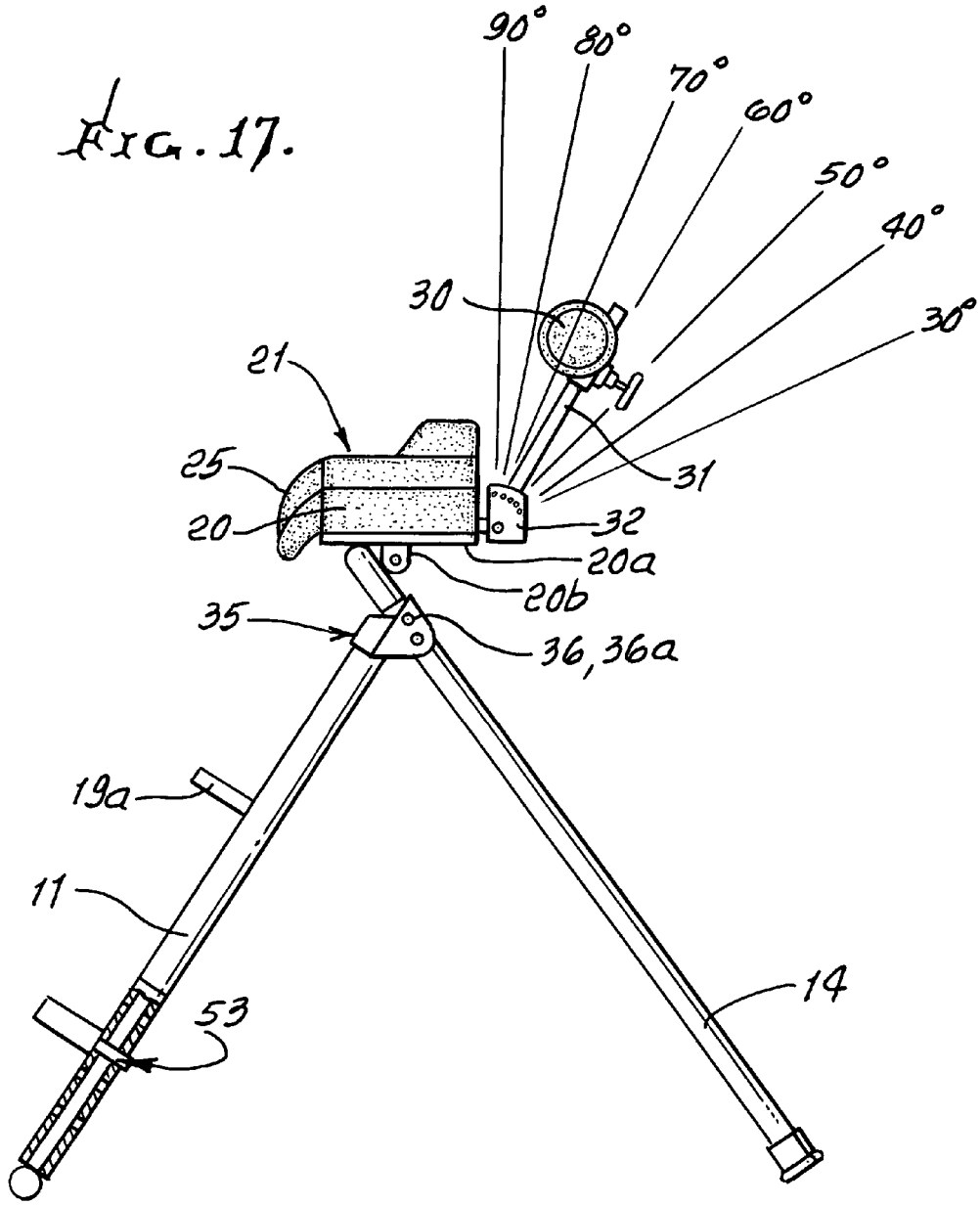
FIG. 17 is a side elevation showing modified apparatus A-frame with triangular hinge joint and telescopic front legs with vertical adjustable rear post and variable horizontal T-bar brace with calf/knee pads shown at 90, 80, 70, 60, 50, 40, 30 degrees more or less and this is applicable to A-Frame, single or double/bilateral post support frames.

In FIG. 17, the method and modified apparatus, shown include an A-Frame hinged at 35 and secured in place by means of 36*a* pivot bolt in pivot hole 36, telescopic front legs 11 and 12 with grip security pin 53 to set the elevation. Handgrip 19*a* stabilizes user, on mounting and using the apparatus. This modified apparatus demonstrates multiple and variable positions and includes components as described before.

Figure 18:
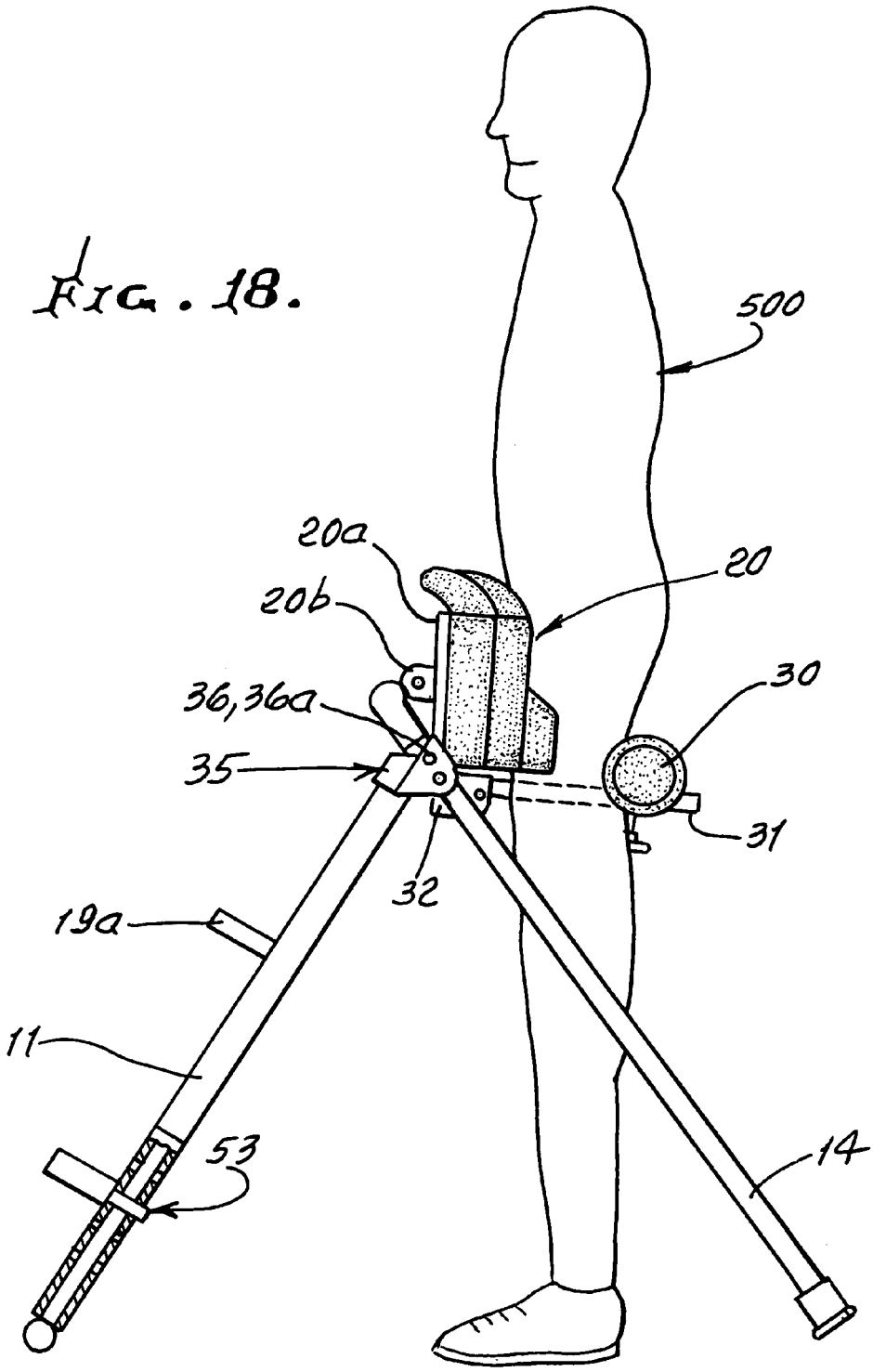
FIG. 18 is a side elevation as in FIG. 17, with the user standing in a vertical mounting position between the saddle seat and adjustable vertical post.

In FIG. 18, same as FIG. 17, the modified apparatus and method shows body 500 standing in a vertical up right position within 35, the hinged A-Framed, and 20, the flat or contoured winged seat with 20*a* base plate and other means, positioned at a 90 degree angle, parallel to the floor.

Figure 19:
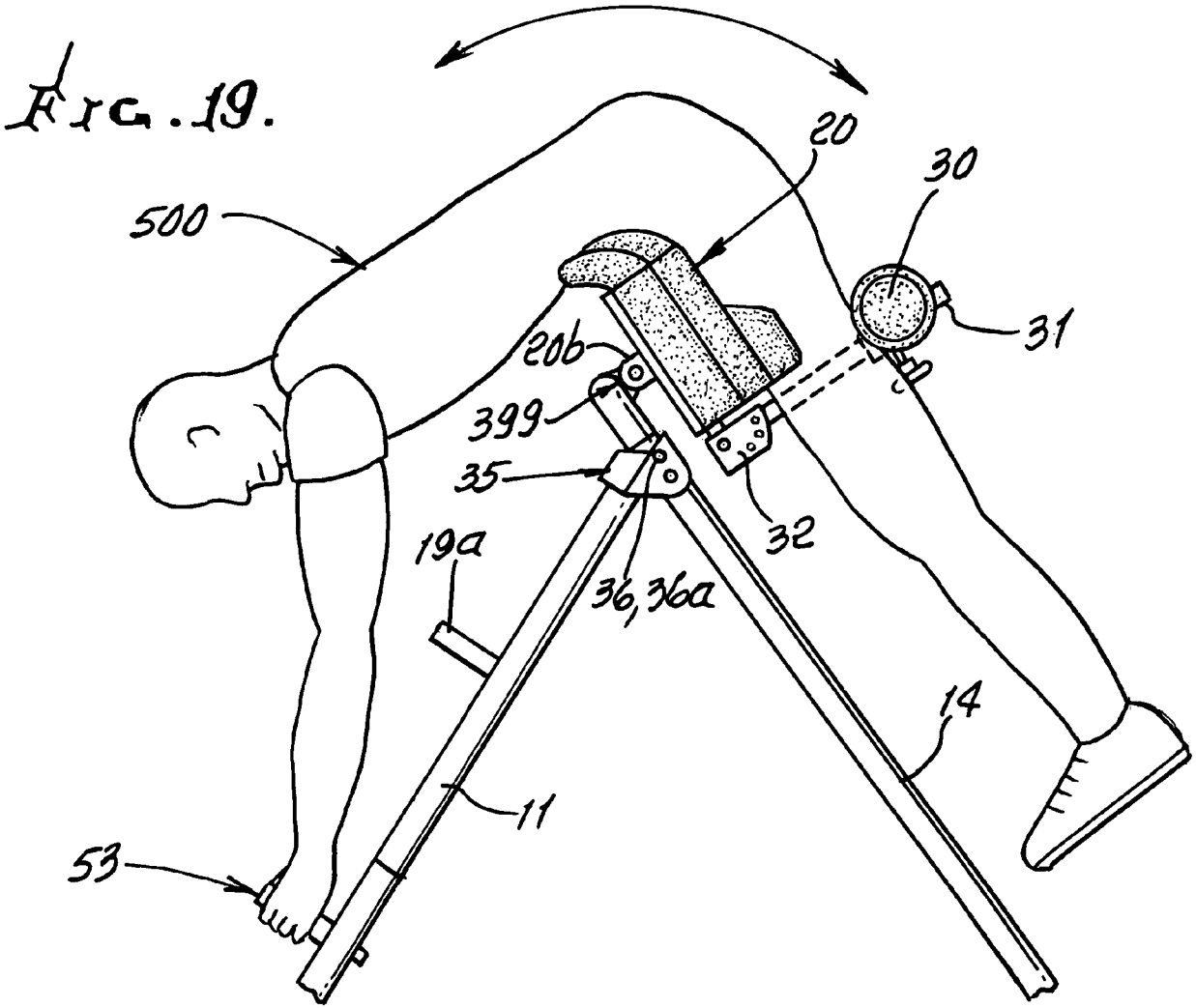
FIG. 19 is a side elevation as in FIG. 17 showing the user in a modified flexed position.

In FIG. 19, the modified apparatus and method is shown with the user in a semi flexed cradling position within the A-Framed device. During this method, the user and seat are rocked/cradled from 0-210 degrees more or less, seat 20 is set as shown. Hinge 35 is locked by means 399. Grip security pin 53 sets the elevation in front legs.

Figure 20:
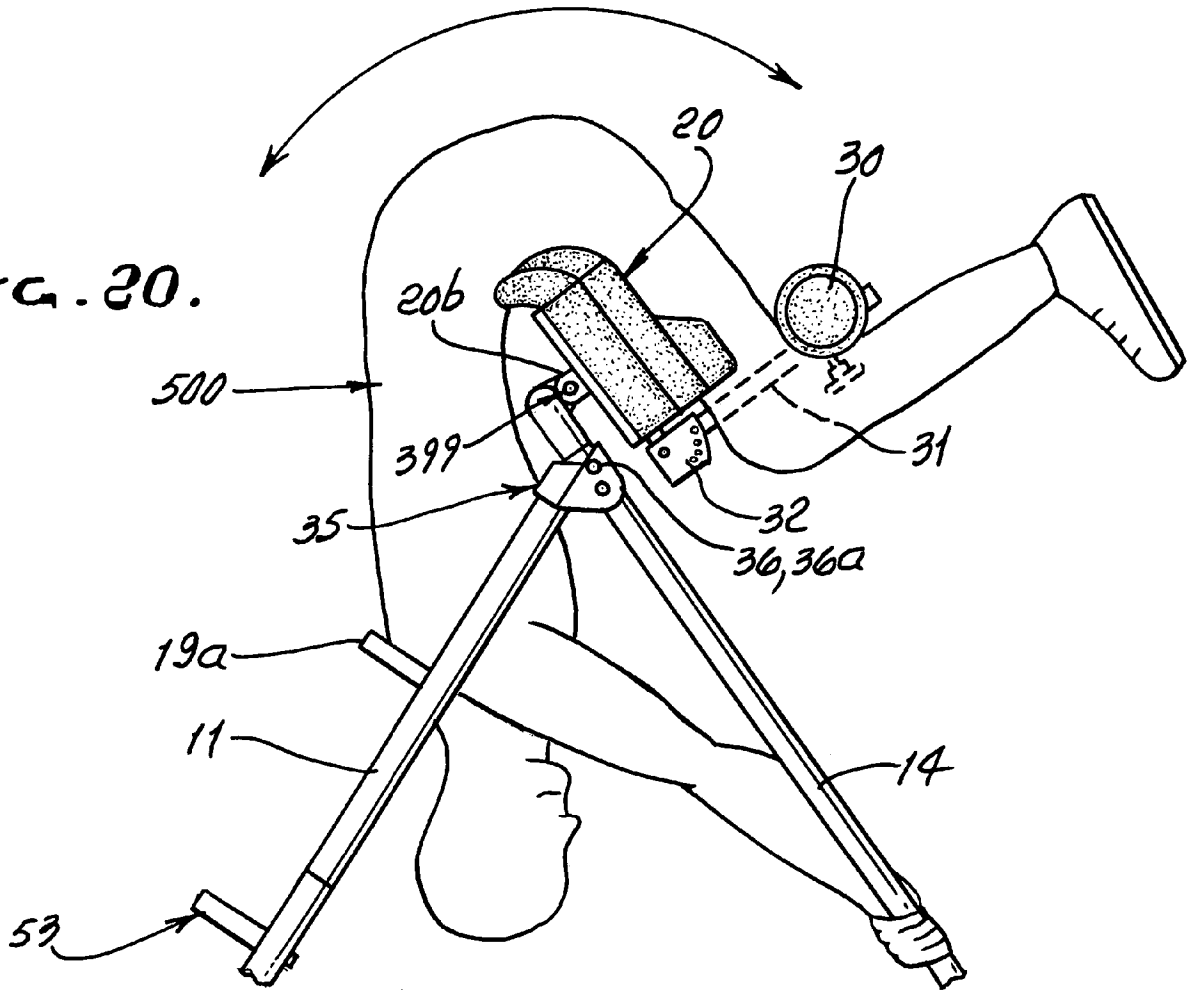
FIG. 20 is a side elevation as in FIG. 17 showing the user in a truck/knee flexed position with arms extended to rear frame.

FIG. 20, same as FIG. 19, the modified apparatus and method showing the user in a semi flexed cradling position hands/arms extended to rear legs within the A-Framed hinged device. During this method, the user and seat are rocked/cradled from 0 degrees flexion to 90 degrees more or less, seat 0 degrees vertical to 90 degrees horizontal parallel to the floor more or less.

Figure 21:
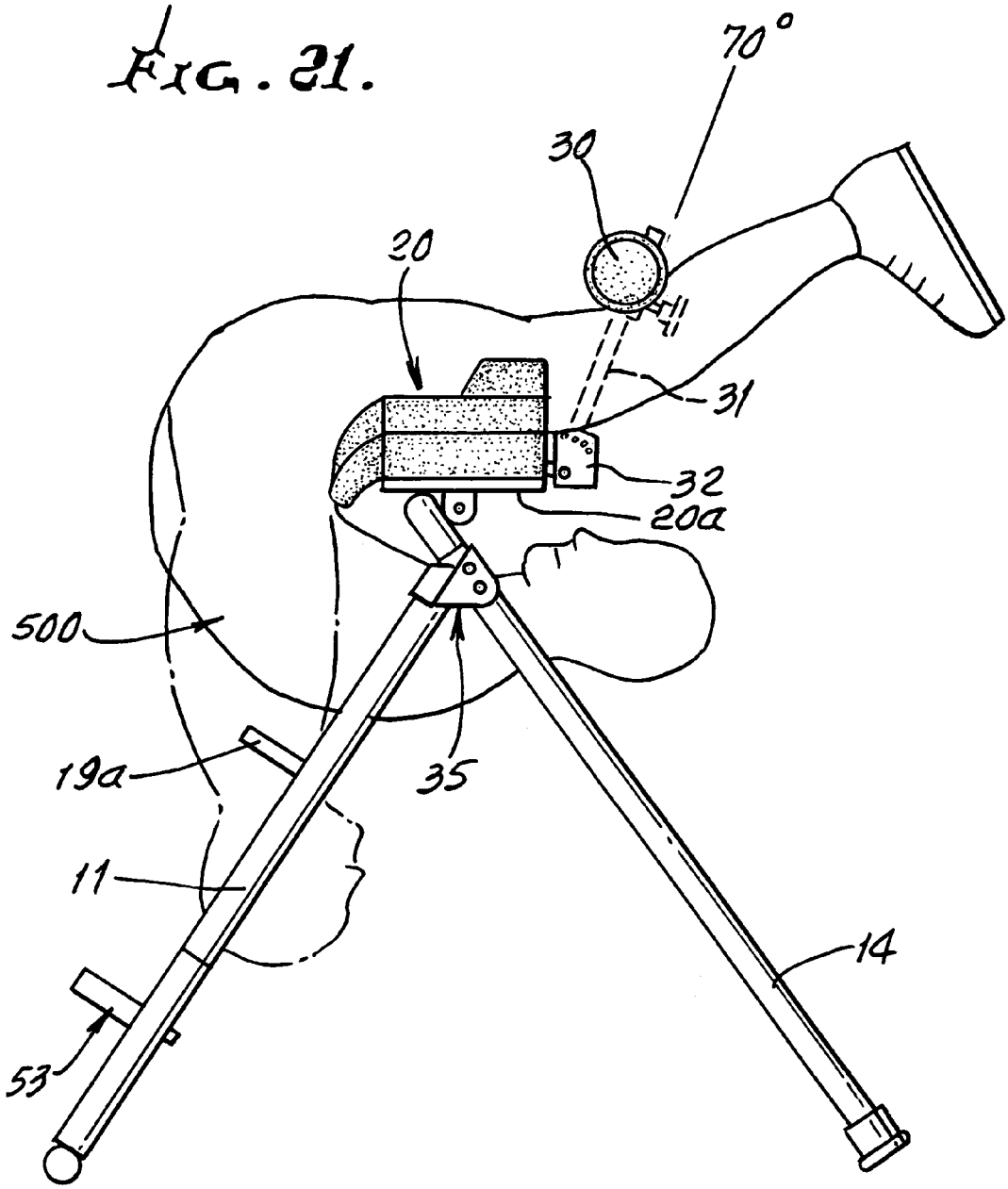
FIG. 21 is a side elevation as in FIG. 17 showing the user hanging in a spiral/trunk flexed position legs bent by apparatus at 70 degrees or variation thereof.

FIG. 21, the modified apparatus and method shows the user in a tucked flexed position hands/arms position.

Figure 22:
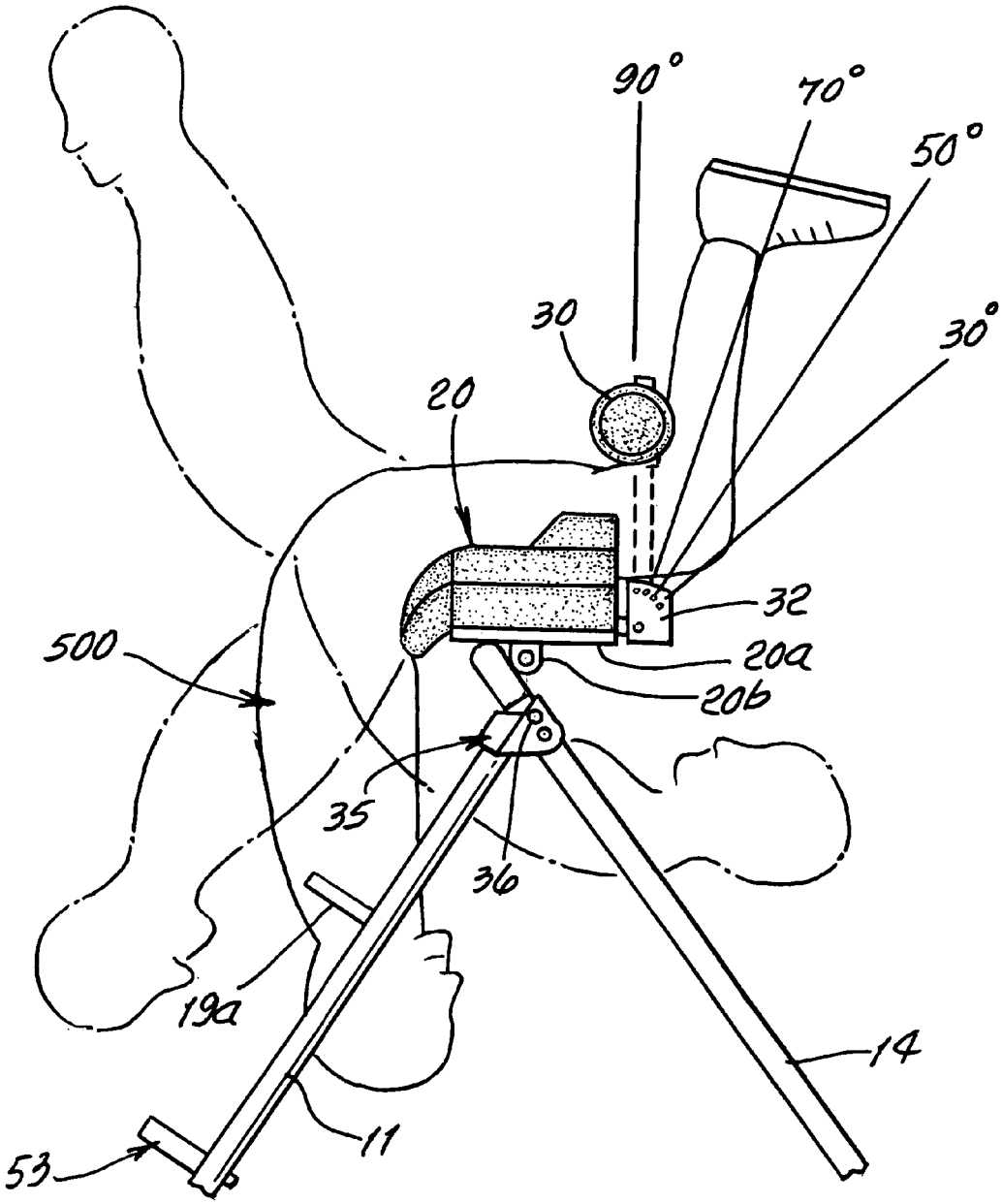
FIG. 22 is a side elevation same as in FIG. 17 showing the user hanging in spinal/trunk flexion/extension positions with legs bent by apparatus at 90 degrees or variation thereof.

FIG. 22, the modified apparatus and method shows the user in a full trunk extended to tucked flexed position hands/arms position may be variably positioned within the A-Framed hinged device. During this method the user performs a full hyper extended to inverted abdominal curl with seat horizontal parallel to the floor.

Figure 23:
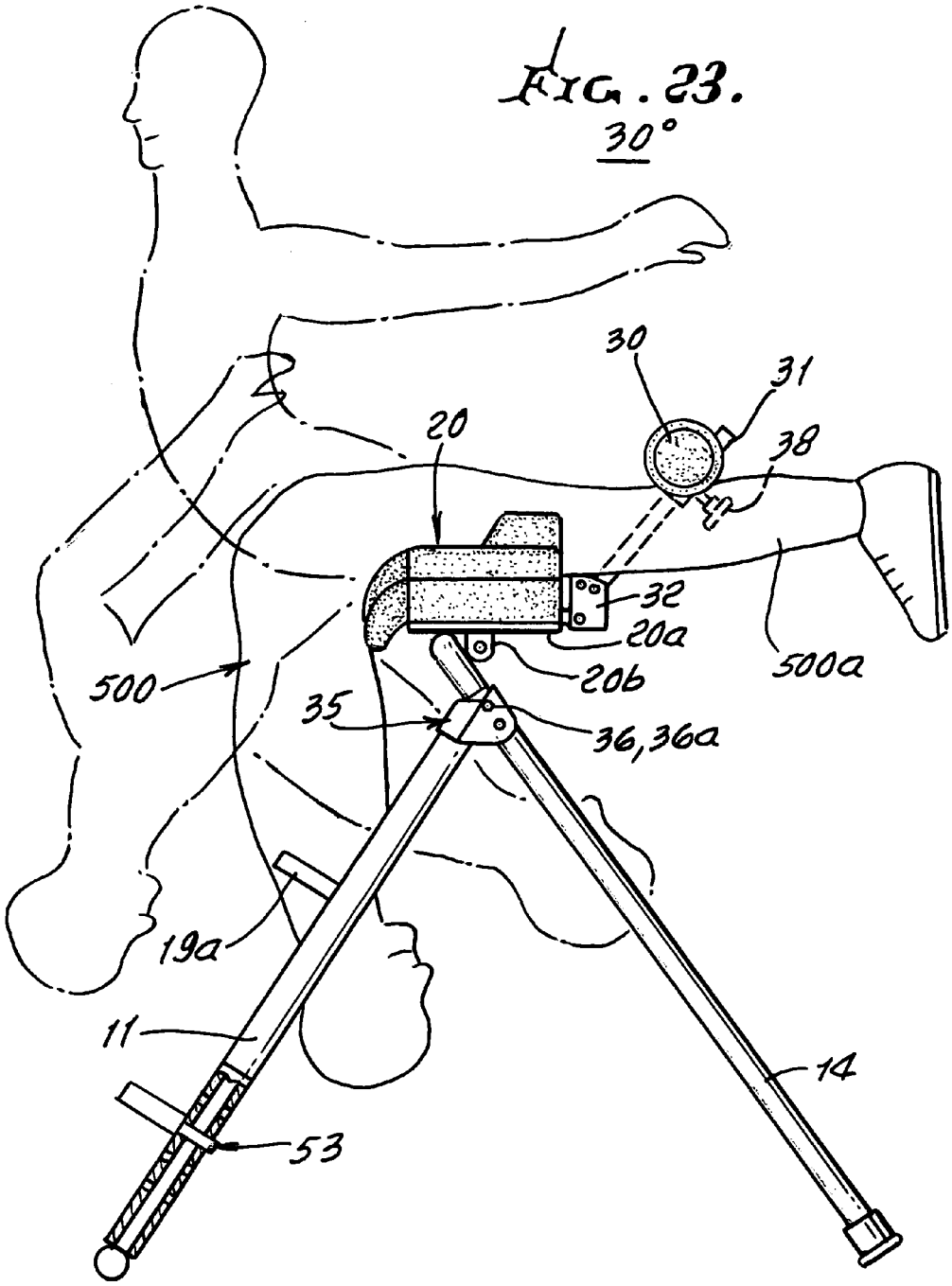
FIG. 23 is a side elevation as in FIG. 17 showing the user hanging in spinal/trunk flexion/extension positions with legs bent by apparatus at 30 degrees or variation thereof.

FIG. 23, same as FIG. 22 with user's legs extended at angle set at 30 degrees.

FIG. 24 is a side elevation showing the modified apparatus and method with posterior 45 degree double/bilateral legs or posts 101 providing support adjoining the floor base support frame 102, the user hanging in a spinal/trunk flexed position legs bent 90 degrees, adjustable vertical post 31 with variable horizontal T-bar brace 30 and calf/knee pads behind the legs 61, 62, knees bent 90 degrees, again generally the same as in FIGS. 1-23, the platform 20 flat or contoured seat, 20*a*, 20*b*, 21*a*, 21*b*, 22*a* and 22*b* and crosspiece assembly 30-38 the same. A grip bar 110 is added to project below a platform 20, base plate 20*a* to have connection with the platform, to be hand gripped by the user, as seen in FIG. 24. This allows the user to pull himself or herself upwardly in a flexion abdominal curl toward the underside of the platform from the position, as seen in FIGS. 24-27, to thereby even further relieve spinal pressure in the spin and more specifically the lumbar and sacroiliac region. Also, the user may extend his or her arms to extend backwards FIGS. 13-16, 22, 23 or into FIGS. 8-12 position and controllably twist the trunk, as enabled by left and right hand push or pull on the grip bar or bars. Also in FIGS. 2 4, the forward legs 100 and 101 of the apparatus extend downwardly in diverging relation to connect to a base 102 having U-shape, as shown, and to project beneath the platform 20, base plate 20*a*, 30 variable horizontal T-bar brace and pads, 31 central rigid telescopic vertical member, 37 vertical post adjustable slider are set at a 90 degree angle or any variation thereof from 90-30 degrees more or less with knees/legs bent at 90 degrees.

FIG. 25 same as FIG. 24 with knees/legs 500 bent at 70 degrees.

FIG. 26 same as FIG. 24 with knees/legs bent at 50 degrees.

FIG. 27 same as FIG. 24 with knees/legs bent at 30 degrees.

FIGS. 28-33 show a modified version and method of the FIGS. 1-27 apparatus, wherein the support means for the platform 20 flat seat or contoured winged seat and base plate 20*a* comprises two laterally spaced vertical upright posts 350 and 351, and an upper lateral member 352 carried by 350 and 351. A hinge at 353 has elements plate 354 and 355 respectively connected to 352 (the top of 351) and to the platform 20 underside, as seen in FIG. 28. A lower lateral member 357 as seen in FIGS. 28*a* and 28*b* connects the lower ends of uprights 350 and 351, and elongated horizontal support struts 365*a* and 366*a* connect to 350, 351 and 357. The structure/means/support and method of creating variable leg/thigh/trunk support are the same as in FIGS. 1-27, and the crosspiece 30 may be carried by a central rigid telescopic vertical member 31 which extends downwardly and merges with a rigid U-shaped member 32 attached to the seat base plate by bolt 32*a* or other means with variable hole 32*b* by means of a security pin 35*c*. The angle may be altered at 90, 70, 50 or 30 degrees or variations thereof more or less, attached to the platform. (See FIGS. 1*b*, 1*c* and 1*d*). Adjustable vertical post 31 within 32, with variable horizontal T-bar brace 30, 37 vertical post slider and calf/knee pads 61, 62 behind the legs/calf/knee/legs make up the elements that support the user and allow him to flex his knees at 90 degrees more or less in the same manner as in FIGS. 1-27. Uprights 350 and 351 may each include lengthwise, height adjustable sections 350*a* and 350*b*, and 351*a* and 351*b*, as seen in FIGS. 28, 28*a*, to vary the elevation of parts 20 (flat or contoured winged seat) and leg support apparatus 30. Security pins 361 and 362 fit through holes 363 and 364 in the sections 351*a*, 351*b* and 350*a* and 350*b*, to secure them in lengthwise adjusted positions. Hand holds 365 and 366 are provided on support struts 365 and 366*a*, handholds 367 and 368 are provided on support 365 and 352.

In FIG. 29 the exercise method and positions of the user 320 include a trunk hyper extended position with leg support apparatus 30, 30*a*, 31, 37 set at a 90 degree angle with knees/legs bent at 90 degrees. FIGS. 29, 29*a*, 29*b* and 29*c* show varying angle degrees 90-30 and demonstrate the unique versatility of the method of exercise allowing the user to assume multiple angles of trunk/thigh/knee/leg positions stretching one side of the body while strengthening the other.

FIG. 29*a* same as FIG. 29 in a trunk hyper extended position with leg support apparatus 30, 30*a*, 31, 37 set at a 70 degree angle with knees/legs bent at 70 degrees.

FIG. 29*b* same as 29 with leg support apparatus 30, 30*a*, 31 set at a 50 degree angle with knees/legs bent at 50 degrees.

FIG. 29*c* same as 29 with leg support apparatus 30, 30*a*, 31 set at a 30 degree angle with knees/legs bent at 30 degrees.

FIG. 30 note the exercise method and positions of the user 320 in a trunk flexed or abdominal curl position with leg support apparatus 30, 30*a*, 31, 37 set at a 90 degree angle with knees/legs bent at 90 degrees. FIGS. 30, 31, 32 and 33 show varying degrees 90-30 of body positioning, and more or less demonstrate the versatility of the method of exercise, allowing the user to assume multiple angles of trunk/thigh/knee/leg positions stretching one side of the body while strengthening the other.

FIG. 31 method and apparatus same as FIG. 30 in a trunk flexed or abdominal curl position with leg support apparatus 30, 30*a*, 31, 37 set at a 70 degree angle with knees/legs bent at 70 degrees.

In FIG. 32, method and apparatus same as FIG. 30 show a trunk flexed or abdominal curl with leg support apparatus, set at a 50 degree angle with knees/legs bent at 50 degrees.

In FIG. 33, method and apparatus as in FIG. 30 show trunk flexed or abdominal curl with leg support apparatus 30, 30*a*, 31 set at a 30 degree angle with knees/legs bent at 30 degrees.

In FIGS. 34, 34*a*, 34*b*, 34*c*, 34*d*, 34*e*, 34*f* and 34*g* method and apparatus in the same, with platform 120, seat 20*a* base plate and support apparatus 20*b* pivot support mechanism, 20*c* pivot hinge and that leg/knee/thigh crosspiece 30 generally the same as previously described; however, the rear crosspiece 30 extends or projects forwardly over a major extent of the platform, as shown. The user's legs or thighs fit between 120 seat and 30 leg/knee/thigh support apparatus, as in FIGS. 34*a*, 34*b*, 34*c*, 34*d*, 34*e*, 34*f* and 34*q* as the user bends forward on the crosspiece 30 against the user's thighs, the body tilted and pivoted forward during exercise involving pivoting of both the platform and the crosspiece (carried by the platform) about a horizontal axis as between the solid and broken line positions seen in FIG. 34. For example, pivoting of the seat may be through a range between 0 degrees to 90 degrees, more or less, while pivoting of hate body 320 may vary, full flexion to full extension. A single horizontal post 90 and single telescopic vertical post 97 are interconnected by single vertical post 97*a* and secured by means of 97*b* security pin, these single vertical posits 97, 97*a*, 90 in combination supporting the platform for such pivoting. A U-shaped horizontal base 98 is connected to the vertical post 97, 97*a*, 90 and extends under the platform counterbalancing the platform and crosspiece. A rear projection 98*a* non skid push off pad enables the user to gain maximum traction to accomplish an inverted posture without slipping. Stabilizing hand grips 99 help the user control postural positions when mounting and exiting the apparatus. Like all other apparatuses as mentioned in FIGS. 1-33, full trunk extension and flexion can be achieved with adduction and internal rotation of the OS illium/pelvis or abduction and external rotation of the os illium/pelvis.

FIG. 35 method and apparatus is same as FIGS. 34, 34*a*, 34*b*, 34*c*, 34*d*, 34*e*, 34*f* and 34*q*, the exercise positions indicated and methods of the user with legs/knees/thighs bent or positioned at a 90 degree angle, more or less, defining this rehabilitative, decompression exercise device.

In FIG. 35 the platform 120 is generally like that shown in FIGS. 1-34 with seat 20 flat or contoured referenced as seat 120, but is unitary i.e., the concave portion 80' and the lateral superiorly flared winged seat 81 being integral with the rest of the platform.

The crosspieces 30, 30*a*, 31 are set for a 90 degree angle, with knees/legs bent at 90 degrees. A single post structure 132 is connected at its upper end to the platform, as via horizontal extent 132*a*, and which may include sections 132*b* and 132*c* for telescopic and adjustable interconnection, as by security locking pin 134. The section 132*a* is attached at 135 to a horizontal base member 136 projected beneath the platform 120. Lateral horizontal members 137 and 138 are connected to the base 136 and project laterally to stabilize the structure. Note the user 140 in a leg or thigh support mode, via the platform and crosspiece and with trunk hanging below platform level, enabling twisting as shown to help relieve pressure at the cervical, thoracic, lumbar and sacroiliac. Positions demonstrated in FIGS. 1-34 can be achieved using this apparatus, all trunk extension/flexion and abductor/adductor decompression and rehabilitation methods of exercises included.

In FIG. 35*a* method and apparatus are made as FIG. 35, with rear leg/knee/thigh support apparatus 30, 30*a*, 31 set at a 110 degrees or more.

In FIG. 35*b* method and apparatus are same as FIG. 35, with rear leg/knee/thigh apparatus 30, 30*a*, 31 set at a 70 degree angle with knees/legs bent at 70 degrees.

In FIG. 35*c* method and apparatus are same as FIG. 35, with rear leg/knee/thigh apparatus 30, 30*a*, 31 set at a 50 degree angle with knees/legs bent at 50 degrees.

In FIG. 35*d* method and apparatus are same as FIG. 35, with rear leg/knee/thigh apparatus 30, 30*a*, 31 set at a 30 degree angle with knees/legs bent at 30 degrees.

In FIG. 35*e* method and apparatus as shown demonstrate the versatility of positioning vertical post 31 into rigid U-shaped member 32 attached at 32*a* to the base plate with anterior hole 32*a* or posterior hole 34. Repositioning from hole 32*a* to 34 allows for greater options and range of motion of 31 increasing flexion of leg/knee/thighs to 110 degrees or more. Like all other apparatuses mentioned FIGS. 1-34 full trunk extension and flexion can be achieved with adduction and internal rotation of the os ilium/pelvis or abduction and external rotation of the os ilium/pelvis.

In FIG. 36, shows front, sides, and rear view of the platform 20 winged contoured seat. The tapered sides 21*a* and 22*a* of the lateral winged contoured seat create an abductor or externally rotating of the os ilium when the user applies weight on them, with his/her thighs, during the use of the apparatus, as seen in FIGS. 1*d*, 2-33. The platform 20, winged abductor contoured pad 21*a* and 22*a*, and adductor inner thigh pad 21*b* and 22*b* together define an upwardly facing saddle-like structure, front seat contoured area 24 and 25 that allows the user to comfortably flex his/her trunk, maximizing benefits of performing an inverted abdominal curl while strengthening or stretching the abductor or adductor musculature thereby ensuring the development of symmetrical pelvic balance and spinal decompression at the same time.

FIGS. 36*c* and 36*d* shows an underneath/bottom view of the seat, illustrating front (FIG. 36*c*) and rear (FIG. 36*d*) views, same as FIG. 36, with methods and benefits as described in FIGS. 36, 36*a* and 36*b* the same.

FIG. 37 shows a modification that includes the support means 70 in the form of a forward leg member or members 71 extending almost vertically, and a rearward leg member 72 extending at less than 45 degrees from horizontal, both resting on a support surface 73. Each leg member or members may be telescopically adjustable, as indicated by structure at 74 and 75.

Figure 37B:
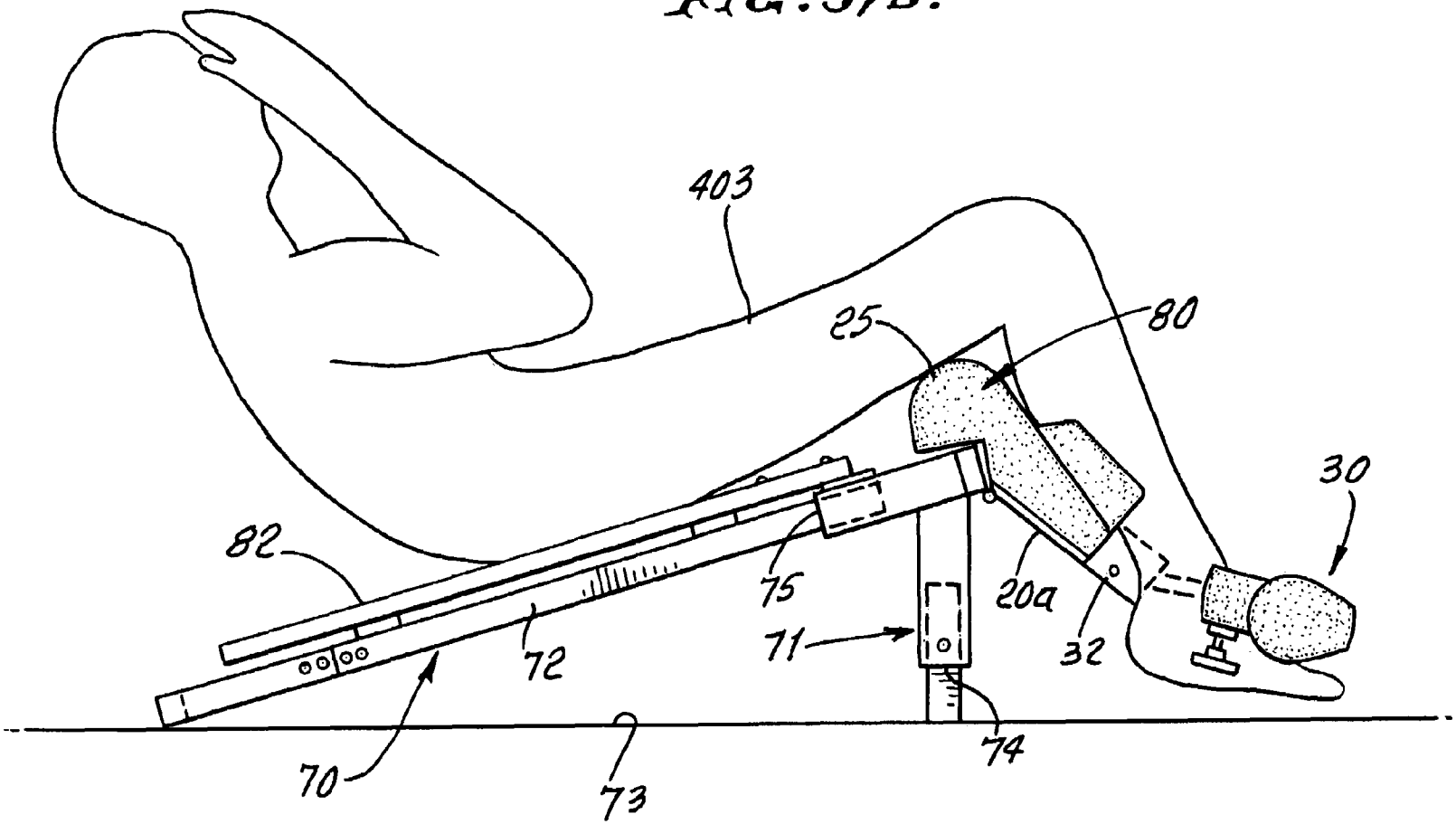

The plat form 80 is generally the same as platform 20 flat or winged contoured seat, base plate 20*a*, but defines an L-shaped notch 81 at its underside to accommodate the platform or rocking or pivoting between the positions shown in FIGS. 37 and 37*b*. Note that the uppermost end of leg member or members 72, indicated at 72*a*, is received in the notch 81 in FIG. 37 position. The remainder of the structure of the platform 80 (20) includes winged contoured seat and crosspiece 30, and their interconnections and variable adjustability central rigid telescopic vertical member 31, which extends downwardly and merges with a rigid U-shaped member 32 attached to the seat base plate 20*a* by bolt 32*a* or other means with variable hole 32*b*. By means of a security pin 32*c*, platform angle may be altered 90-30 degrees, or variations thereof, attached to the platform. (See FIGS. 1*c*, and 1*d*). See also adjustable vertical post 31 within 32 with variable horizontal T-bar brace 30, 37 vertical post slider and calf/knee pads 61, 62 in front of the legs to block upward displacement of the anterior thighs 21 and 22 relative to the platform.

A backboard 82 is secured to the top 72*b* of the leg members 72, to support the back of an user/exerciser whose legs and thighs fit over the structure 80 and 30 in a manner as previously described FIG. 37*b* this device also allows the user to lie on his back on the board 82 and extend his legs 403 over the nose or surface 25 at the locations of the rearward sides of the knees. His lower legs may then extend downwardly and between the structures 80 and 30 with variable adjustable positions from 30 to 90 degrees or more. He may then rock his legs upwardly and downwardly in such position, and also do sit-ups while adducting or abducting his thighs and internally or externally rotating his pelvis, the benefit of which will stabilize core abdominal strength reducing pressure on the spin specifically the lumbar and sacroiliac regions.

I claim:

1. Exercise stretching and rehabilitation method and apparatus, comprising, in combination:

a) means for support including a seat, for supporting the user's thighs, knees, calves, legs, b) a vertical supporting A-frame, upright posts carried by the A-frame, and a cross-member carried by the posts, the cross member having an axis, and the posts being adjustable vertically, c) a horizontal platform carried by the cross member and extending directly beneath the support member for supporting the support member, d) at least one block carried by the cross member to extend directly beneath the platform, the block, platform and means for support being pivotable about said axis, and the posts having tops located to substantially align with the bottom of the platform in platform horizontal position, e) a horizontally adjustable and angularly indexing T-brace pivotably carried by the platform to have multiple selectable fixed upright positions of connection to the platform and above the level of the at least one block, for allowing the user to alter variable leg, knee and thigh positions between about 30° and 90°, and between the platform and the T-brace which allows for a varied and multiple combination of user's trunk positions from flexion to hyperextension and rotation, which in turn allows the user to achieve a greater spinal stretching, decompression, and strengthening of the hamstrings, gluteus maximus, erector spinae and other associated spinal muscles, tendons and ligaments while strengthening abdominal core strength, said posts positioned to allow T-bar rotation between 90 degrees and 30, and body curl under the seat, f) and said seat configured and acting with the platform and T-bar for inducing stretching of the adductor musculature while contracting the abductor muscles producing posterior or external rotation of the user's ilium, thereby inducing distraction of the user's inguinal ligaments and associated adductor musculature anterior as the result of platform pivoting about the horizontal axis with varied degrees of leg, knee, thigh, trunk extension, flexion and rotation.

2. The combination of claim 1, including adjustable calf/leg/knee/thigh pad elements, which can be variably adjusted 90, 70, 50, 30 degrees, substantially.

3. The combination of claim 1 wherein said platform and said seat define a winged saddle providing variable adjustable calf/leg/knee/thigh engagement positions with flexion or extension.

4. The combination of claim 1 wherein the A-frame includes telescopically lengthwise inter-fitting upper and lower members, there being holder structure holding said members in selected positions of lengthwise inter-fit.

5. The combination of claim 1 including a grip bar projecting below the platform and connected thereto, whereby the user's trunk swing between two upright A-frame members, beneath the platform, and permit hand gripping of the grip bar with variable adjustable leg/calf/knee/thigh positions with flexion or extension.

6. The method for controlled exercise, that includes, a) providing a support structure, b) providing a platform to enable user support, c) providing a hinged connection between the platform and the support structure, d) providing a thigh engaging T-shaped crosspiece associated with the platform to extend there above and having a stem with selected indexed rotary positioning relative to the platform whereby the crosspiece and stem have a series of alternate fixed positions of selected angularity relative to the platform to accommodate different leg and thigh support positions of the user, which are accomplished, e) and providing a vertically adjustable post or posts supporting said hinged connection, said support structure including an A-shaped frame and a connector connected to frame legs and adjustably supporting said post or posts, forwardly of said stem, f) the post or posts having a top or tops located to substantially align with the bottom of the platform in platform horizontal position to allow user's body curl beneath the platform engaging a user's body in said controlled exercise for said curling movement.

7. The method of claim 6 wherein said indexed positioning extends within a 60° angular range.

8. The method of claim 7 wherein said indexed positioning extends at approximately 20° angular intervals within said 60° angular range.

9. The method of claim 6 including providing locking pin and orifice selected positioning for establishing said fixed positions.

10. The method of claim 6 including locating said crosspiece in spaced relation to said platform, in each of said indexed fixed positioning of the crosspiece, whereby the user's legs may fit in said space between the crosspiece and the platform.

11. The method of claim 10 including allowing said platform to rotate about a transverse axis defined by said hinged connection.

12. The method of claim 6 including providing structure legs which are effectively assembled to support the platform, and disassembling the legs for transport.

13. The method of claim 12 including providing two delta shaped connections between the legs and the platform.

14. Exercise apparatus, comprising, in combination:

a) a first means for support, b) a platform mounted on the means for support to support a user's legs, there being a hinge connecting the platform to the support means and defining a generally horizontal hinge axis to allow pivoting of the user's trunk about a generally horizontal axis as the user relatively bends his body and his legs, c) a second means for support for supporting the back of the user's body, d) and a third means for rotatably indexing said second support means into fixed positions of selected angularity relative to the hinge axis, and relative to and above the platform, e) a vertically adjustable post or posts, directly forwardly of said third means, for supporting said platform, and an A-frame or frame with legs supporting said post or posts, for vertical adjustment, f) the post or posts having a top or tops located to substantially align with the bottom of the platform in platform horizontal position to allow user's body curl beneath the platform.

15. The apparatus of claim 14 including a contoured seat operatively connected to the platform and carried to tilt with said first means for support.

16. The apparatus of claim 15 including a notch formed in the underside of the seat to receive a part of the support means as the seat and means for support relatively rotate.

17. The method of claim 6 with the user seated on said support structure, with his legs extending over the platform, his feet extending beneath the crosspiece, the user then flexing his body.

18. The method of claim 6 wherein the user's body is carried in relation to said platform and T-shaped crosspiece, and oriented successively in selected ones of the following positions:

$x_1$) body trunk flexion/inverted abdominal and, knees bent at angle selected from the group of about 90, 70, 50 and 30 degrees;

$x_2$) body in semi-flexed cradled position;

$x_3$) body in tucked and flexed position;

$x_4$) body in full trunk extended to tucked flexed position;

$x_5$) same as step $x_4$, with legs extended;

$x_6$) body hanging in a spinal/trunk flexable position, legs bent;

$x_7$) same as step $x_6$) with use pulling body upwardly in a flexion abdominal curl to relieve spinal pressure;

$x_8$) same as step $x_6$ with knees bent at selected angularity;

$x_9$) user's thighs supported on platform, and legs extended adjacent crosspiece;

$x_{10}$) same as step $x_9$ with user's trunk hanging below level of platform;

$x_{11}$) same as step $x_9$ with user's trunk extended horizontal.

* * * * *